US005263822A

United States Patent [19]

Fujio

[11] Patent Number: 5,263,822

[45] Date of Patent: Nov. 23, 1993

[54] SCROLL COMPRESSOR WITH LUBRICATION PASSAGES TO THE MAIN BEARING, REVOLVING BEARING, BACK-PRESSURE CHAMBER AND COMPRESSION CHAMBERS

[75] Inventor: Katuharu Fujio, Shiga, Japan

[73] Assignee: Matsushita Electric Industrial Co., Ltd., Osaka, Japan

[21] Appl. No.: 720,789

[22] PCT Filed: Oct. 31, 1990

[86] PCT No.: PCT/JP90/01400

§ 371 Date: Sep. 3, 1991

§ 102(e) Date: Sep. 3, 1991

[87] PCT Pub. No.: WO91/06763

PCT Pub. Date: May 16, 1991

[30] Foreign Application Priority Data

Oct. 31, 1989 [JP] Japan ..... 1-283561

[51] Int. Cl.[5] ..... F04C 18/04; F04C 29/02

[52] U.S. Cl. ..... 418/55.4; 418/55.5; 418/55.6; 418/57; 418/88; 418/94; 418/99

[58] Field of Search ..... 418/55.4, 55.5, 55.6, 418/57, 88, 94, 97–99

[56] References Cited

U.S. PATENT DOCUMENTS

| | | | |
|---|---|---|---|
| 3,994,636 | 11/1976 | McCullough et al. | 418/55.4 |
| 4,365,941 | 12/1982 | Tojo et al. | 418/55.5 |
| 4,596,521 | 6/1986 | Murayama et al. | 418/55.6 |
| 5,037,278 | 8/1991 | Fujio et al. | 418/55.6 |

FOREIGN PATENT DOCUMENTS

| | | | |
|---|---|---|---|
| 3341637 | 6/1984 | Fed. Rep. of Germany | 418/55.6 |
| 56-165788 | 12/1981 | Japan . | |
| 57-8386 | 1/1982 | Japan . | |
| 57-18491 | 1/1982 | Japan . | |
| 57-35184 | 2/1982 | Japan . | |
| 57-153988 | 9/1982 | Japan . | |
| 57-198384 | 12/1982 | Japan . | |
| 58-65986 | 4/1983 | Japan | 418/55.6 |
| 58-160580 | 9/1983 | Japan . | |
| 59-183095 | 10/1984 | Japan . | |
| 61-213556 | 9/1986 | Japan . | |
| 61-234287 | 10/1986 | Japan . | |
| 61-57935 | 12/1986 | Japan . | |
| 62-87693 | 4/1987 | Japan . | |
| 62-49474 | 10/1987 | Japan . | |
| 63-9692 | 1/1988 | Japan . | |
| 63-131889 | 6/1988 | Japan | 418/88 |
| 1-32088 | 2/1989 | Japan | 418/55.6 |
| 1-177482 | 7/1989 | Japan . | |
| 2-9978 | 1/1990 | Japan . | |

*Primary Examiner*—John J. Vrablik

*Attorney, Agent, or Firm*—Stevens, Davis, Miller & Mosher

[57] ABSTRACT

A scroll compressor includes a discharge oil reservoir chamber that is subjected to a discharge pressure, a bearing oil supply passage for supplying and returning the lubricating oil to the main bearing and a revolving bearing by a viscosity pump; and an oil injection passage having a throttle passage which supplies part of the lubricating oil supplied to at least one of the bearings to compression chambers, thereby lubricating the bearing sliding surfaces supporting most of the compression load so as to reduce wear and frictional resistance.

14 Claims, 26 Drawing Sheets

SCROLL COMPRESSOR WITH LUBRICATION PASSAGES TO THE MAIN BEARING, REVOLVING BEARING, BACK-PRESSURE CHAMBER AND COMPRESSION CHAMBERS

TECHNICAL FIELD

This invention relates to the supply of oil to a bearing portion of a scroll compressor, a fluid passage passing via a back surface portion of a scroll member in connection therewith, and a device for reducing an excessive compression load resulting from the fluid and the fluid passage.

BACKGROUND ART

In a scroll compressor having low vibration and low noise characteristics, an intake chamber is provided at the outer peripheral portion, and a discharge port is provided at the central portion of a volute, and the compressed fluid flows in one direction, and a discharge valve, as used in a reciprocating type compressor or a rotary type compressor to compress the fluid is not needed, and the compression ratio is constant, and depending on operating conditions of the compressor, discharge pulsation is small, and a large discharge space is not needed, and the study for putting it into practical use in various fields has been made.

However, since compression chambers have many sealing portions, a great amount of leakage of the compressed fluid occurs, and particularly in the case of a scroll compressor of a small displacement capacity, such as a cooling medium compressor for home air-conditioning, it is necessary to extremely enhance dimensional accuracies of the volute portion in order to reduce the leakage gap of the compression portion; however, because of complicated shapes of parts and variations in dimensional accuracy of the volute portion, the cost of the scroll gas compressor is high, and variations in performance are large. Particularly, in a low-speed operating condition of the compressor, since the compression time is long, a great amount of gas leakage occurs during the compression, and this compressor has a drawback that its compression efficiency is lower than that of a reciprocating type compressor or a rotary type compressor.

Therefore, as a measure for solving problems of this kind, it is much expected to achieve the optimization of the dimensional accuracy of the volute portion, as well as the improvement of the compression efficiency, by an oil film sealing effect utilizing lubricating oil so as to prevent the gas leakage during the compression, and as disclosed in Japanese Patent Unexamined Publication No. 57-8386, it has been proposed to inject a proper amount of lubricating oil into the compression chambers during the compression to seal a gap of the compression chambers by an oil film of the lubricating oil, thereby improving the above drawback.

Particularly, in the refrigerating air-conditioning field, a scroll cooling medium compressor has been put into practical use, and compressors of a medium- to a large-size class, such as a package air conditioner and a chiller unit, in which a cooling medium volume per suction step is relatively large, have already been mass-produced.

FIG. 1 is an example of a general construction of a scroll cooling medium compressor of a medium- to a large-size 93 class in which the interior of a sealed vessel provides a high-pressure space. In the construction of this Figure, a compression portion and a discharge chamber 1031 are provided at the upper portion, and electrically-operated elements are provided at the lower portion, and an oil reservoir is provided at the bottom portion, and a discharge pipe 1042 serving as a final outlet of the compressor is disposed near the electrically-operated elements. After discharge cooling medium gas and lubricating oil are separated from each other at the discharge chamber 1031, the lubricating oil is returned via oil removal holes 1035 and 1036 to the space accommodating the electrically-operated elements, and is collected in the oil reservoir at the bottom portion, whereas the discharge cooling medium gas passes from the upper portion of the discharge chamber 1031 through another passage 1032 and the space accommodating the electrically-operated elements, and then is again discharged via the discharge pipe 1042. Also, in order to reduce the axial gap of the compression chambers, the lubricating oil at the bottom of the sealed vessel (chamber) 1013 is passed through an oil lift hole 1019 formed in a crankshaft 1008, a gap in a bearing for a frame 1009 which supports the crankshaft 1008 and fixedly holds a fixed scroll 1003, and a gap in a crankshaft portion of the crankshaft 1008 to lubricate sliding surfaces of the bearing, and then is caused to flow into a back-pressure chamber 1025 provided at the back surface of a revolving scroll 1006, and the back surface of the revolving scroll 1006 is urged by the lubricating oil, decreased to a medium pressure midway in the flow path thereof, and the high-pressure lubricating oil at the upper portion of the crankshaft portion. The back pressure urging force is so determined that it will prevent the revolving scroll 1006 from moving apart from the fixed scroll against the pressure of the compression chambers.

The lubricating oil in the back-pressure chamber 1025 flows through a back-pressure hole 1017, formed in a mirror plate 1004 of the revolving scroll 1006, into the compression chambers 1015 during the compression, and then is compressed and discharged, together with the intake cooling medium gas, while sealing the gap of the compression chambers 1015, and is discharged to the discharge chamber 1031 (Japanese Patent Unexamined Publication No. 56-165788).

However, in the above construction as shown in FIG. 1 in which the lubricating oil is supplied to the two sliding portions (the sliding portion of the upper bearing mounted on the frame 1009 supporting the crankshaft 1008 and the sliding portion of the bearing of the crank portion for revolving the revolving scroll 1006) engaged with the crankshaft 1008, and thereafter flows into the compression chambers 1015, there are many portions of flow into the compression chambers 1015, and the heated lubricating oil of high pressure and the cooling medium gas introduced into the lubricating oil flow into the compression chambers 1015 during the compression, so that there has been encountered a problem that the compression efficiency is lowered.

Further, the compression portion is provided at the upper portion, and the oil reservoir is provided at the bottom portion, and the supply of the oil to each of the bearing portions engaging the crankshaft 1008 is performed utilizing the pressure differential between the oil reservoir subjected to the discharge pressure and the compression chambers 1015 during the compression, and a centrifugal pumping action of the oil feed hole 1019 formed in the crankshaft 1008. In this construction, when the discharge pressure is not increased and the temperature of the lubricating oil is low in a low-speed operating condition as at the initial stage of the activation of the compressor, the pressure of the compression chambers 1015 during the compression is higher than the pressure of the lubricating oil in the oil reservoir, so that the pressure-differential oil supply can not be performed, and besides it is difficult to supply the lubricating oil of high viscosity by the centrifugal pumping action, and therefore it has been encountered a problem that the sliding portions engaged with the crank shaft 1008 are subjected to seizure.

Further, when the pressure of the oil reservoir at the initial stage of the activation of the compressor is low, the pressure differential oil supply from the oil reservoir at the bottom portion to the bearing portion supporting the crankshaft can not be performed as described above, and in addition the compressed cooling medium gas in the compression chambers 1015 during the compression flows reversely through the back-pressure chamber 1025 even to the gap in the bearing of the crankshaft 1008, and expels the lubricating oil residing in the very small bearing gap at the crankshaft 1008. As a result, there has been encountered a problem that the generation of the seizure of the crankshaft 1008 at the initial stage of the activation of the compressor is promoted.

Further, in the construction in which the discharge chamber 1031 having a volume necessary for separating the lubricating oil in the cooling medium gas is disposed above the compression chambers 1015, and also a motor (a rotor 1011 and a stator 1012) as well as the oil reservoir is disposed at the lower portion, the space for separating the lubricating oil from the cooling medium gas is separate from the space for accommodating the motor and for cooling the motor, and therefore there has been encountered a problem that the outer size of the compressor becomes large.

On the other hand, in order to solve the problem with the large outer size of the compressor, it has been proposed in Japanese Patent Unexamined Publication No. 57-198384, Japanese Patent Unexamined Publication No. 57-18491 and Japanese Patent Unexamined Publication No. 59-183095 and etc., to cool a motor while using a motor chamber as a space for separating discharge gas and lubricating oil from each other.

However, in any of these proposals, the discharge passage space between a discharge port, disposed adjacent to the compression chambers, and a discharge piping system is formed only by the motor chamber, or by a single discharge chamber and the motor chamber. When the final pressure of the compression chambers is extremely higher than the pressure of the discharge chamber or the pressure of the motor chamber, the compressed cooling medium gas is discharged from the compression chambers into the discharge chamber with an instantaneous expansion sound, and therefore the pulsation of the pressure of the discharge chamber (or the motor chamber) is large. As a result, there has been encountered a problem that the discharge piping system vibrates due to the high-pressure side pulsation, so that a quiet operation which is a characteristic of the scroll compressor is not achieved.

Also, when the pressure of the discharge chamber (the motor chamber) is higher than the final pressure of the compression chambers, the cooling medium gas intermittently flows reversely from the discharge chamber (the motor chamber) into the compression chambers to increase the pulsation, and therefore a similar problem has been encountered.

Further, since the pressure distribution of the compression chambers is generally determined by the intake pressure, the force (thrust force) tending to move the revolving scroll 1004 and the fixed scroll 1003 apart from each other in the axial direction depends on the intake pressure. Also, in order to flow the lubricating oil, introduced into the back-pressure chamber 1025 via the bearing sliding portions, into the compression chambers 1015, the back-pressure hole 1017 communicating between the back-pressure chamber 1025 and the compression chambers 1015 is so positioned that it opens to the compression chambers 1015 of a medium pressure somewhat lower on the average than the pressure of the back-pressure chamber 1025. Therefore, when the pressure of the discharge chamber 1031 is higher than the pressure of the compression chambers, the compressed fluid intermittently flows reversely from the discharge chamber 1031 to the compression chambers serving as the compression final-step portion. Therefore, the pressure distribution of the compression chambers 1015 is larger than that obtained with an ordinary pressure ratio, and the thrust force tending to move the revolving scroll 1004 apart from the fixed scroll 1003 becomes greater than the back pressure acting on the back surface of the revolving scroll 1004. As a result, the revolving scroll 1004 is moved apart from the fixed scroll 1003, thus inviting a problem that the compression performance is greatly lowered.

On the other hand, as measures for solving the above problems (the discharge chamber and the motor chamber are the separate spaces, so that the compressor has a large size, and the oil supply during the low-speed operation at the initial stage of the activation is difficult), there is a construction as shown in FIG. 2 in which a compression portion is provided at a lower portion of a sealed vessel 1201, and an electric motor 1203 is provided at the upper portion, and an oil reservoir 1215 is provided at the bottom portion, and a feed pipe 1217 for discharge gas is provided at the upper wall, and a bearing portion supporting a crankshaft 1204, as well as compression chambers, is dipped in the oil reservoir 1215 so as to achieve a small-size design, and also lubricating oil in the oil reservoir 1215 is supplied in a pressure-differential manner to the compression chambers 1216 via an oil feed hole 1211 formed in a boss 1205*a* of a frame 1205 supporting the crankshaft 1204, a gap in the bearing portion supporting the crankshaft 1204, an intermediate chamber 1208 provided between the frame 1205 and a revolving scroll 1206, and a communication hole 1211 formed in the revolving scroll 1206 (Japanese Patent Unexamined Publication No. 57-35184).

With the above construction, however, during the stop of the compressor, the lubricating oil flows into and fills in the compression chambers via the intermediate chamber 1208 and a discharge pipe 1214, and the starting torque at the time of re-activating the compressor is rendered excessive by the liquid compression, and therefore there have been encountered problems that the activation is impossible and that even if the activation is possible, the compressor is damaged.

On the other hand, as a measure for solving the above problem, there is a method as disclosed in Japanese Patent Unexamined Publication No. 61-213556 in which a reverse-rotation activation is performed at the time of the activation of a compressor; however, a check valve for preventing a reverse rotation of a revolving scroll due to a pressure differential developing immediately after stopping the compressor is provided in an intake passage, and it is difficult to discharge fluid from compression chambers at the time of the reverse rotation, and therefore there has been encountered a problem that the reverse-rotation activation can not substantially be performed. Also, as disclosed in Japanese Patent Unexamined Publication No. 57-153988, there is a device in which in order to prevent a cooling medium liquid and lubricating oil from flowing via a discharge port into compression chambers to fill in them during the stop of the compressor, a check valve is provided at the discharge port; however, when the intake pressure is lower than a set pressure, or when the discharge pressure is higher than a set pressure, the discharge fluid intermittently flows into the compression chambers during the operation of the compressor, and at this time the check valve is opened and closed in response thereto, so that the check valve generates impingement sounds, and therefore there has been encountered a problem that low noise characteristics of the scroll compressor are adversely affected.

Further, with respect to the oil supply to the bearing sliding portions engaged with the crankshaft 1204, although the pressure differential oil supply to the bearing portion between the oil feed hole 1212 and the intermediate chamber 1208 is sufficient, the other bearing sliding portions (the bearing portion above the oil feed hole 1212 and the bearing portion between the crank portion of the crankshaft 1204 and the revolving scroll 1206) are only dipped in the lubricating oil, and do not receive a positive circulation of the lubricating oil, and therefore there has been encountered a problem that the crankshaft is subjected to seizure.

Further, the pressure of the intermediate chamber 1208 for urging the revolving scroll 1206 toward the fixed scroll 1207 is formed only by the pressure intermediate the intake pressure and the discharge pressure, and as described later, when the intake pressure becomes lower than the set pressure, or when the discharge pressure becomes higher than the set pressure, the force for urging the revolving scroll 1206 toward the fixed scroll 1207 becomes insufficient, and the axial gap of the compression chambers becomes larger, and as a result the leakage of compressed gas is increased, and therefore there has been encountered problems that the compression efficiency is greatly lowered and that because of an abnormal temperature rise in the compression portion, the sliding portions are subjected to seizure.

On the other hand, as shown in FIGS. 3 and 4, as a method of solving the above problem (when the compression ratio is higher than the set value, the revolving scroll moves apart from the fixed scroll, so that the compression performance is lowered), there is a construction in which a differential pressure control mechanism is provided at a communication hole 1316 which communicates between a back-pressure chamber 1315, provided between a back surface of a revolving scroll 1301 having a communication hole 1314 open to a sealed space (compression chamber) 1308, and a frame 1303, and a discharge chamber 1310, and this differential pressure control mechanism performs the function of a check valve which only allows gas to flow from the discharge chamber 1310 to the back-pressure chamber 1315, and causes the pressure of the back-pressure chamber 1315 to follow the pressure of the discharge chamber 1310 so as to overcome the insufficiency of the back-pressure acting on the revolving scroll 1301 (Japanese Patent Unexamined Publication No. 58-160580).

With the above construction, however, when the amount of by-pass gas flowing from a motor chamber into the back-pressure chamber 1315 via the differential pressure control mechanism portion is large, the pressure differential supply of oil from an oil reservoir at the bottom portion to bearing portions supporting a crankshaft is insufficient, and therefore there has been encountered a problem that the bearings are damaged.

Further, when a continuous liquid compression occurs in the compression chambers 1308, the high-pressure fluid flows into the back-pressure chamber 1315 via the communication hole 1314, so that the pressure of the back-pressure chamber 1315 may become higher than the discharge pressure. As a result, the pressure differential supply of the oil from the oil reservoir at the bottom portion to the bearing portions supporting the crankshaft can not be performed, and therefore there has been encountered a problem that the crankshaft is subjected to seizure.

It is also considered that the back-pressure area of the oil chamber, which is provided at the crankshaft 1008 in FIG. 1 or at the crank head of the crankshaft in FIG. 2 and is subjected to the discharge pressure, is increased so as to increase the back-pressure urging force due to the discharge pressure, thereby solving the problem concerning the insufficiency of the back-pressure urging force occurring when the compression ratio is high, without using the thrust seal as described above. However, as described in Japanese Patent Publication No. 62-49474, in order to reduce the thrust force acting on the crankshaft by forming the opposite end portions of the crankshaft into the same diameter, the crankshaft need to be increased in diameter, which invites an input loss due to an increased frictional torque of the bearing portions and a large-size outer configuration of the compressor, and therefore it has been difficult to achieve the above proposal to solve the problem.

In view of the problems of the prior art, an object of a first invention of the present application is to perform a sufficient oil supply to bearing portions while ensuring an optimum amount of supply of oil to compression chambers so as to seal a gap of the compression chambers by an oil film.

An object of a second invention is to decrease the amount of supply of oil to the compression chambers in accordance with the increase of the operation speed of the compressor, thereby improving the compression efficiency.

An object of a third invention is to reduce wear of a rotation prevention member and a sliding surface gap of the rotation prevention member by forcible feed of oil to the rotation prevention member, thereby preventing the generation of noises due to the movement of the rotation prevention member.

An object of a fourth invention is to always keep constant the relative angle between a revolving scroll and a fixed scroll so as to keep the gap of the compression chambers to a very small level, thereby maintaining a good compression efficiency.

An object of a fifth invention is to reduce the leakage of lubricating oil from a back-pressure chamber of the revolving scroll into an intake chamber, thereby enhancing an intake efficiency of the compression chambers.

An object of a sixth invention is to enhance the durability of a movable seal member which separates the bearing portion, provided at the high-pressure side and related to a drive shaft, from the back-pressure chamber of the revolving scroll.

An object of a seventh invention is to provide an oil feed pump passage which can simultaneously supply oil to two bearings related to the drive shaft of a large load, thereby enhancing the durability.

An object of an eighth invention is to provide a space-saving oil feed pump device which can supply oil to the bearing portion related to the drive shaft simultaneously with the activation of the compressor.

An object of a ninth invention is to provide a space-saving oil feed pump which has a low speed of sliding between the drive side and the driven side, and is excellent in durability.

An object of a tenth invention is to provide an oil feed passage which can supply oil to the back-pressure chamber of the revolving scroll simultaneously with the activation of the compressor.

An object of an eleventh invention is to provide a bearing oil feed pump which has a small input loss even at the time of a high-speed operation.

An object of a twelfth invention is to provide a capacity-type pump which can supply oil only when the operating speed of the compressor is above a predetermined value, whereby the supply of a liquid cooling medium to the sliding portion at the initial stage of the activation of the compressor in a cooled condition is prevented, thereby enhancing the durability of the sliding portion.

An object of a thirteenth invention is to stabilize the pressure of the back-pressure chamber by an oil feed passage construction which supplies oil to the back-pressure chamber of the revolving scroll without causing the flow of gas thereinto.

An object of a fourteenth invention is to provide an oil feed passage which can effectively lubricate the sliding surface in the process of the flow of the lubricating oil from the back-pressure chamber of the revolving scroll into the compression chambers.

In order to achieve the above objects, in a scroll compressor of the first invention, there is provided a bearing oil feed passage in which by an oil feed pump operated by the rotation of a drive shaft, lubricating oil in an oil reservoir subjected to a discharge pressure is supplied to a main bearing, supporting the drive shaft and disposed close to a revolving scroll, and a revolving bearing slidably connecting the drive shaft and the revolving scroll together, and thereafter is returned again to the oil reservoir, and there is provided an oil injection passage having a throttle passage which supplies part of the lubricating oil, supplied to at least one of the bearings, sequentially via a back-pressure chamber of the revolving scroll and compression chambers.

In the second invention, there is provided an oil feed passage which passes sequentially via an oil reservoir, communicated with a discharge chamber, a back-pressure chamber of a revolving scroll and leads to compression chambers, and there is provided means for intermittently opening and closing the flow inlet of the back-pressure chamber and the communication passage between the back-pressure chamber and the compression chambers in response to the revolution of the revolving scroll.

In the third invention, there is provided an oil feed passage passing sequentially via an oil reservoir, a back-pressure chamber and compression chambers, and means for intermittently opening and closing the flow inlet of the back-pressure chamber is based on a reciprocal movement of a sliding surface of a self-rotation prevention member.

In the fourth invention, there is provided an oil feed passage passing sequentially via an oil reservoir, a back-pressure chamber and compression chambers, and means for intermittently opening and closing the flow inlet of the back-pressure chamber is based on a reciprocal movement of a key portion of a self-rotation prevention member in sliding contact with a body frame.

In the fifth invention, there is provided an oil feed passage passing sequentially via an oil reservoir subjected to a discharge pressure, a back-pressure chamber of a revolving scroll, an outer peripheral space around a wrap support disk supporting a volute-like wrap of the revolving scroll, and compression chambers, and a throttle passage between the back-pressure chamber and the outer peripheral space is intermittently communicated in accordance with the revolution of the wrap support disk.

In the sixth invention, means for intermittently opening and closing the flow inlet of a back-pressure chamber is provided between a body frame, supporting a drive shaft, and a revolving scroll so as to sealingly separate a bearing portion, which is at the high-pressure side and is related to the drive shaft, from the back-pressure chamber of the revolving scroll, and this means is based on a revolution of a sliding sealing surface of an annular seal member movably mounted on the revolving scroll.

In the seventh invention, an oil suction passage, which is communicated between a revolving bearing slidably connecting a drive shaft and a revolving scroll together, and a main bearing supporting that side of a drive shaft close to the revolving scroll, is communicated with an oil reservoir subjected to a discharge pressure, and spiral oil grooves having a viscosity pumping action are formed respectively in the sliding surfaces of the two bearings, and the oil suction passage is communicated with the suction side of the spiral oil grooves.

In the eight invention, a trochoid pump, which comprises an inner rotor connected to a drive shaft and an outer rotor received in a revolving scroll, is provided at that side of a revolving bearing close to compressing chambers which revolving bearing slidably connects the drive shaft and the revolving scroll together, and there is provided an oil feed passage in which an oil reservoir subjected to a discharge pressure is at its most upstream side, the revolving bearing is at its upstream side, and the bearing sliding portion supporting the drive shaft is at its downstream side.

In the ninth invention, there is provided an oil feed pump device in which an outer peripheral portion of a sliding connection portion between a drive shaft and a revolving scroll is slidably contacted with an inner surface of an annular piston disposed outside thereof, and the piston is swingingly moved in response to the revolution of the revolving scroll so as to perform a pumping action, and this pump device is provided between a main bearing, which supports a drive shaft and is disposed close to the revolving scroll, and the sliding connection portion, and the oil feed pump device is provided halfway in an oil feed passage communicating between an oil reservoir subjected to a discharge pressure and the bearing sliding portion related to the drive shaft.

In the tenth invention, a capacity-type oil feed pump device, which is operated in response to rotation of a drive shaft, is provided between a main bearing, which supports the drive shaft and is disposed close to a revolving scroll, and the revolving scroll, and there is provided an oil feed passage passing sequentially via an oil reservoir subjected to a discharge pressure, a bearing sliding portion related to the drive shaft, a back-pressure chamber of the revolving scroll and compression chambers, and the capacity-type oil feed pump device is provided halfway in the oil feed passage between the oil reservoir and the back-pressure chamber.

In the eleventh invention, there is provided an oil feed pump device in which an outer peripheral portion of a sliding connection portion between a drive shaft and a revolving scroll is slidably contacted with an inner surface of an annular piston disposed outside thereof, and part of the outer periphery of the piston is movably engaged with a stationary member, and the piston is swingingly moved in response to the revolution of the revolving scroll so as to perform a pumping action, and this pump device is provided between a main bearing, which supports a drive shaft and is disposed close to the revolving scroll. and the sliding connection portion, and the oil feed pump device is provided halfway in an oil feed passage communicating between an oil reservoir subjected to a discharge pressure and the bearing sliding portion related to the drive shaft.

In the twelfth invention, a slide vane-type oil feed pump device, which comprises a rotor rotatable coaxially with a drive shaft, and a vane movable back and forth in a groove in the rotor so as to divide a pump chamber, is provided between a main bearing, which supports the drive shaft and is disposed close to a revolving scroll, and the revolving scroll, and the slide vane-type oil feed pump device is provided halfway in an oil feed passage communicating between an oil reservoir subjected to a discharge pressure and the bearing sliding portion related to the drive shaft, and the back-pressure urging force of the vane depends on the centrifugal force based on the weight of the vane.

In the thirteenth invention, there is provided a pressure differential oil feed passage passing sequentially via an oil reservoir subjected to a discharge pressure, an oil reservoir provided between two bearings supporting a drive shaft, a back-pressure chamber of a revolving scroll, and compression chambers, and a throttle passage is provided between the back-pressure chamber and the oil reservoir.

In the fourteenth invention, there is provided a pressure differential oil feed passage passing sequentially via an oil reservoir subjected to a discharge pressure, a back-pressure chamber of a revolving scroll, an outer peripheral space where the revolving scroll and a fixed scroll is slidably contacted with each other outside an intake chamber, a communication passage formed in the fixed scroll and opening to a sliding surface of a mirror plate, and compression chambers, and the open portion of the oil passage, communicating between the back-pressure chamber and the outer peripheral space, and the open portion of the communication passage formed in the mirror plate are disposed in opposite relation to each other with respect to the center of the revolving scroll.

BEST MODE FOR CARRYING OUT THE INVENTION

A first embodiment of a scroll cooling medium compressor of the present invention will now be described with reference to FIGS. 5 to 20.

Figure 5:
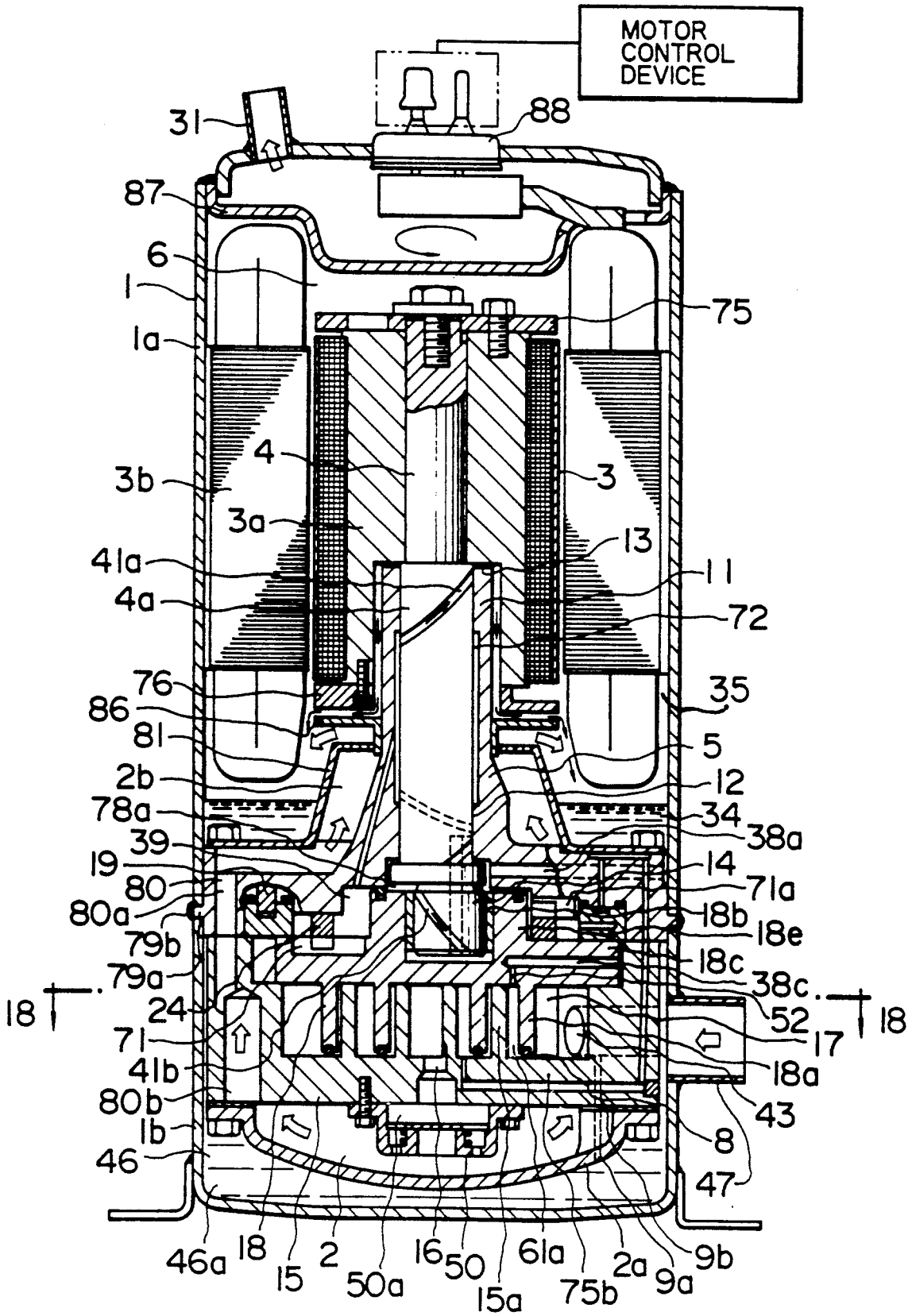
FIG. 5 is a vertical cross-sectional view of an embodiment of a scroll cooling medium compressor of the present invention.
Figure 6:
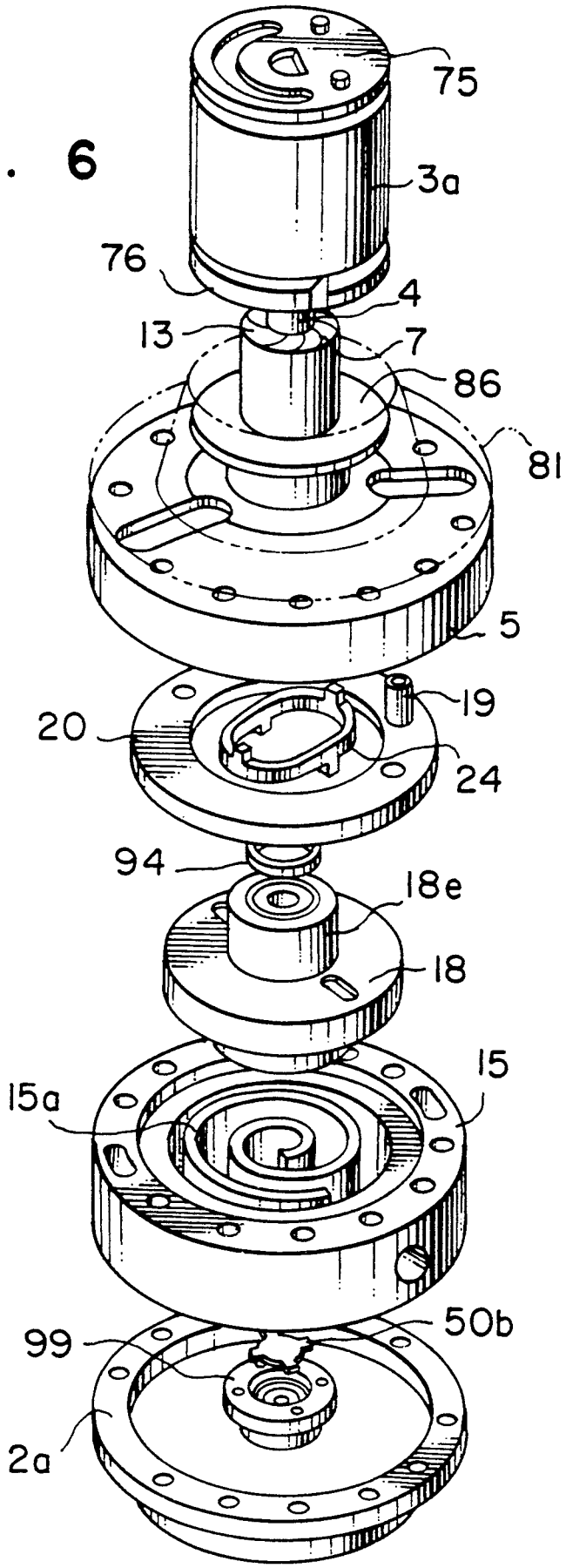
FIG. 6 is an exploded view of main parts of the above compressor.

In FIG. 5, numeral 1 denotes a sealed case made of iron, and the interior thereof is divided into an upper motor chamber 6 and a lower accumulator chamber 46 by a body frame 5 which has a fixed scroll member 15 fixedly secured thereto by bolts and supports a drive shaft 4, the fixed scroll member being engaged with a revolving scroll 18 to form compression chambers.

The motor chamber 6 has a high-pressure atmosphere, and a motor 3 controlled by a D. C. power source for variable speed operation is provided at the upper portion thereof, and a compression portion is provided at the lower portion thereof. The body frame 5, supporting the drive shaft 4 to which a rotor 3*a* of the motor 3 is fixedly connected, is made of eutectic graphite cast iron having excellent sliding properties and solderability. A projection 79*a* formed on the outer peripheral surface of the body frame is abutted against inner surfaces and end faces of an upper sealed case 1*a* and a lower sealed case 1*b*, and the projection 79*a*, the upper sealed case 1*a* and the lower sealed case 1*b* are sealingly welded together by a single welding bead 79*b*.

The drive shaft 4 is supported by an upper bearing 11 provided at the upper end portion of the body frame 5, a main bearing 12 provided at the central portion thereof, and a thrust bearing portion 13 which is provided at the upper end face of the body frame 5 and has a plurality of radial shallow grooves 7. A crankshaft 14, which is provided at the lower end portion of the drive shaft 4 and is eccentric from the main axis of the drive shaft 4, is engaged in a revolving bearing 18*b* of a revolving boss 18*e* formed on the revolving scroll 18.

Figure 14:
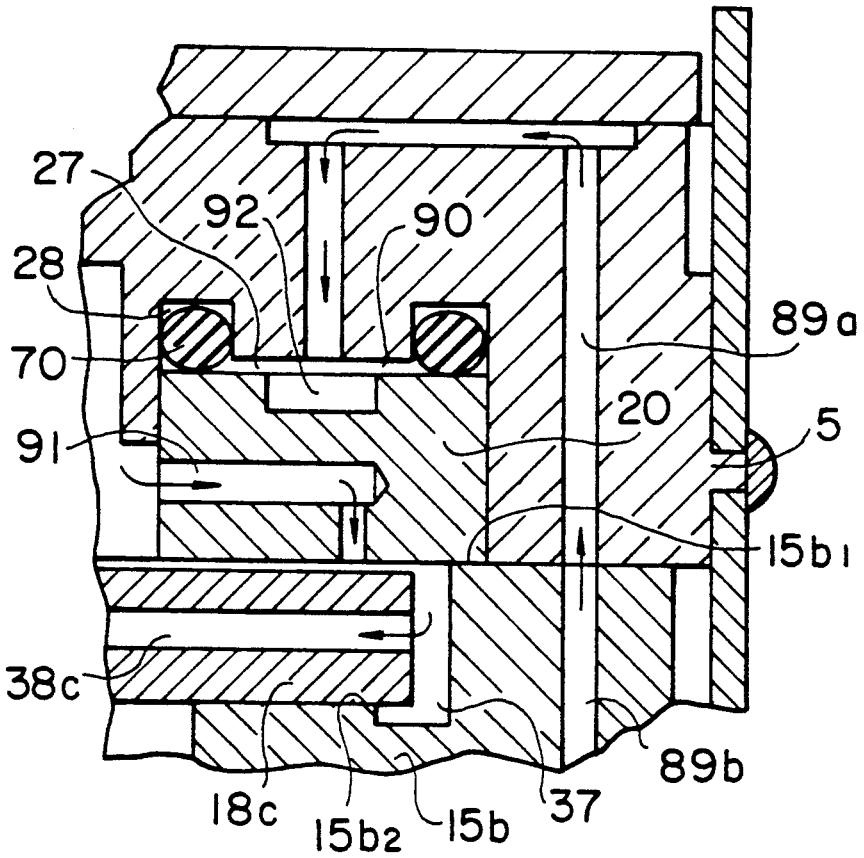
FIG. 14 is a cross-sectional view of a portion of a thrust bearing portion of the above compressor.

The fixed scroll 15 is made of high silicon-aluminum alloy whose thermal expansion coefficient corresponds to a value intermediate that of pure aluminum and that of eutectic graphite case iron, and comprises a volute-like fixed scroll wrap 15*a* and a mirror plate 15*b*, as shown in FIG. 14. Provided at the central portion of the mirror plate 15*b* is a discharge port 16 which is open at a winding-starting portion of the fixed scroll wrap 15*a*, and is communicated with a discharge passage 80 communicated with the motor chamber 6. An intake chamber 17 is provided at the outer peripheral portion of the fixed scroll wrap 15*a*.

A check valve device 50 is mounted on that side of the mirror plate 15*b* facing away from the revolving scroll in a manner to cover the discharge port 16. As shown in detail in FIGS. 5 to 10, the check valve device 50 comprises a valve member 50*b* composed of a thin steel sheet having a plurality of notches at its outer periphery (or a valve member 50*e* having a discontinuous annular hole 50*ea*), a valve case 99 having a check valve bore 50*a*, a central hole 50*g* and a plurality of discharge small holes 50*h* provided therearound, a spring device 50*c* interposed between the valve member 50*b* and the valve case 99. The spring device 50*c* has such shape memory properties that it is contracted when its temperature exceeds 50° C. and that it is expanded when its temperature goes below 50° C. The spring device is so set that during the operation of the compressor, it is influenced by the shape memory properties under the discharge gas pressure at the temperature of above 50° C. so as to be contracted as far as the bottom of the check valve bore 50*a*, and that during the stop of the compressor, the spring device can urge the valve member 50 against the mirror plate 15*b* at the temperature of below 50° C. so as to close the discharge port 16.

Figure 18:
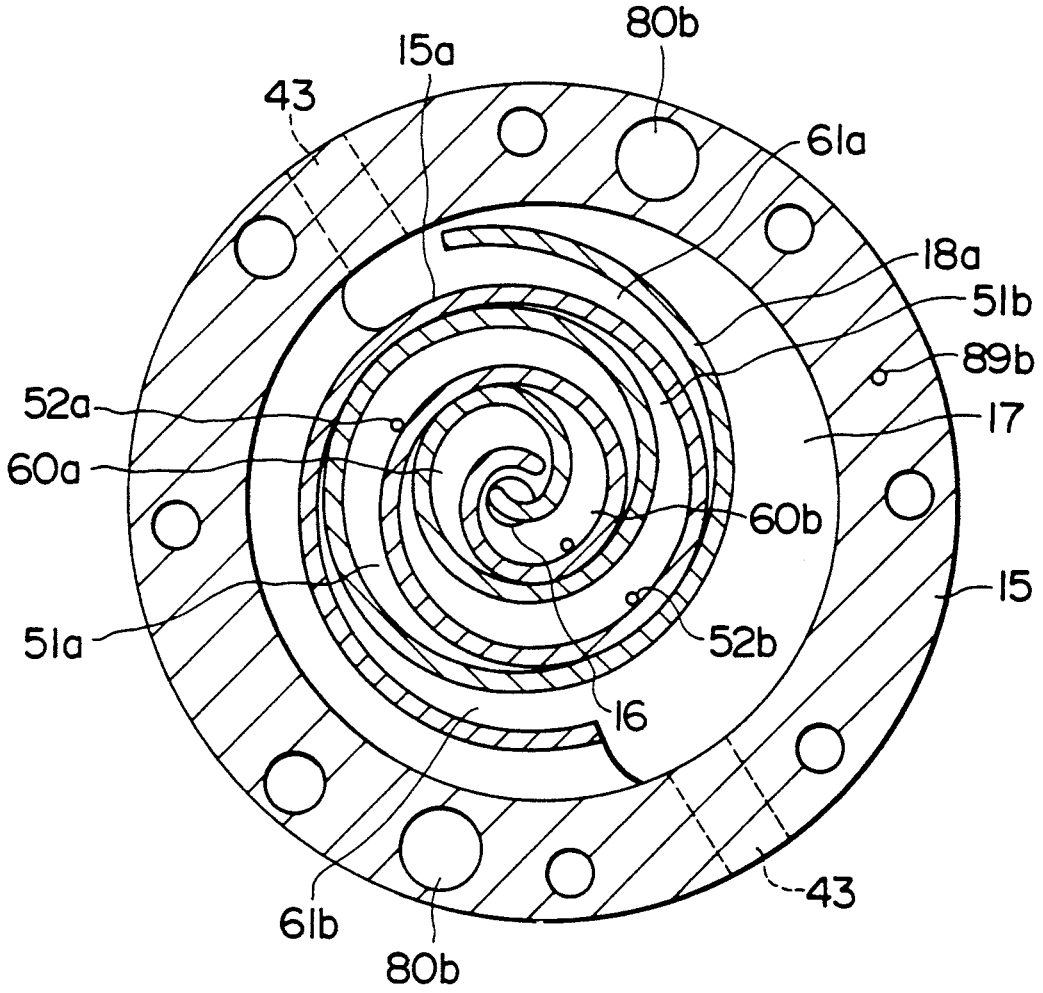
FIG. 18 is a horizontal cross-sectional view taken along the line 18—18 of FIG. 5.

As shown in FIG. 5 and FIG. 18, the revolving scroll 18, is made of aluminum alloy, and comprises a volute-like revolving scroll wrap 18*a* engaged with the fixed scroll wrap 15*a* to form the compression chambers, and the upstanding revolving boss 18*e* engaged with the crankshaft 14 of the drive shaft 4. The revolving scroll is surrounded by the fixed scroll 15 and the body frame 5, and a hardening treatment such as a porous nickel plating is applied to the surface of a wrap support disk 18*c* and the surface of the revolving scroll wrap 18*a*. A volute-like tip seal groove 98, as described in U.S. Pat. No. 3,994,636, is formed in the distal end of the revolving scroll wrap 18*a*, and a tip seal 98*a* of a resin is mounted in the tip seal groove 98 with a slight gap. When the revolving scroll 18 is urged in the axial direction of the fixed scroll 15, the flat portion of the wrap support disk 18*c* is brought into contact with the distal end of the fixed scroll wrap 15*a*, but the distal end of the revolving scroll wrap 18*a* is not brought into contact with the fixed scroll 15, and is kept apart a very small distance of about several microns therefrom, and the tip seal 98*a* seals this gap.

The discharge passage 80 comprises a discharge chamber 2 formed by a discharge cover 2*a*, mounted on the mirror plate 15*b* to cover the check valve device 50, and the mirror plate 15*b*, gas passages 80*b* formed in the fixed scroll 15, gas passages 80*a* formed in the body frame 5, and a discharge chamber 2*b* formed by a discharge guide 81, mounted on the body frame 5 in surrounding relation to the main bearing 12, and the body frame 5. The gas passages 80*a* as well as the gas passages 80*b* are disposed in symmetrical positions (see FIG. 18).

Figure 11:
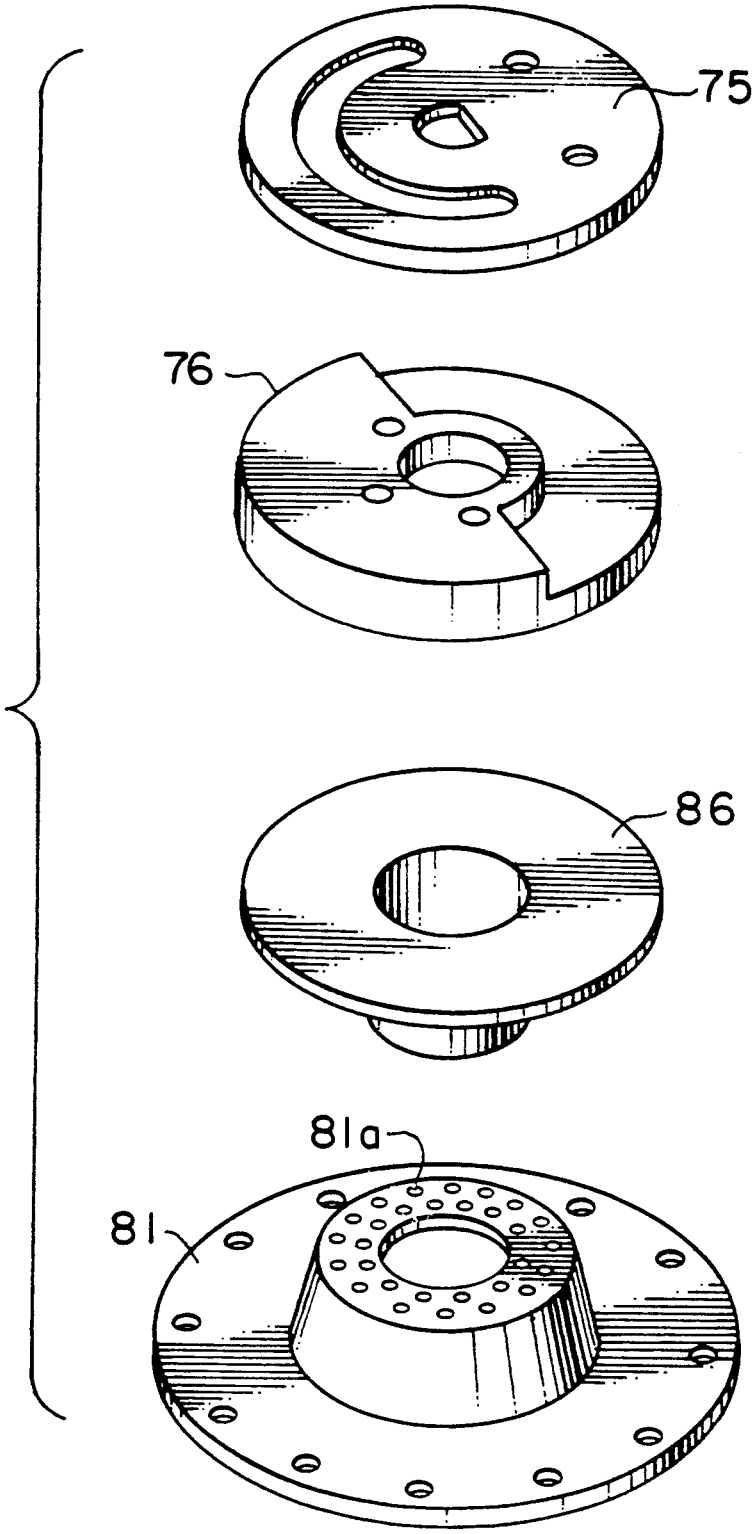
FIG. 11 is an exploded perspective view of small parts of the above compressor.

As shown in FIG. 11, a number of small apertures 81*a* formed in the upper surface of the discharge guide 81 in a uniform symmetrical manner.

The accumulator chamber 46 leading to an evaporator of a refrigerating cycle is formed by the lower sealed case 1*b*, the fixed scroll 15 and the body frame 5, and an intake pipe 47 communicated with this chamber is connected to the side surface of the lower sealed case 1*b*.

Intake holes 43 are formed in the fixed scroll 15 respectively at a position opposed to the intake pipe 47 and at two positions spaced 90° from that position.

A low-pressure oil reservoir 46*a* at the bottom portion of the accumulator chamber 46 is communicated with the intake holes 43 via oil suction holes 9*a*, formed in the discharge cover 2*a*, and oil suction holes 9*b* of a small diameter formed in the fixed scroll 15. These oil suction holes (9*a*, 9*b*) are designed to draw up cooling medium liquid and lubricating oil, residing in the low-pressure oil reservoir 46*a*, by a negative pressure generated when the cooling medium gas passes through the intake holes 43.

A thrust bearing 20 of a flat plate-shape, which is prevented from rotation by parallel pins 19 of a cotter pin-shape fixed to the body frame 5 and is movable only in the axial direction, is provided between the lap support disk 18*c* and the body frame 5, and this thrust bearing is abutted against a mirror plate mounting surface 15*b*1, disposed between the body frame 5 and the fixed scroll 15, by the resilient force of annular seal rings 70 (made of rubber) interposed between the thrust bearing 20 and the body frame 5.

The height from a mirror plate sliding surface 15*b*2 in sliding contact with the wrap support disk 18*c* of the revolving scroll 18 to the mirror plate mounting surface 15*b*1 is set to be larger about 0.015 to 0.020 mm than the thickness of the wrap support disk 18*c* in order to enhance the sealing effect of the sliding portions by the oil film.

Figure 13:
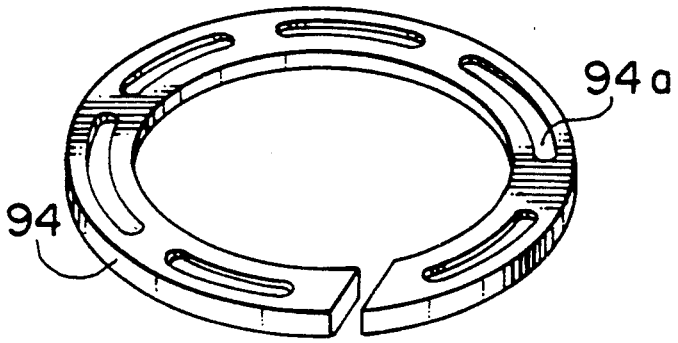
FIG. 13 is a perspective view of a seal part of the above compressor.

An annular seal groove 95 coaxial with the revolving bearing 18*b* is formed in that end surface of the revolving boss 18*e* of the revolving scroll 18 directed toward the body frame 5, and an annular soft ring 94 of Teflon cut off at part thereof as shown in FIG. 13 is mounted in the annular seal groove 95, and its outer peripheral surface is in intimate contact with the side surface of the annular seal groove 95. The annular ring 94 provides a seal between a back-pressure chamber 39, formed by the revolving scroll 18, the body frame 5 and the thrust bearing 20, and that side of the main bearing 12 supporting the drive shaft 4.

Figure 15:
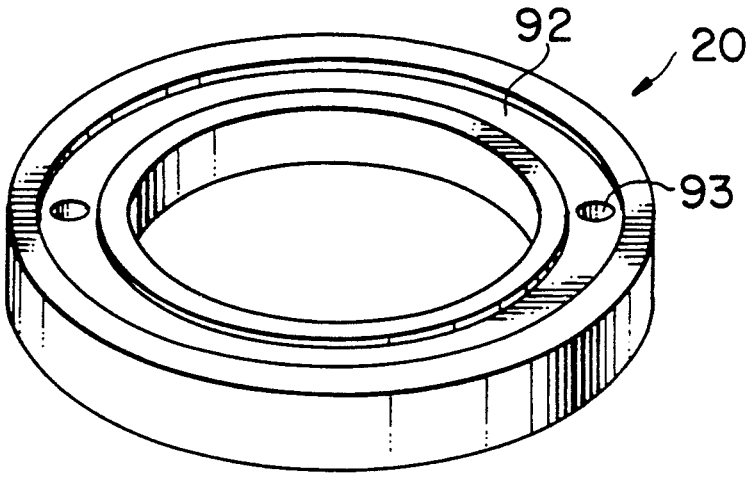
FIG. 15 is a perspective view of a thrust bearing in FIG. 14.

The annular thrust bearing 20 is made of sintered alloy facilitating the formation of a removal hole, and has two guide holes 93 into which the cotter pins 19 are movably inserted, respectively, an annular oil groove 92, and an oil hole 91, as shown in FIGS. 14 and 15. This thrust bearing is mounted in a thrust ring groove 90 in the body frame 5.

A release gap 27 of about 0.05 mm is provided between the body frame 5 and the thrust bearing 20, and annular grooves 28 receiving the seal rings 70 are provided on the inner and outer sides of the release gap 27. The seal rings 70 provides a seal between the release gap 27 and the back-pressure chamber 39.

The release gap 27 is communicated with a third compression chamber 60*b* of a final compression step via a thrust back-pressure introduction hole 89*a*, formed in the body frame 5, and a thrust back-pressure introduction hole 89*b* formed in the fixed scroll 15.

A member (hereinafter referred to as "Oldham's ring") 24 for preventing the rotation of the revolving scroll 18 about its own axis, which is disposed inwardly of the thrust bearing 20, is made of a light alloy or a reinforced fiber composite material suited for a sintering molding or an injection molding, and has key portions of a parallel key-shape formed on opposite flat surfaces of the ring in perpendicular relation to each other. The key portion on the upper surface is slidably engaged in a key groove 7 formed in the body frame 5, and the key portion on the lower surface is slidably engaged in a groove 71*a* formed in the wrap support disk 18*c*.

The thickness of the ring of the Oldham's ring 24 is so determined that when the Oldham's ring 24 is reciprocally moved, it can smoothly slide between the body frame 5 and the wrap support disk 18*c* via oil films in such a manner as not to cause a jumping phenomenon.

A discharge pipe 31 is connected to the outer peripheral portion of the upper wall of the upper sealed case 1*a*, and a motor power source-connection glass terminal 88 connected to a DC inverter power source is mounted on the central portion of the upper sealed case.

An oil separator 87 mounted on the upper sealed case 1*a* separates the side of the discharge pipe 31 and the glass terminal 88 from the side of the motor 3. The rotor 3*a* of the motor 3 axially positioned by a stepped portion of the drive shaft 4 is, together with a stamped upper balance weight 75, fixedly secured by a bolt to the drive shaft 4. The upper balance weight 75 is disk-shaped, and its outer diameter is determined to be greater than the outer diameter of the rotor 3*a* so as to effectively centrifuge the lubricating oil in the discharge cooling medium gas.

A shield plate 86 is mounted on the body frame 5, and is disposed between a lower balance weight 76, mounted on the lower end of the rotor 3*a*, and the discharge guide 81, and is disposed close to the lower balance weight.

A discharge chamber oil reservoir 34 provided at the lower portion of the motor chamber 6 is communicated with the upper portion of the motor chamber 6 via a cooling passage 35 formed by notching part of the outer periphery of the stator 3*b* of the motor 3.

Also, the discharge chamber oil reservoir 34 is communicated with an oil chamber 78, disposed between the main bearing 12 and the revolving bearing 18*b*, via an oil hole 38*a* formed in the body frame 5.

Spiral oil grooves 41*a* and 41*b* are formed respectively in the surfaces of the sliding shaft portion 4*a* of the drive shaft 4 and the crankshaft 14 in such a direction that when the drive shaft 4 rotates in its normal direction, the lubricating oil in the oil chamber 78*a* is fed by a screw-pumping action toward an oil chamber 78*b*, formed by the revolving bearing 18*b* and the crankshaft 14, and further toward the motor 3, and the spiral groove reaches the thrust bearing 13 at its upper end.

The oil chamber 78*b* is communicated with the surface of the main bearing 12 via an oil feed hole 73*a* formed in the drive shaft 4, and an oil reservoir 72 disposed between the upper bearing 11 and the main bearing 12 is communicated with the back-pressure chamber 39 via an oil hole 38*b* which is formed in the body frame 5 and has a throttle passage portion. The open end of the oil hole 38*b* opening to the back-pressure chamber 39 is provided in such a position as to be intermittently opened and closed by the annular ring 94 revolving together with the revolving scroll 18.

Second compression chambers 51 intermittently communicated with the intake chamber 17 is communicated with the back-pressure chamber 39 via an injection passage 74 which is constituted by an oil hole 91 formed in the thrust bearing 20, an outer peripheral space 37 provided outside the wrap support disk 18*c*, an oil hole 38*c* formed in the wrap support disk 18*c*, and an injection hole 52 of a small diameter formed in the wrap support disk. The oil hole 91 formed in the thrust bearing 20 is intermittently communicated with its downstream side by the wrap support disk 18*c*.

Figure 16:
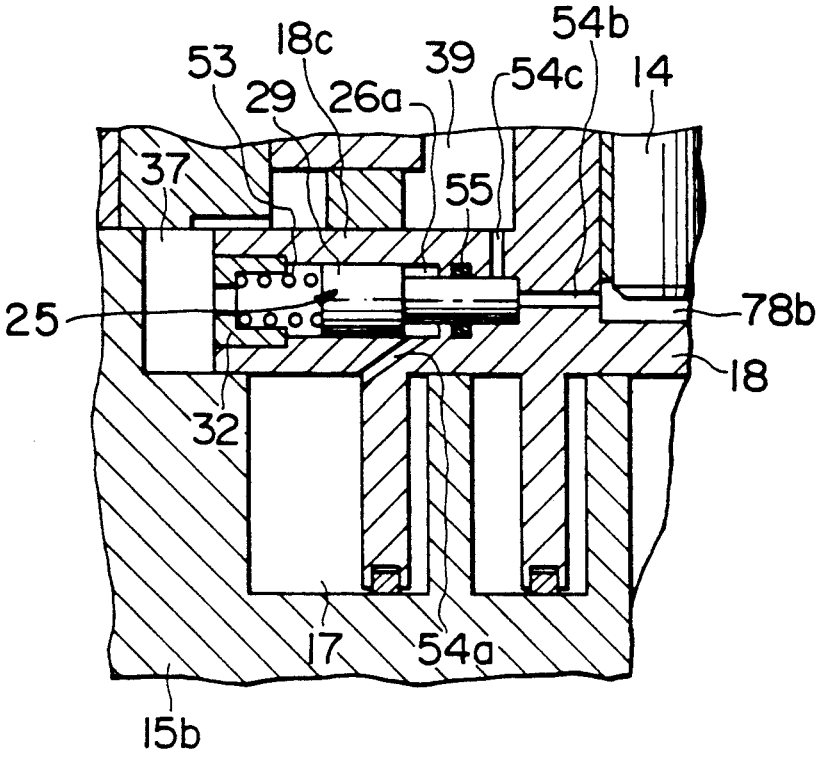
FIGS. 16 and 17 are cross-sectional views explanatory of the operation of a back-pressure control valve device of the above compressor.
Figure 17:
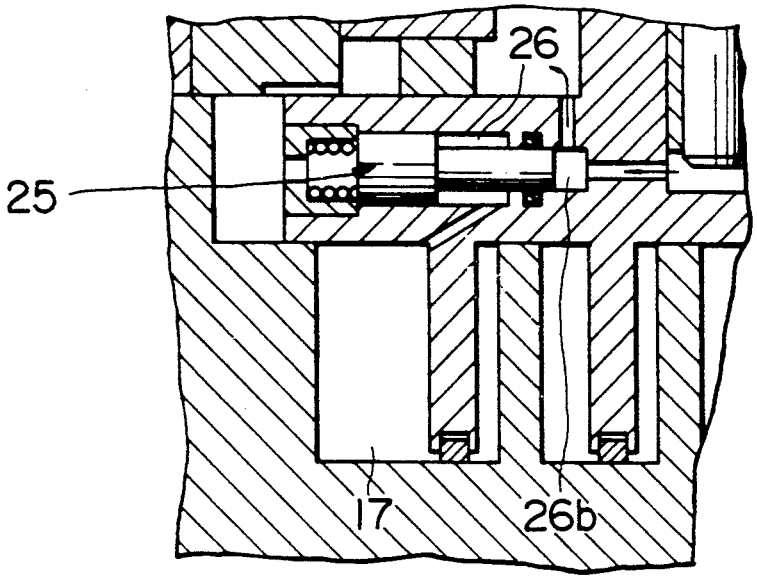

As shown in FIGS. 16 and 17, a back-pressure control valve device 25 for controlling the pressure of the back-pressure chamber 39 is mounted on the wrap support disk 18*c*.

The back-pressure control valve device 25 comprises a cylinder 26 of a stepped configuration which is provided in the radial direction of the wrap support disk 18*c* and has a greater-diameter cylinder 26*a* and a smaller-diameter cylinder 26*b*, a plunger 29 of a stepped configuration movable in this cylinder, a cap 32 closing part of the open end of the cylinder 26 close to the outer peripheral space 37, a coil spring 53 provided between the cap 32 and the plunger 29 to urge the plunger 29 toward the crankshaft 14, an oil hole 54*a* communicating that side of the greater-diameter cylinder 26*a* close to the crankshaft 14 with the intake chamber 17, and oil holes 54*b* and 54*c* respectively communicating that side of the smaller-diameter cylinder 26*b* close to the crankshaft 14 with the oil chamber 78*b* and the back-pressure chamber 39. With respect to its operation, the urging force of the coil Spring 53 and the dimensions of the various portions of the cylinder 26 are so determined that when the pressure of the back-pressure chamber 39 is in a proper range, the smaller-diameter end of the plunger 29 closes the open end of the oil hole 54*b* close to the cylinder, and when the pressure of the back-pressure chamber 39 in insufficient, the plunger 29 is moved toward the outer peripheral space 37 by the difference between the urging forces acting respectively on the opposite side portions of the plunger 29 the boundary between which is the greater-diameter portion of the plunger 29, so that the open end of the oil hole 54*b* close to the cylinder is opened so as to communicate the oil chamber 78*b* with the back-pressure chamber 39.

Numeral 55 denotes an O-ring mounted on the smaller-diameter cylinder 26*b* to seal the smaller-diameter outer peripheral portion of the plunger 29.

Figure 19:
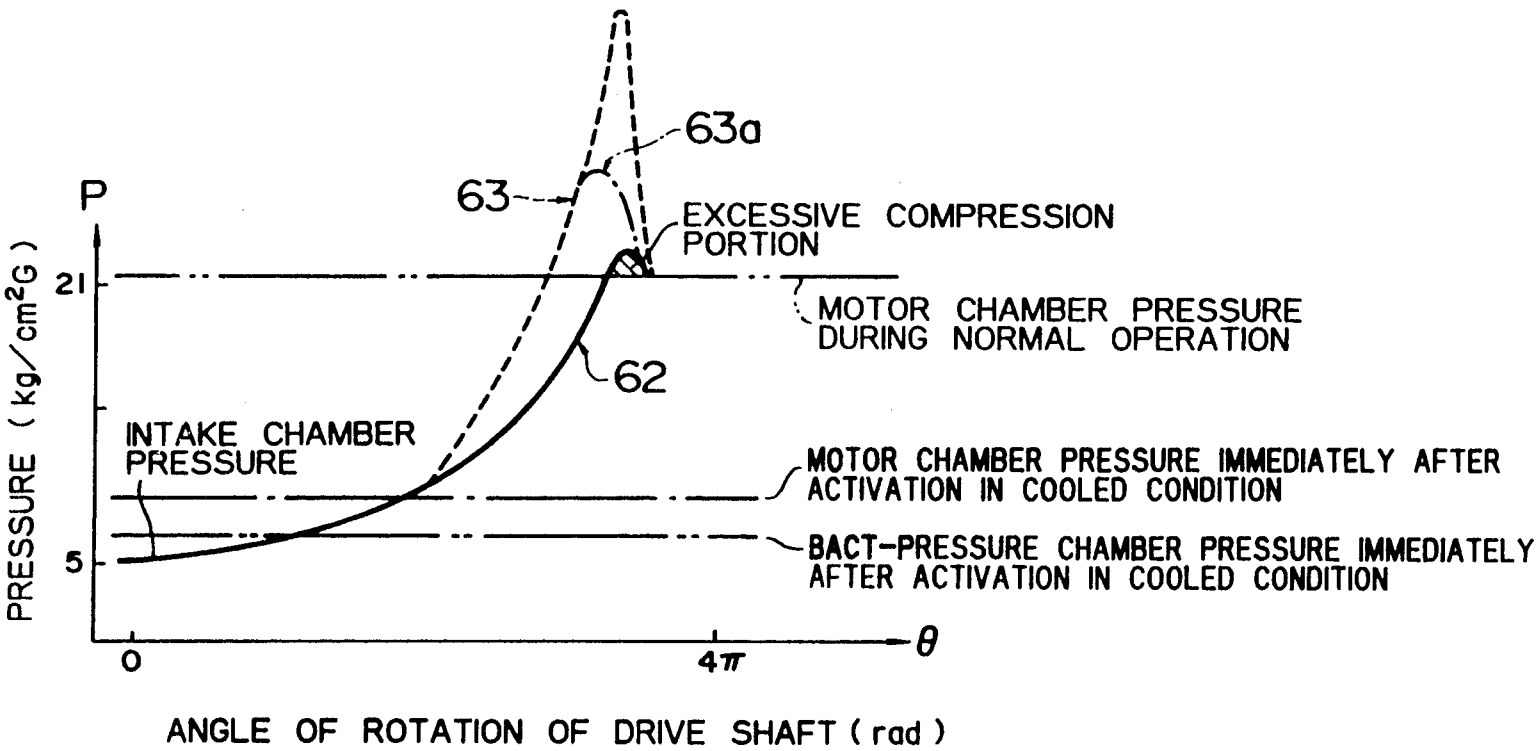
FIG. 19 is a characteristics view showing pressure variations of a cooling medium gas from an intake step to a discharge step.

In FIG. 19, the ordinate axis represents the angle of rotation of the drive shaft 4, and the abscissa axis represents the cooling medium pressure, and indicates variations in the pressure of the cooling medium gas during the intake, compression and discharge steps, and a solid line 62 represents a pressure variation during the operation under the normal pressure, and a dotted line 63 represents a pressure variation when an abnormal pressure increase occurs.

Figure 20:
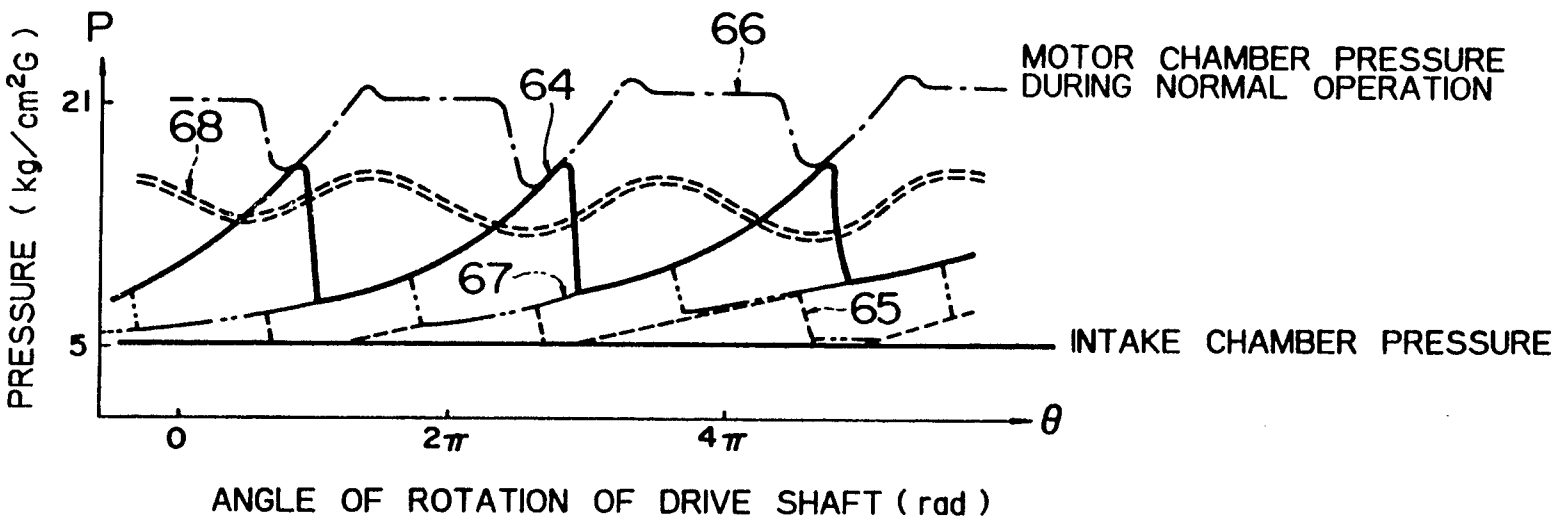
FIG. 20 is a characteristics view showing pressure variations at fixed points of compressor chambers.

In FIG. 20, the ordinate axis represents the angle of rotation of the drive shaft 4, and the abscissa axis represents the cooling medium pressure, and a solid line 64 represents a variation of the pressure of the second compression chambers 51*a* and 51*b* (which are not communicated with either of the discharge chamber 2 and the intake chamber 17) at the open positions of the injection holes 52*a* and 52*b*, and a dotted line 65 represents a variation of the pressure of the first compression chambers 61*a* and 61*b* (see FIG. 11) (which communicate with the intake chamber 17) at the fixed point, and a dot-and-dash line 66 represents a variation of the pressure of the third compression chambers 60*a* and 60*b* (which communicate with the discharge port 2) at the fixed point, and a two dots-and-dash line 67 represents a pressure variation at the fixed point between the first compression chambers 61*a* and 61*b* and the second compression chambers 51*a* and 51*b*, and a double dot line 68 represents a variation of the pressure of the back-pressure chamber 39.

Figure 21:
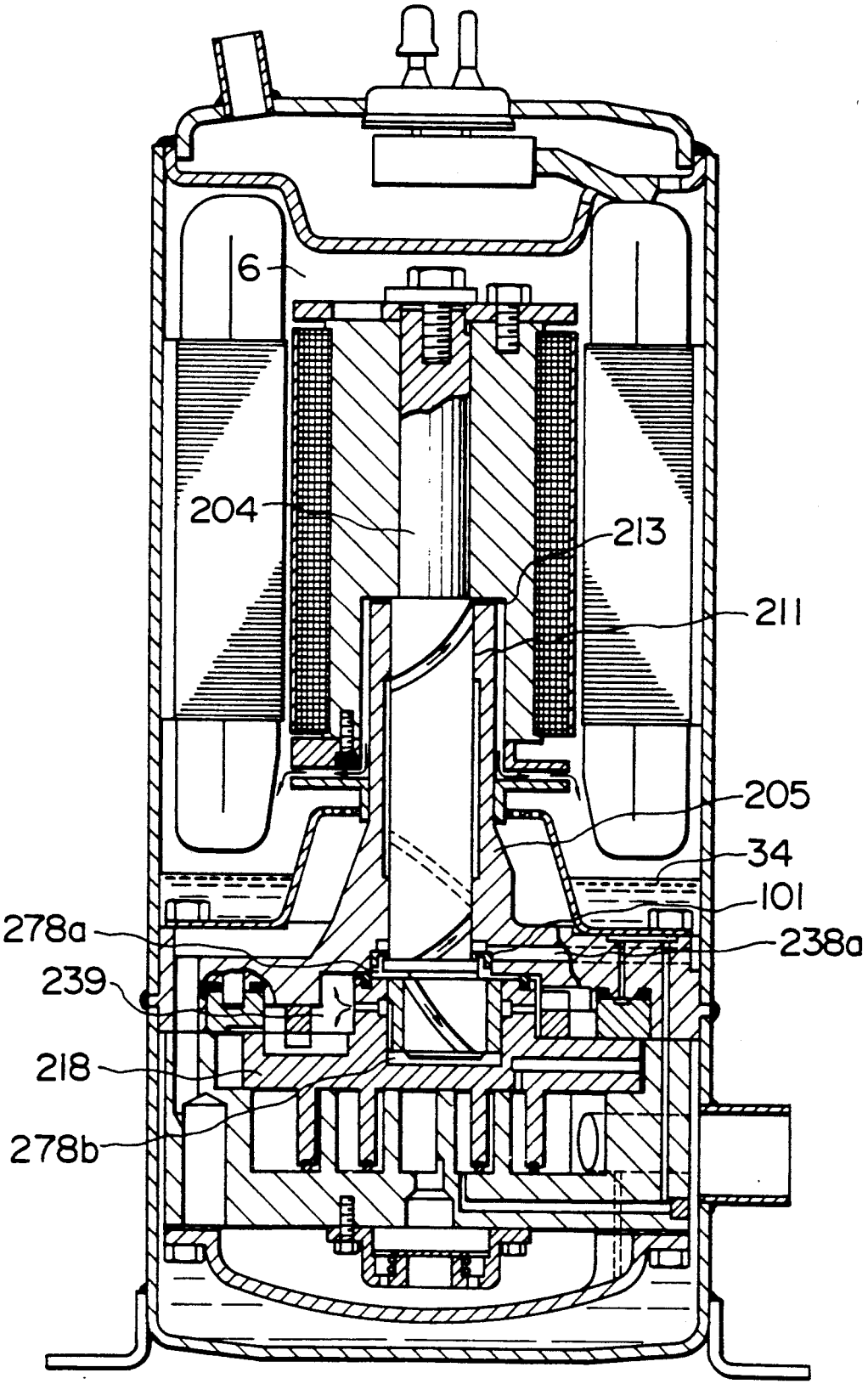
FIG. 21 is a vertical cross-sectional view of a second embodiment of a scroll cooling medium compressor of the present invention.
Figure 22:
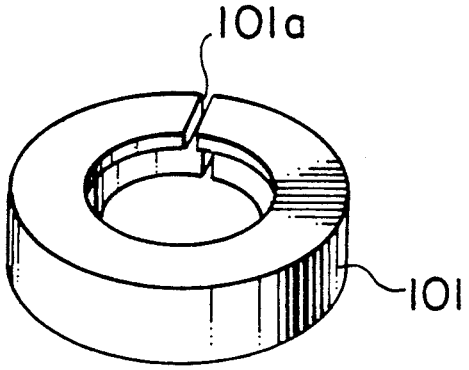
FIGS. 22 and 23 are perspective views of a partition cap and a bearing part of the above compressor, respectively.
Figure 24:
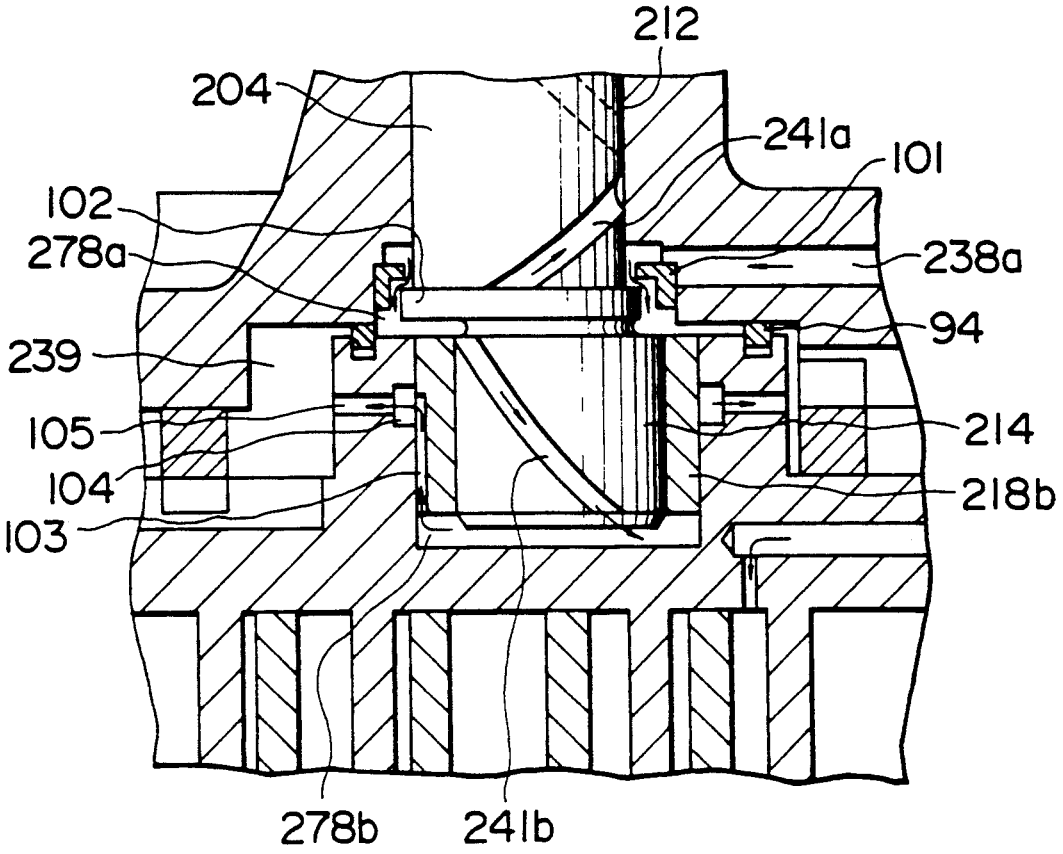
FIG. 24 is a cross-sectional view of a portion of a main bearing portion of the above compressor.

FIG. 21 is a vertical cross-sectional view of a second embodiment of a scroll cooling medium compressor of the present invention. A partition cap 101, shaped by a steel sheet and having an outer shape shown in FIG. 22, is press-fitted in a stepped inner wall of a high-pressure oil chamber 278*a* communicated with a discharge chamber oil reservoir 34 via an oil hole 238*a* formed in a body frame 205, and this partition cap is disposed in such a manner as to cover a flange portion 102 of a drive shaft 204, as shown in FIG. 24. The partition cap 101 has a cut 101*a* at part thereof, and in the condition in which the partition cap is mounted on the stepped inner wall of the oil chamber 278*a*, the cut 101*a* is closed, so that the partition cap partitions the oil chamber 278*a* into two portions close respectively to a main bearing 212 and a revolving bearing 218*b*.

Figure 23:
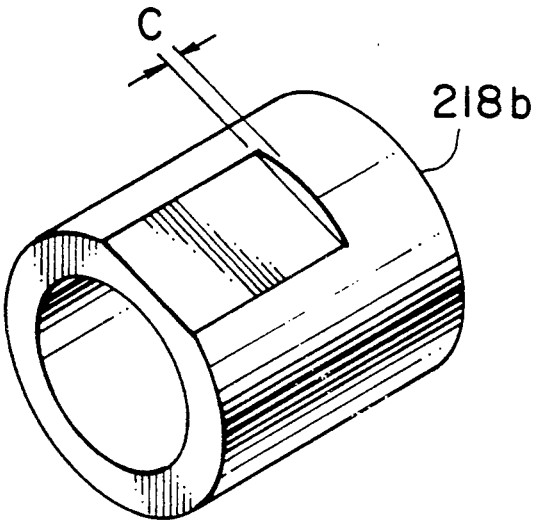

A revolving bearing 218, having an outer shape shown in FIG. 23, is press-fitted in a revolving boss 218*e* of a revolving scroll 218. Part of the outer periphery of the revolving bearing 218 of a cylindrical shape is worked into a flat surface, and its step C is determined to be about 100 microns. This step C, when press-fitted in the revolving boss 218*e*, forms a throttle passage 103, as shown in FIG. 24.

An annular groove 104 and oil holes 105 of a small diameter are formed in the revolving boss 218*e*.

The discharge chamber oil reservoir 34 is communicated with a back-pressure chamber 39 via the oil hole 238*a*, the oil chamber 278*a*, a spiral oil groove 241*b*, an oil chamber 278*b*, the throttle passage 103, the annular groove 104 and the oil holes 105.

Figure 25:
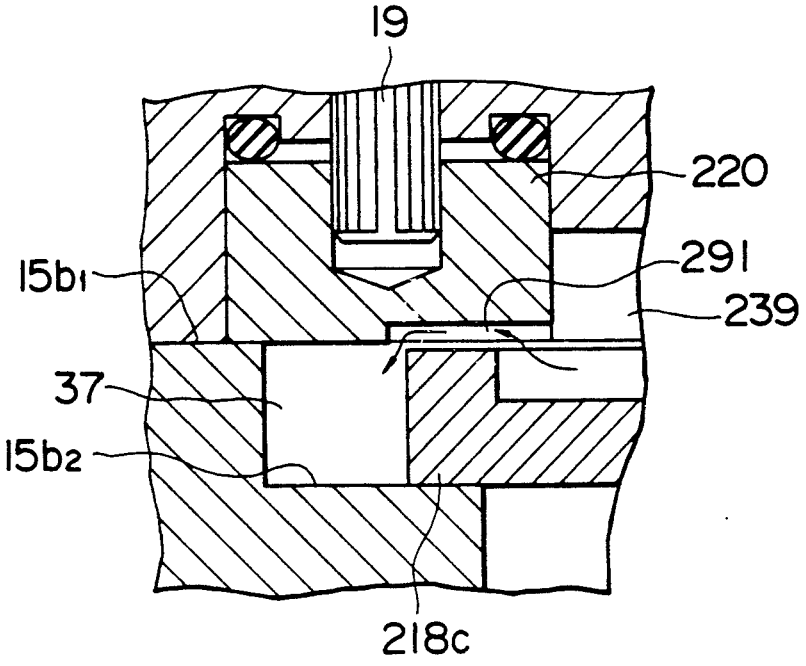
FIG. 25 is a cross-sectional view of a portion of a thrust bearing portion of the above compressor.

As shown in FIG. 25, an outer peripheral space 37 is communicated with the back-pressure chamber 239 via a shallow groove 291 formed in a surface of a thrust bearing 220 only when the compression chambers are at the revolution angle of the intake step, and the position of the shallow groove 291 is so determined that this communication is interrupted by a wrap support disk 218*c* of the revolving scroll 218 when the compressions chambers are at the revolution angle of the compression step.

The other constructions are similar to those of FIG. 5.

Figure 26:
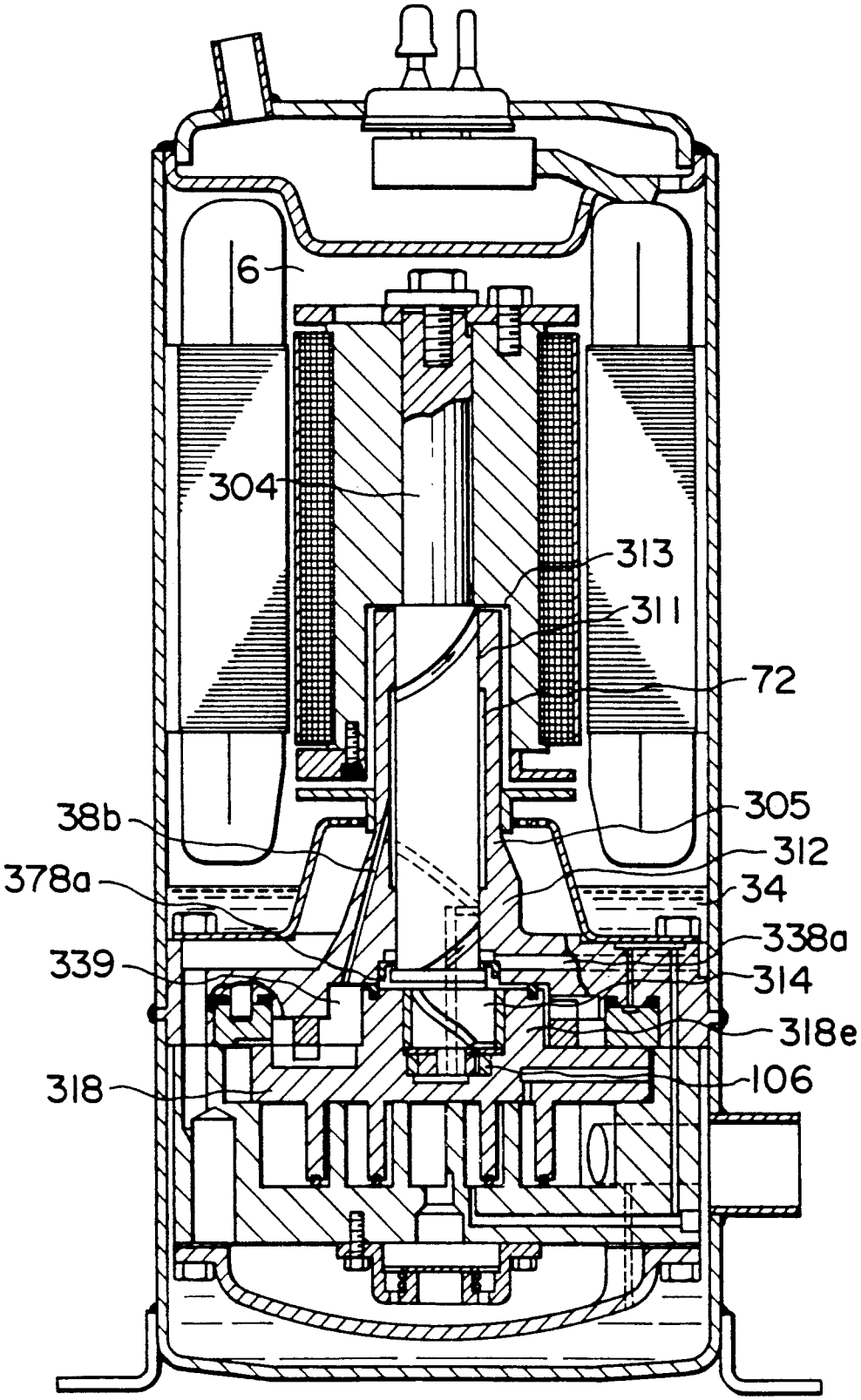
FIG. 26 is a vertical cross-sectional view of a third embodiment of a scroll cooling medium compressor of the present invention.
Figure 27:
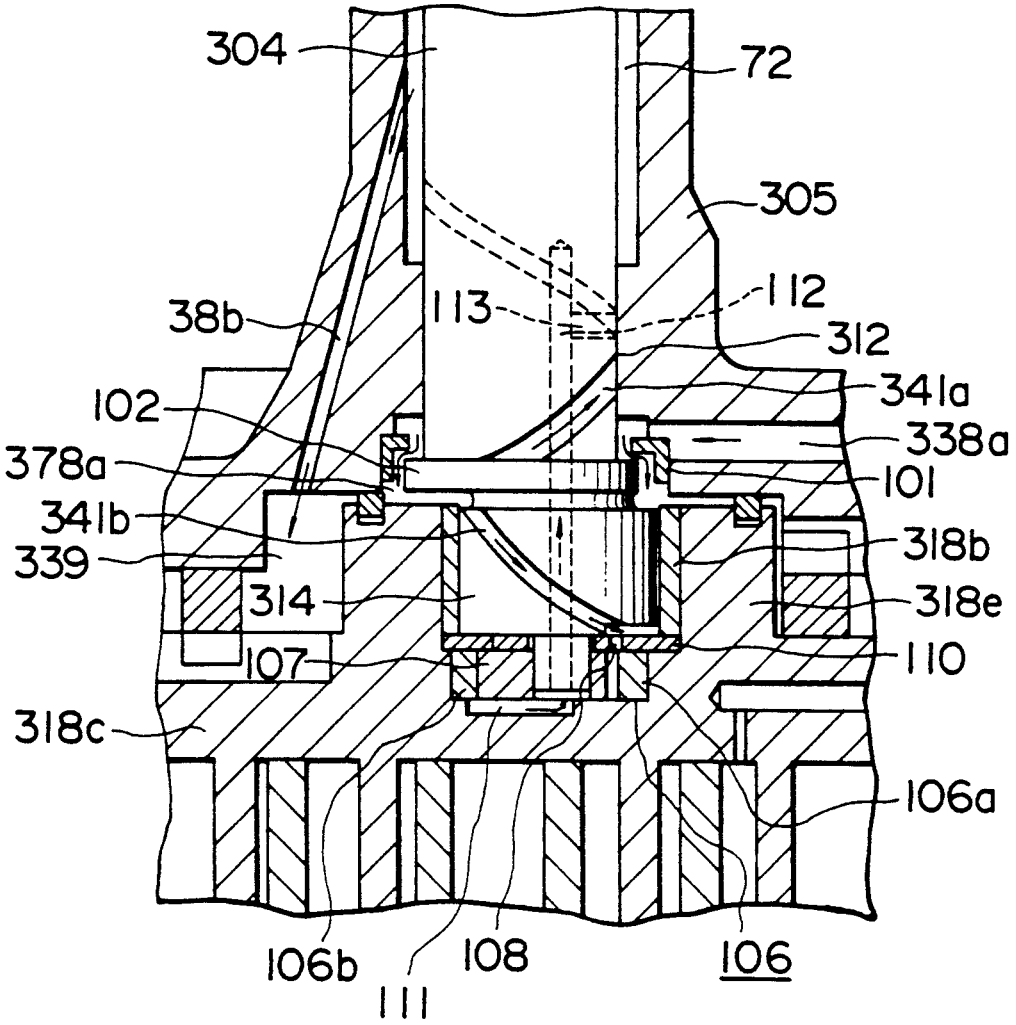
FIG. 27 is a cross-sectional view of a portion of a main bearing portion of the above compressor.

FIG. 26 is a vertical cross-sectional view of a third embodiment of a scroll cooling medium compressor of the present invention. As in FIG. 21, a partition cap 101, shaped by a steel sheet and having an outer shape shown in FIG. 27, is press-fitted in a stepped inner wall of a high-pressure oil chamber 378*a* communicated with a discharge chamber oil reservoir 34 via an oil hole 338*a* formed in a body frame 305, and as in FIG. 24, this partition cap is disposed in such a manner as to cover a flange portion 102 of a drive shaft 304, and partitions the oil chamber 378*a* into two portions close respectively to a main bearing 312 and a revolving bearing 318*b*.

A revolving bearing 318 is press-fitted in a revolving boss 318*e* of a revolving scroll 318, and a trochoid pump device 106 comprising an outer rotor 106*a* and an inner rotor 106*b* is mounted at the bottom thereof.

The trochoid pump device 106 is connected to a drive end shaft 107 formed on a crank 314 on the end of the drive shaft 304, and is driven by it. The crankshaft 314 and the drive end shaft 107 are coaxial with each other.

Figure 28:
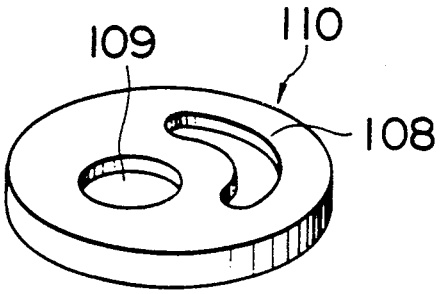
FIG. 28 is a perspective view of a partition plate used in a trochoid pump device in FIG. 27.

A partition plate 110, which has an intake hole 108 and a central hole 109 as shown in FIG. 28, is fixedly mounted between the revolving bearing 318*b* and the trochoid pump device 106.

An oil groove 111, formed in a central portion of a wrap support disk 318*c* of the revolving scroll 318, serves as a discharge port of the trochoid pump device, and the oil groove 111 is communicated with the sliding surface of the main bearing 312 via an axial oil hole 112 and a radial oil hole 113 which are formed in the drive shaft 304.

The discharge chamber oil reservoir 34 is communicated with a back-pressure chamber 339 of the revolving scroll 318 via an oil feed passage and an oil hole 38*b*. The oil feed passage comprises an oil passage, which communicates with an oil reservoir 72 via the oil hole 338*a*, the oil chamber 378*a*, a spiral oil groove 341*b*, the intake hole 108, the trochoid pump device 106, the oil groove 111, the axial oil hole 112, the radial oil hole 113 and the bearing gap of the main bearing 312, and an oil feed passage which communicates with the oil reservoir 72 from the oil chamber 378*a* via the spiral oil groove 341*a*.

The other constructions are similar to those of FIG. 21.

Figure 29:
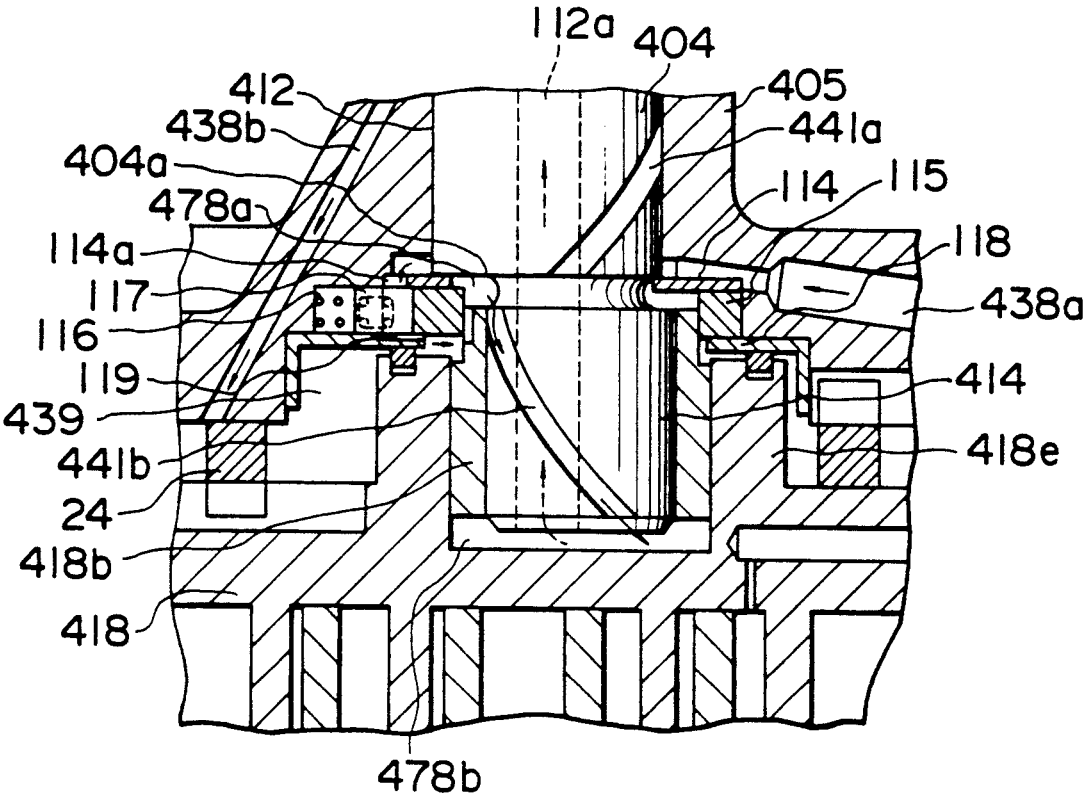
FIG. 29 is a cross-sectional view of a portion of a main bearing portion of a scroll cooling medium compressor according to a fourth embodiment of the present invention.

FIG. 29 is a vertical cross-sectional view of an important portion in the vicinity of an oil feed pump device at a distal end portion of a drive shaft in a fourth embodiment of a scroll cooling medium compressor of the present invention. A side plate 114 with an intake notch 114*a* and a side plate case 118 with a groove 119 whose outer shapes are shown in FIG. 31 are fixedly mounted in a stepped hole of a main bearing 412 of a body frame 405 close to a revolving scroll 418 in spaced relation to each other, and component parts of a rolling piston-type pump device, comprising a ring-shaped piston 115, a partition vane 117 and a coil spring 116, are mounted between the side plate 114 and the side plate case 118.

Figure 31:
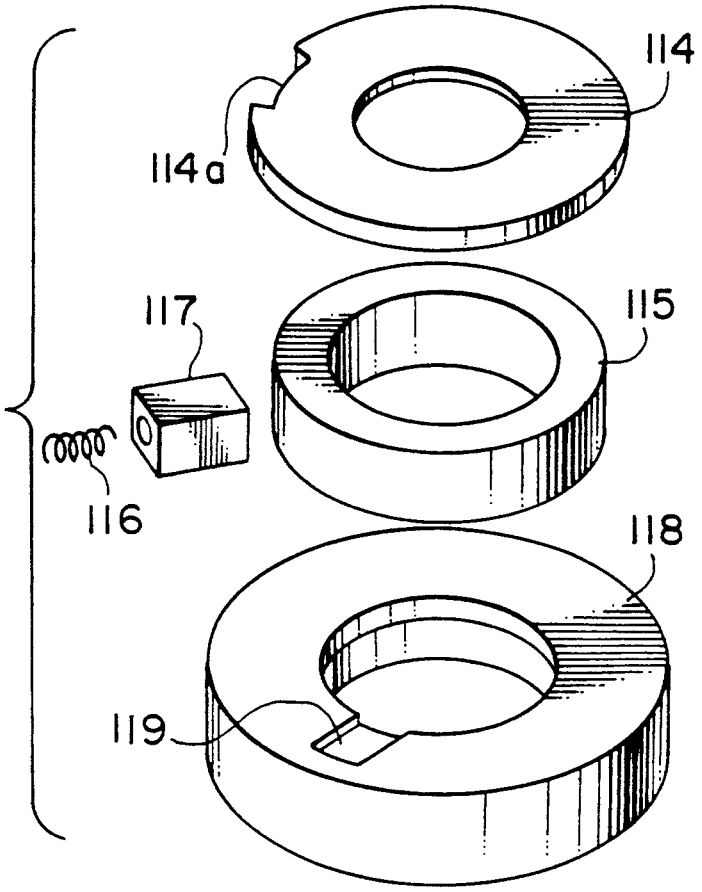
FIG. 31 is an exploded perspective view of component parts of an oil feed pump device of the above compressor.

A revolving bearing 418*b*, having a smaller-diameter outer peripheral portion 418*f* as shown in FIG. 31, is press-fitted in a revolving boss 418*e* of the revolving scroll 418, and its inner peripheral surface is in sliding contact with a crankshaft 414 of a drive shaft 404, and the smaller-diameter outer peripheral portion 418*f* is in sliding contact with the inner peripheral surface of the piston 115.

An oil chamber 478*a*, which is communicated with a discharge chamber oil reservoir 34 via an oil hole 438*a* formed in the body frame 405, is isolated from a back-pressure chamber 439 of the revolving scroll 418 by the side plate case 118, press-fitted in the body frame 405, and an annular ring 94 mounted on the end of the revolving boss 418*e*.

The side plate 114 is abutted against an end face 404*a* of the stepped portion of the drive shaft 404 to isolate the oil hole 438*a* from the peripheral surface of the piston 115.

The oil chamber 478*a* is communicated with the back-pressure chamber 439 via the rolling piston-type oil feed pump device 120, a spiral oil groove 441*b* formed in the outer peripheral surface of the crankshaft 414, an oil chamber 478*b* provided at the end of the crankshaft 414, an axial oil hole 112*a* formed axially in the drive shaft 404, a spiral oil groove 441*a* and an oil hole 438*b* formed in the body frame 405. The open end of the oil hole 438*b* is intermittently closed by a reciprocal movement of an Oldham's ring 24.

The other constructions are similar to those of FIG. 26.

Figure 32:
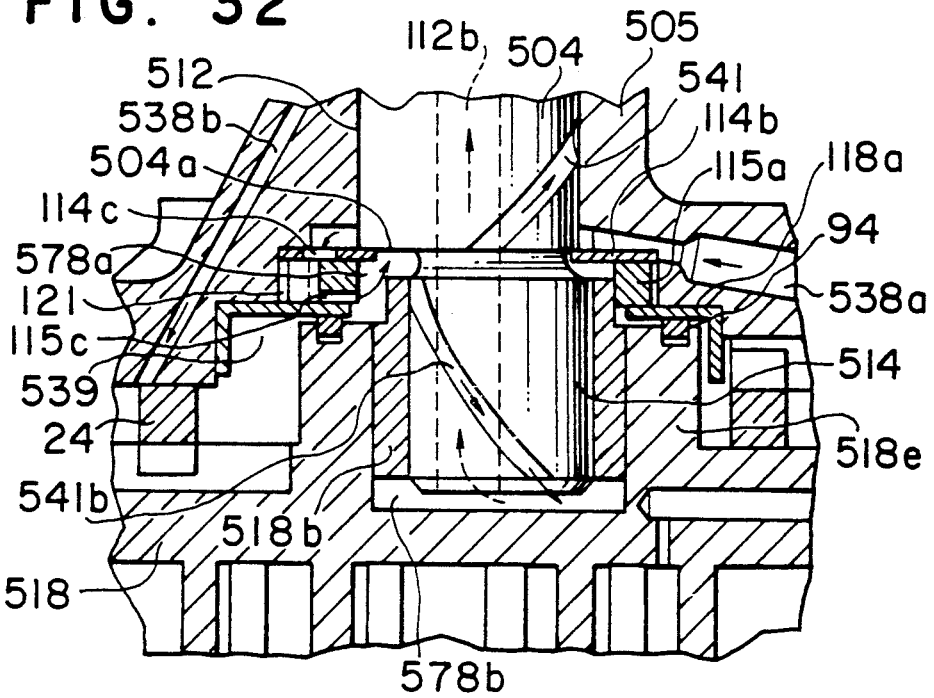
FIG. 32 is a cross-sectional view of a portion of a main bearing portion of a scroll cooling medium compressor according to a fifth embodiment of the present invention.
Figure 33:
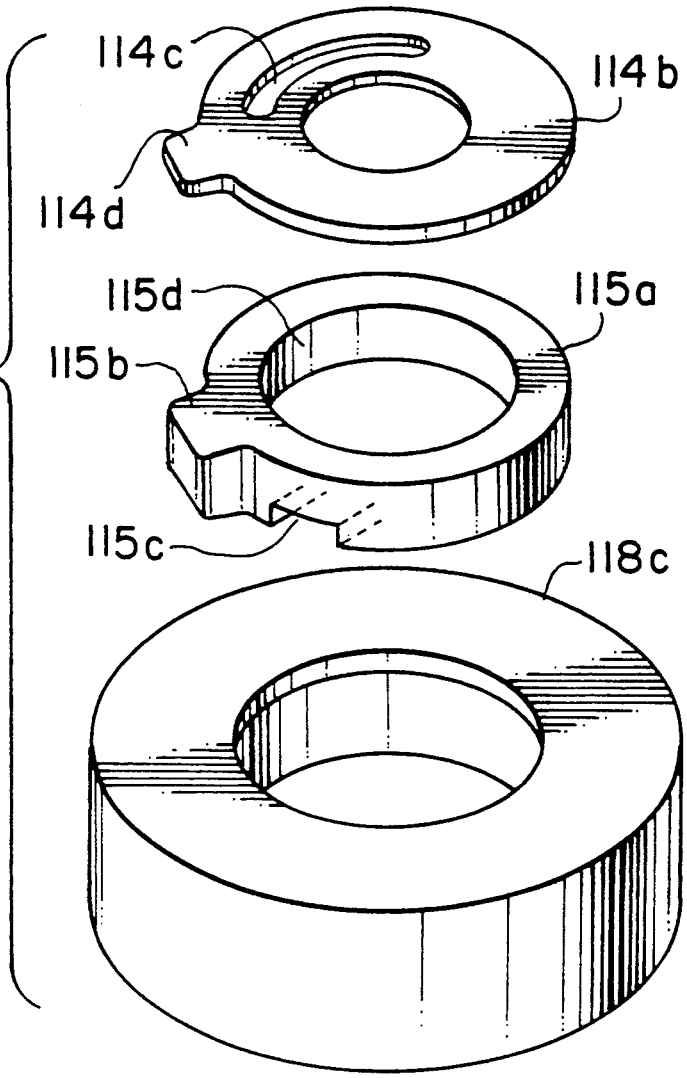
FIG. 33 is an exploded perspective view of component parts of an oil feed pump device of the above compressor.

FIG. 32 is a vertical cross-sectional view of an important portion in the vicinity of an oil feed pump device at a distal end portion of a drive shaft in a fifth embodiment of a scroll cooling medium compressor of the present invention. As in FIG. 25, a side plate 114*b* with a crescent-like intake hole 114*c* and a projection 114*d* and a side plate case 118*a* whose outer shapes are shown in FIG. 33 are fixedly mounted in a stepped hole of a main bearing 512 of a body frame 505 close to a revolving scroll 518 in spaced relation to each other, and a component part of a revolving cylindrical piston-type pump device (which is similar, for example, to a revolving cylindrical piston-type pump device as disclosed in Japanese Patent Publication No. 61-57935), comprising a ring-shaped piston 115*a* with a projection 115*b* and a groove 115*c*, is mounted between the side plate 114*b* and the side plate case 118*a*.

Figure 34:
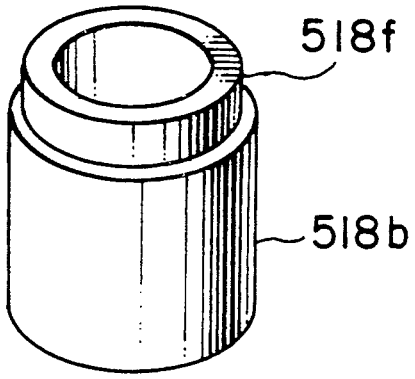
FIG. 34 is a perspective view of a bearing part in FIG. 32.

A revolving bearing 518*b*, having a smaller-diameter outer peripheral portion 518*f* as shown in FIG. 34, is press-fitted in a revolving boss 518 of the revolving scroll 518. When the revolving scroll 518 makes a revolving motion, the smaller-diameter outer peripheral portion 518*f* is intermittently abutted against an inner peripheral surface 115*d* of the piston 115*a*, so that the piston 115*a* makes a revolving and swinging motion around a path smaller than the diameter of revolution of the revolving scroll 518, thereby performing a small displacement capacity pumping action.

Incidentally, the projection 115*b* of the piston 115*a* is engaged in a notched groove 121, formed in the body frame 505, to prevent the rotation of the piston 115*a*.

The side plate 114*b* is abutted against an end face 504*a* of the stepped portion of the drive shaft 504 to isolate an oil hole 538*a* from the peripheral surface of the piston 115*a*.

An oil chamber 578*a*, which is communicated with a discharge chamber oil reservoir 34 via an oil hole A 538*a* formed in the body frame 505, is isolated from a back-pressure chamber 539 of the revolving scroll 518 by the side plate 114*b*, press-fitted in the body frame 505, and an annular ring 94 mounted on the end of the revolving boss 518*e*.

The oil chamber 578*a* is communicated with the back-pressure chamber 539 via the revolving cylindrical piston-type oil feed pump device, a spiral oil groove 541*b* formed in the outer peripheral surface of the crankshaft 514, an oil chamber 578*b* provided at the end of the crankshaft 514, an axial oil hole 112*b* formed axially in the drive shaft 504, a spiral oil groove 541*a* and an oil hole 538*b* formed in the body frame 505. The open end of the oil hole 538*b* is intermittently closed by a reciprocal movement of an Oldham's ring 24.

The other constructions are similar to those of FIG. 26.

Figure 35:
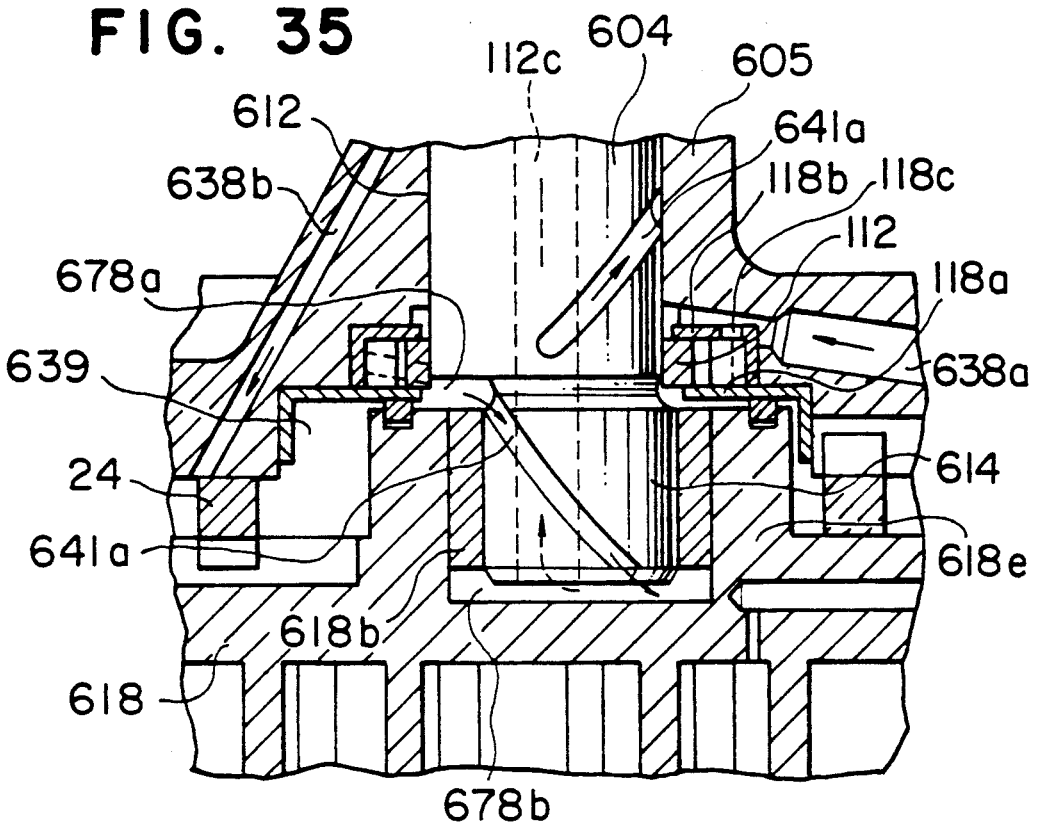
FIG. 35 is a cross-sectional view of a portion of a main bearing portion of a scroll cooling medium compressor according to a sixth embodiment of the present invention.

FIG. 35 is a vertical cross-sectional view of an important portion in the vicinity of an oil feed pump device at a distal end portion of a drive shaft in a sixth embodiment of a scroll cooling medium compressor of the present invention. As in FIG. 29 and FIG. 32, a side plate case 118*b* (shown in FIG. 36) with a crescent-like intake hole 118*c* and a side plate case 118*a* are fixedly mounted in a stepped hole of a main bearing 612 of a body frame 605 close to a revolving scroll 618 in spaced relation to each other, and component parts of a so-called slide vane-type oil feed pump device, which comprises a rotor 122 having two vane grooves 124 and two discharge holes 125 and fixed to a drive shaft 604, and two vanes 123 mounted respectively in the vane grooves 124 for reciprocal movement in the vane grooves 124, is mounted between the side plate cases 118*a* and 118*b*.

An oil chamber 678*a*, which is communicated with a discharge chamber oil reservoir 34 via an oil hole 638*a* formed in the body frame 605, is isolated from a back-pressure chamber 639 of the revolving scroll 618 by the side plate case 118*a*, press-fitted in the body frame 605, and an annular ring 94 mounted on the end of the revolving boss 618*e*.

The oil chamber 678*a* is communicated with the back-pressure chamber 639 via the slide vane-type oil feed pump device, a spiral oil groove 641*b* formed in the outer peripheral surface of a crankshaft 614, an oil chamber 678*b* provided at the end of the crankshaft 614, an axial oil hole 112*c* formed axially in the drive shaft 604, a spiral oil groove 641*a* and an oil hole 638*b* formed in the body frame 605. The open end of the oil hole 638*b* is intermittently closed by a reciprocal movement of an Oldham's ring 24.

The other constructions are similar to those of FIG. 26.

Figure 37:
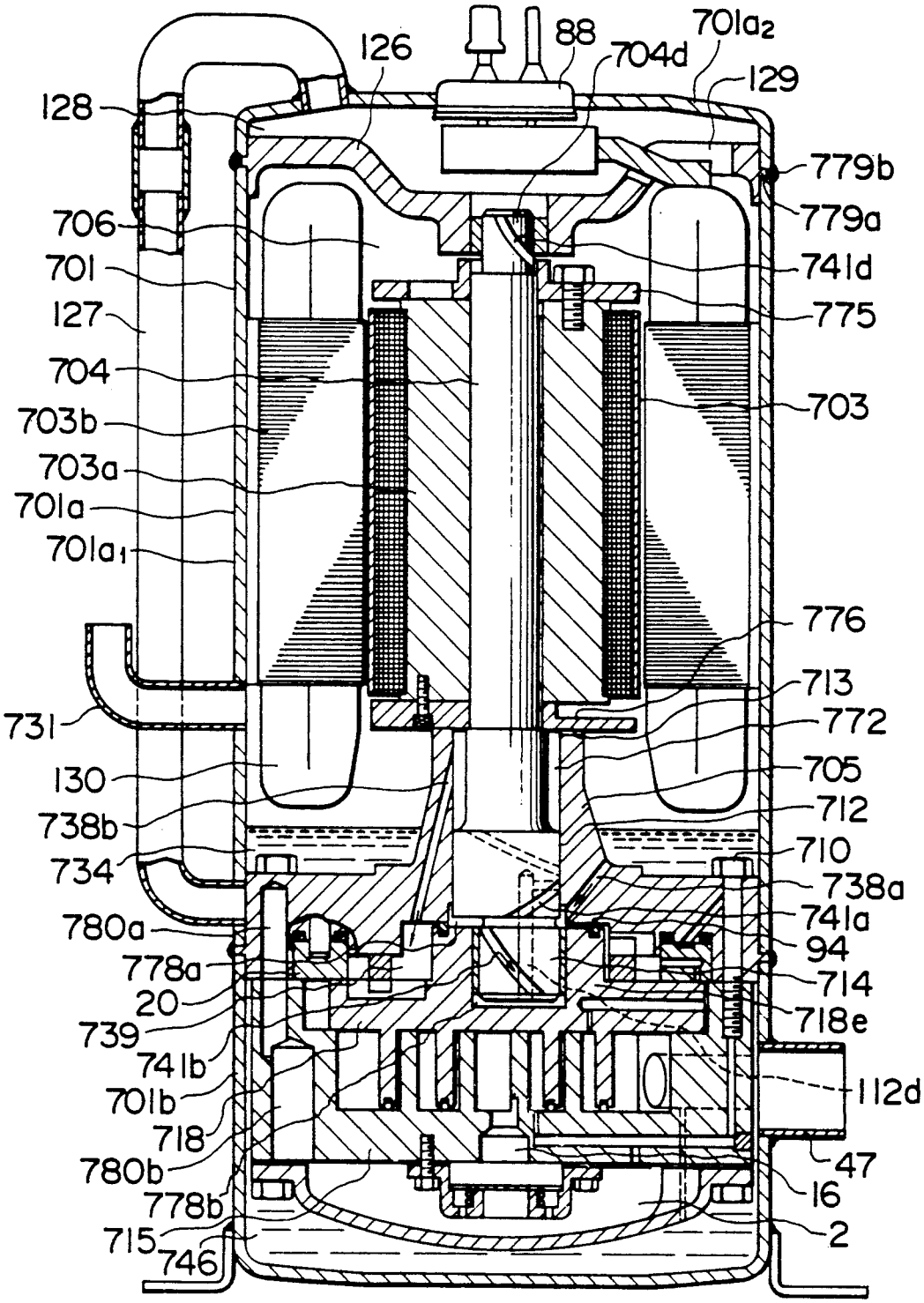
FIG. 37 is a vertical cross-sectional view of a seventh embodiment of a scroll cooling medium compressor of the present invention.

FIG. 37 is a vertical cross-sectional view of a seventh embodiment of a scroll cooling medium compressor of the 93 present invention. As in FIG. 1, the interior of a sealed case 701 of soft iron is partitioned into the side of an upper sealed case 701*a* and the side of a lower sealed case 701*b* by a body frame 705 supporting a drive shaft 704. As in FIG. 1, the interior of the upper sealed case 701*a* is a high-pressure space containing a motor 703, and the interior of the lower sealed case 701*b* is a low-pressure space leading to the downstream side of an evaporator, and constitutes an accumulator chamber 746.

The upper sealed case 701*a* is constituted by a barrel shell 701*a*1, supporting a stator 703*b* of the motor 703, and an upper shell 701*a*2 on which a glass terminal 88 for connection to a motor power source is mounted, and an upper frame 126 supporting one end of the drive shaft 704 is provided between the two shells.

The upper frame 126 is made of gray cast iron having a poor solderability as well as vibration damping characteristics, and a projected portion 779*a* on its outer periphery is held against the inner walls and end surfaces of the upper shell 701*a*2 and the barrel shell 701*a*1, and a single welding bead 779*b* sealingly fixes the upper shell 701*a*2 and the barrel shell 701*a*1 together, and also fixes the outer peripheral portion of the projected portion 779*a* of the upper frame 126 sandwiched therebetween. In other words, the welding bead 779*b* forms an alloy structure between it and the upper shell 701*a*2 and barrel shell 701*a*1 of soft iron, but does not form an alloy structure between it and the surface of the upper frame 126 of gray cast iron, and the welding bead 779*b* surrounds and fixes the upper frame 126 without giving the influence of a welding strain.

An upper balance weight 775 and a lower balance weight 776 are mounted respectively on upper and lower ends of a rotor 703*a* of the motor 703, and the axial movement of the rotor 703*a* is limited between the end of the upper frame 126 and the end of the body frame 705.

The diameter of a main bearing 712 for the drive shaft 704 supported by the upper frame 126 and the body frame 705 is determined to be greater than the sum of the diameter of a crankshaft 714 and a value twice the amount of eccentricity of the crank, so that the drive shaft 704 can be withdrawn upwardly.

The lower balance weight 776 is abutted at its lower surface against a thrust bearing portion 713 at the upper end portion of the body frame 705, and supports the drive shaft 704 and the rotor 703*a*.

An oil reservoir 772 above the main bearing 712 is communicated with a back-pressure chamber 739 of a revolving scroll 718 via an oil hole B 738*b*.

Figure 1:
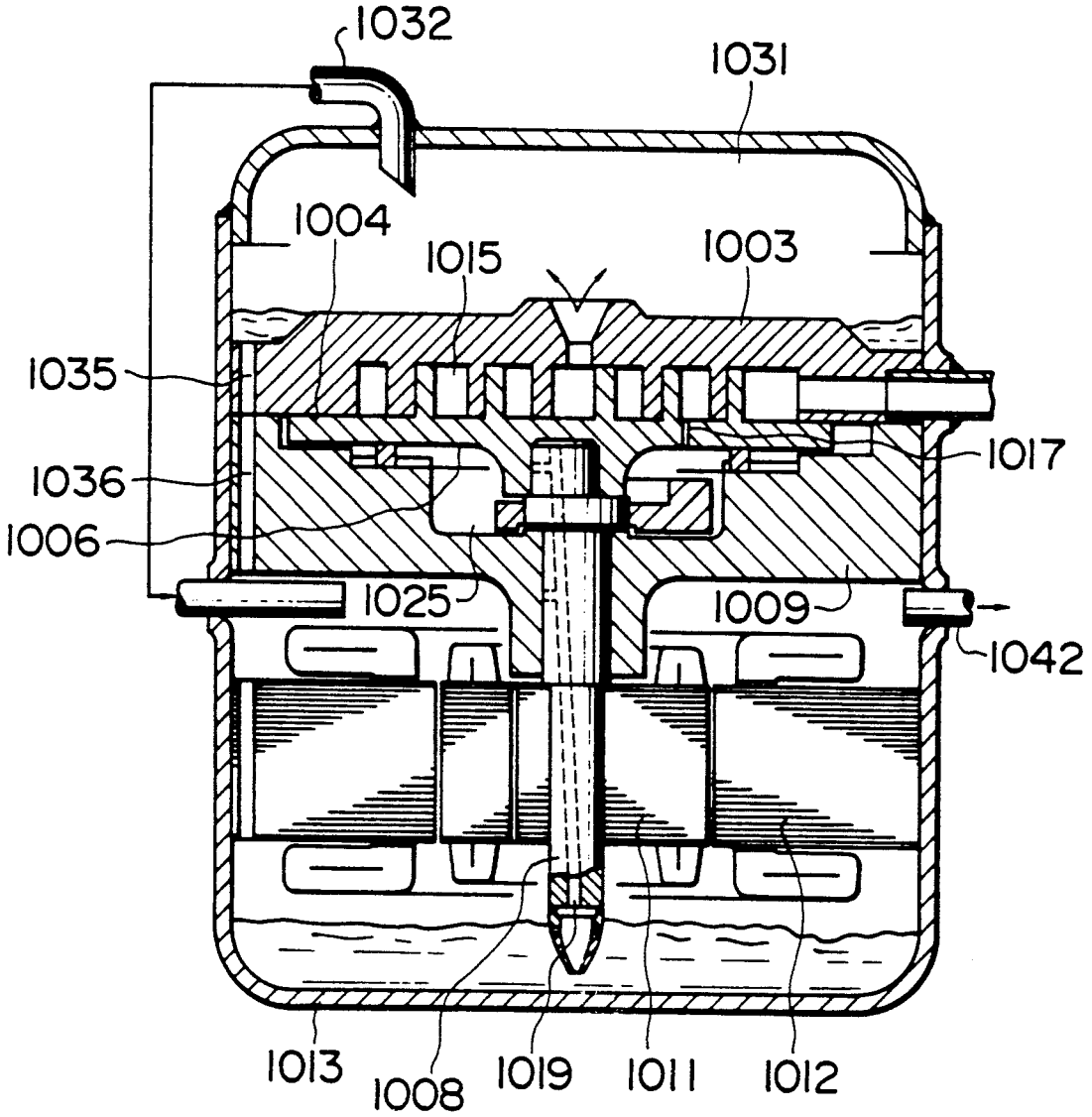
FIG. 1 PRIOR ART
FIGS. 1, 2 and 3 are vertical cross-sectional views of conventional scroll compressors different from one another, respectively.
Figure 2:
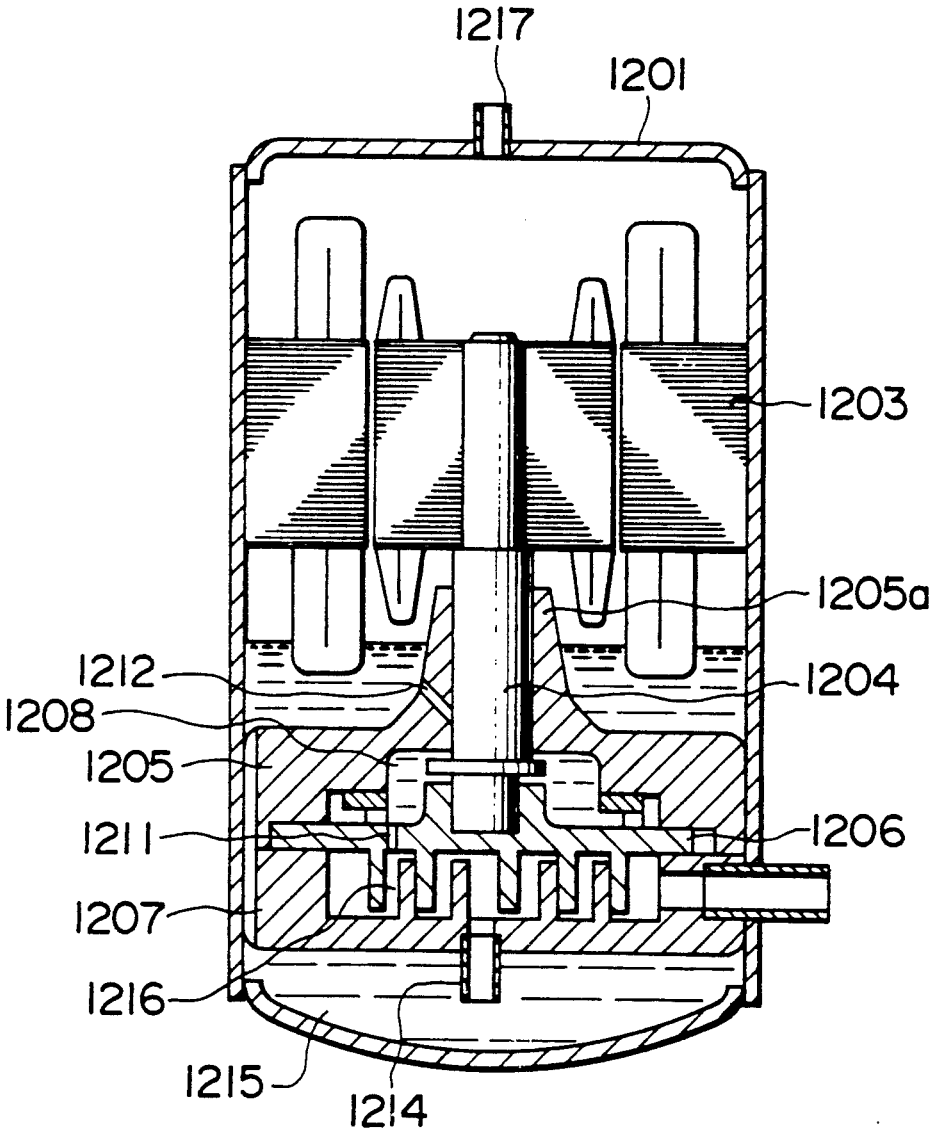
FIG. 2 PRIOR ART
Figure 3:
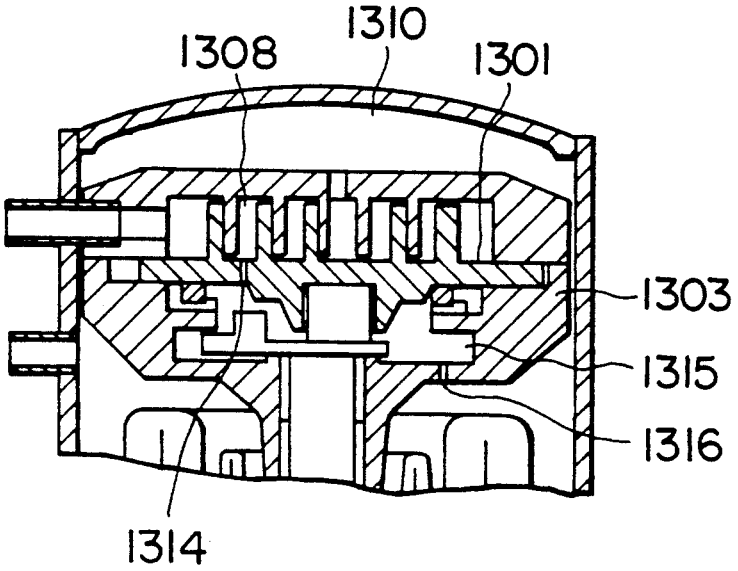
FIG. 3 PRIOR ART
Figure 4:
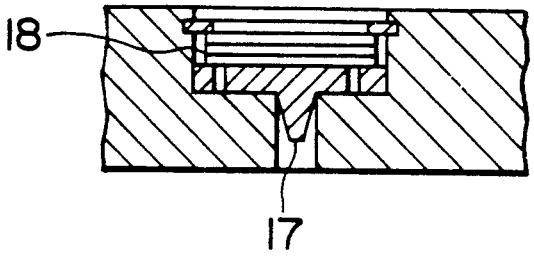
FIG. 4 PRIOR ART
FIG. 4 is a cross-sectional view of a portion of a pressure control valve of FIG. 3.

As in FIG. 1, a thrust bearing 20 is communicated with a compression chamber of a final compression step via gaps in mounting holes receiving bolts 715, which fix a fixed scroll 715 to the body frame 705, and also via very small gaps in screws.

A high-pressure oil chamber 778*a* is communicated with a discharge chamber oil reservoir 34 via an oil hole 738*a* formed in the body frame 705.

A discharge chamber 2, provided at that side of the fixed scroll 715 facing away from the compression chambers, is communicated with an oil separation chamber 128, provided above the upper frame 126, via a gas passage 780*b* formed in the fixed scroll 715, a gas passage 780*a* formed in the body frame 705, and a discharge by-pass pipe 127.

The oil separation chamber 128 is communicated with a discharge pipe 731, formed on the barrel shell 701*a*1 at the outer periphery of a lower motor coil end 130, via a gas hole 129, formed in the upper frame 126, and a motor chamber 706. A spiral oil groove 741 is formed in the surface of an upper end shaft 704*d* of the drive shaft 704 supported by the upper frame 126, and is extended in such a direction that when the drive shaft 704 rotates in its normal direction, lubricating oil, separated from the discharge gas at the oil separation chamber 128, can be guided to the motor chamber 706 by a viscosity pumping action.

The oil chamber 778*a*, communicated with the discharge chamber oil reservoir 34 via the oil hole 738*a* formed in the body frame 705, is isolated from the back-pressure chamber 739 of the revolving scroll 718 by an annular ring 94 mounted on the end of a revolving boss 718*e* of the revolving scroll 718.

The oil chamber 778*a* is communicated with the back-pressure chamber 739 via a spiral oil groove 741*b* formed in the outer peripheral surface of the crankshaft 714, an oil chamber 778*b* provided at the end of the crankshaft 714, an axial oil hole 112*d* formed in the drive shaft 704, a spiral oil groove 741*a*, an oil reservoir 772, and the oil 738*b* formed in the body frame 704. The open end of the oil hole 738*b* is intermittently closed by the revolving movement of the annular ring 94.

The other constructions are similar to those of FIG. 5.

Figure 38:
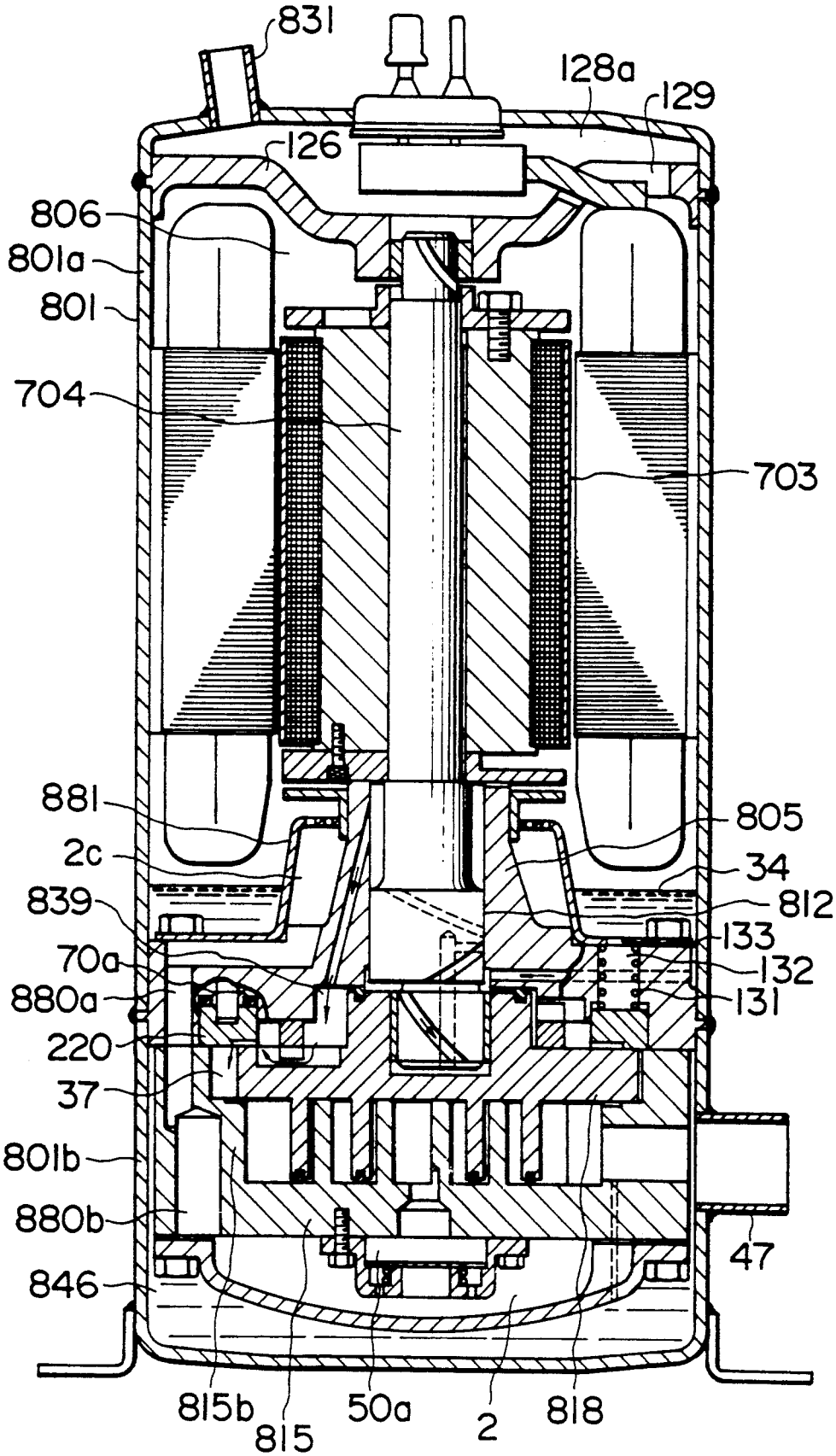
FIG. 38 is a vertical cross-sectional view of an eighth embodiment of a scroll cooling medium compressor of the present invention.

FIG. 38 is a vertical cross-sectional view of an eighth embodiment of a scroll cooling medium compressor of the present invention. As in FIG. 1 and FIG. 37, the interior of a sealed case 801 of soft iron is partitioned into the side of an upper sealed case 801*a* and the side of a lower sealed case 801*b* by a body frame 805 supporting a drive shaft 704. The interior of the upper sealed case 801*a* is a high-pressure space containing a motor 703, and the interior of the lower sealed case 801*b* is a low-pressure space leading to the downstream side of an evaporator, and constitutes an accumulator chamber 846.

As in FIG. 37, the drive shaft 703 connected to the motor 703 is supported by a main bearing 812 of the body frame 805 and an upper frame 126.

A discharge chamber 2 is communicated with a motor chamber 806 at the high-pressure side via a gas passage 880*b* formed in a fixed scroll 815, a gas passage 880*a* formed in the body frame 805, and a discharge chamber 2*c* formed by the body frame 805 and a discharge guide 81.

A discharge pipe 831, mounted on the upper end of the upper sealed case 801*a*, is communicated with the motor chamber 806 via a gas hole 129 formed in the upper frame 126.

A plurality of coil springs 131 are provided at equal intervals at the back side of a thrust bearing 220 facing away form compression chambers. The coil springs 131 are held at their ends by the discharge guide 881, mounted on the body frame 805, to urge the thrust bearing 220 against a mirror plate 815*b* of the fixed scroll 815.

The back side of the thrust bearing 220 is communicated with a discharge chamber oil reservoir 34 via coil spring-mounting holes 132 formed in the body frame 805, and oil introduction holes 133 formed in the discharge guide 881.

A seal ring 70*a* is provided only on the inner side of the thrust bearing 220 at the back side thereof, and the outer peripheral side thereof is sealed by the pressing of the thrust bearing 220 against the mirror plate 815.

The other constructions are similar to those of FIG. 37.

Figure 39:
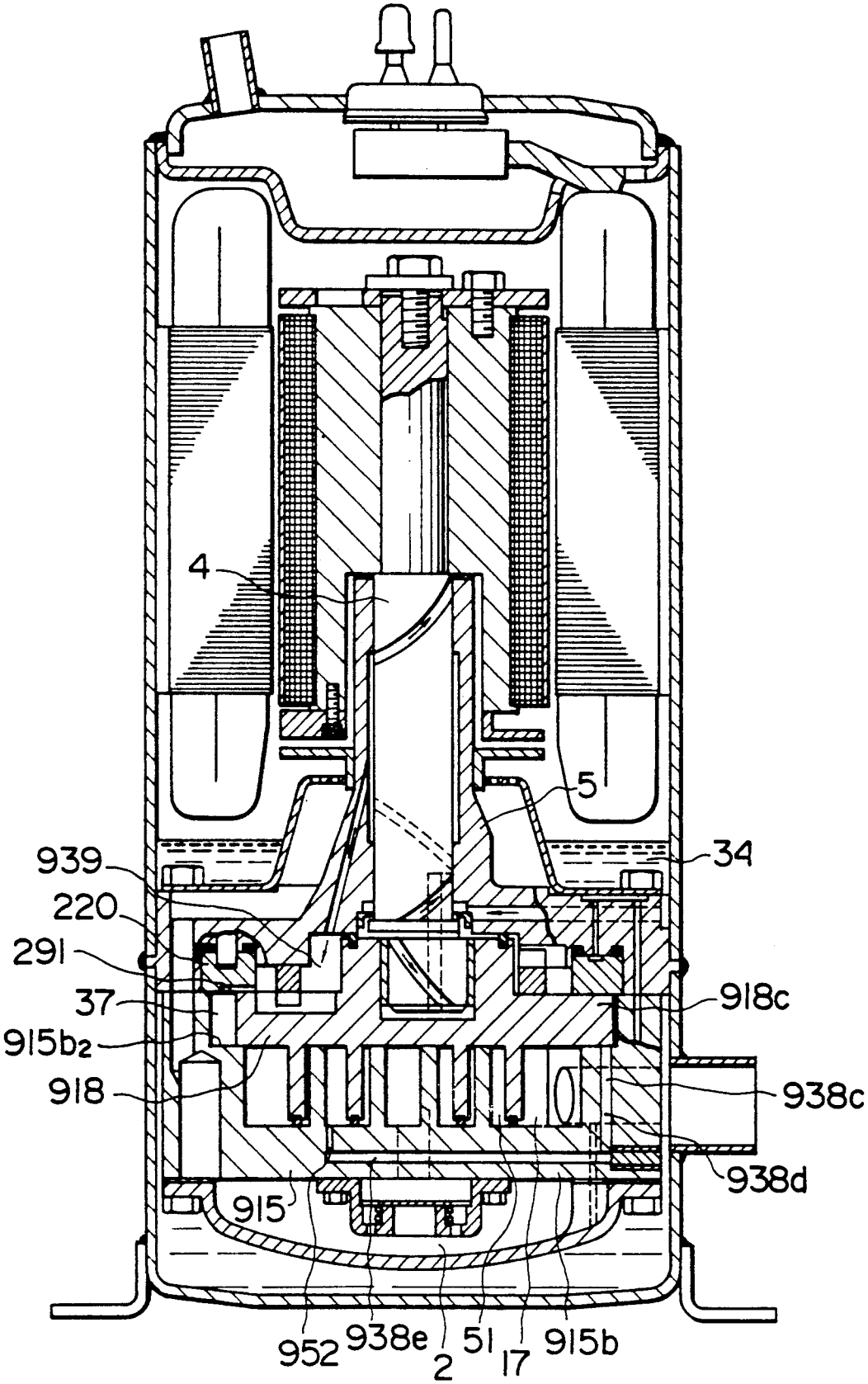
FIG. 39 is a vertical cross-sectional view of a ninth embodiment of a scroll cooling medium compressor of the present invention.

FIG. 39 is a vertical cross-sectional view of a ninth embodiment of a scroll cooling medium compressor of the present invention. Second compression chambers 51*a* and 51*b*, intermittently communicated with an intake chamber 17, are communicated with an outer peripheral space 37 of a revolving scroll 918 via an oil hole 938*c* opening to a sliding surface 915*b*2 of a mirror plate of a fixed scroll 915 and injection holes 952 of a small diameter.

The oil hole 938*c* is constituted by a throttle passage 938*d*, opening to the outer peripheral space 37, and an oil reservoir passage 938*e* communicated with the injection holes 952.

The throttle passage 938*e* is so positioned that it can be communicated with the outer peripheral space 37 only during the intake step of the second compression chambers 51*a* and 51*b* (the condition of first compression chambers 61*a* and 61*b*) intermittently communicated with the intake chamber 17, and that this throttle passage can be isolated from the outer peripheral space 37 by a wrap support disk 918*c* of the revolving scroll 918 during the compression step of the second compression chambers 51*a* and 51*b*.

A back-pressure chamber 939 of the revolving scroll 918 is communicated with the outer peripheral space 37 via an oil groove 291, formed in a thrust bearing 220, only during the intake step of the second compression chambers 51*a* and 51*b* (the condition of the first compression chambers 61*a* and 61*b*) intermittently communicated with the intake chamber 17, and this communication is interrupted by the wrap support disk 918*c* of the revolving scroll 918 during the compression step of the second compression chambers 51*a* and 51*b*.

The oil groove 291, formed in the thrust bearing 220, and the open portion of the oil hole 938 (formed in the fixed scroll 915) opening to the sliding surface 915*b*2 of the mirror plate are disposed respectively at the opposite sides relative to the center of the revolving scroll 918.

The other constructions are similar to those of the first and second embodiments described respectively in FIGS. 5 to 20 and FIGS. 21 to 25.

Figure 40:
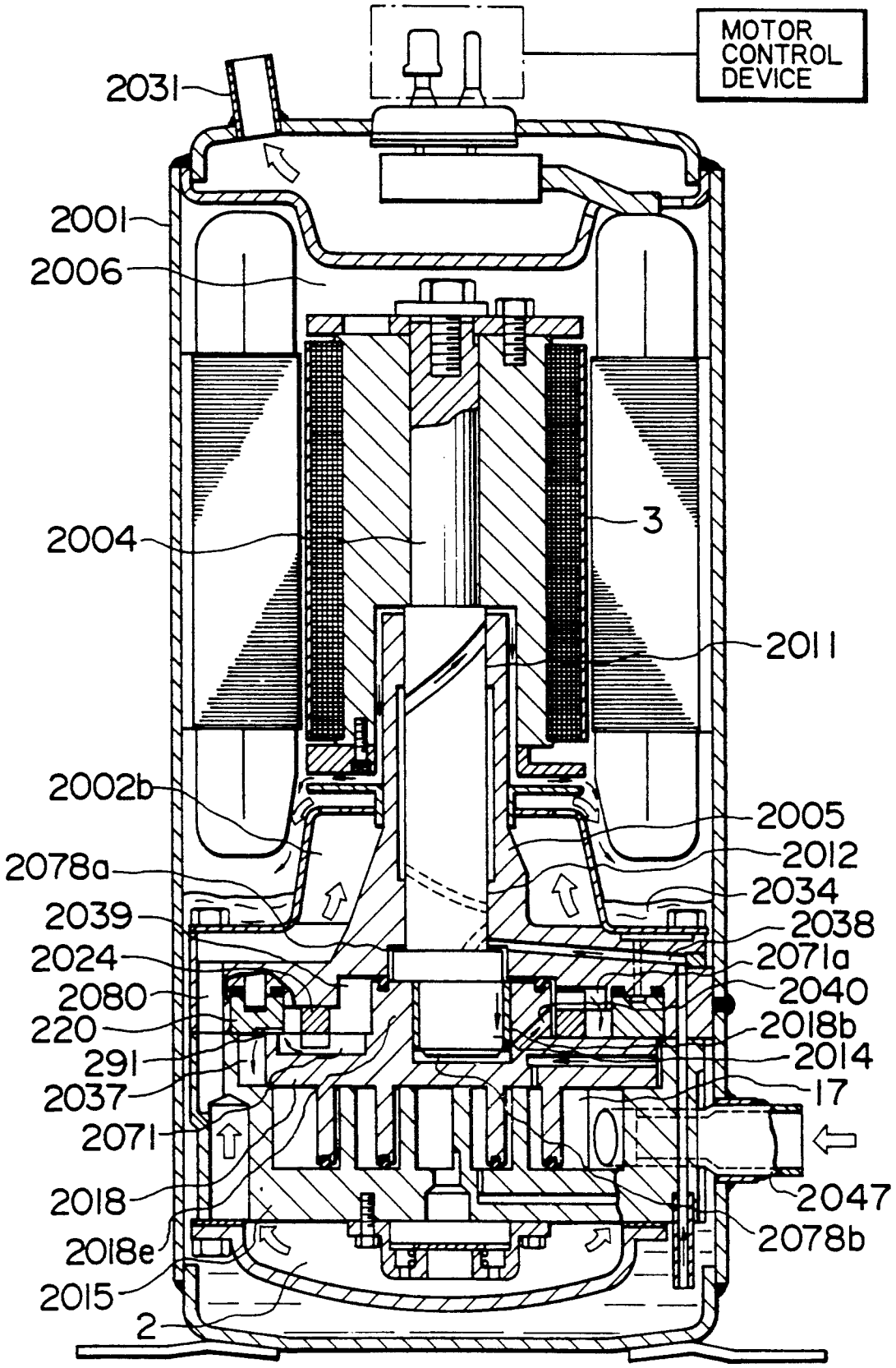
FIG. 40 is a vertical cross-sectional view of a tenth embodiment of a scroll cooling medium compressor of the present invention.

FIG. 40 is a vertical cross-sectional view of a tenth embodiment of a scroll cooling medium compressor of the present invention. The interior of a sealed case 2001 is a high-pressure space, and a discharge chamber oil reservoir 2034 and a scroll compressor mechanism portion are provided at a lower portion thereof, and a motor 3 is provided at an upper portion thereof.

An intake chamber 17 is communicated directly with a low-pressure side outside the compressor via an intake pipe 2047 extending through the side wall of the sealed case 2001 of iron.

A body frame 2005 of cast iron fixes a fixed scroll 2015, and is fixedly welded to several portions of the side wall of the sealed case 2001.

A drive shaft 2004 connected to the motor 3 is supported by a main bearing 2012, close to the compression portion of the body frame 2005, and an upper bearing 2011 close to the motor, and its crankshaft 2014 is slidably connected to a revolving bearing 2018*b* of a revolving scroll 2018.

The discharge chamber oil reservoir 2034 is communicated with an oil chamber 2078*a*, provided at that side of the main bearing 2012 close to the compression chambers, via an oil intake passage 2038 formed in the body frame 2005 and the fixed scroll 2015.

An oil chamber 2078*b* formed by the crankshaft 2014 and the revolving bearing 2018*b* is communicated with a back-pressure chamber 2039 via a narrow hole 2040 formed in the revolving boss 2018*e* of the revolving scroll 2018, and is also communicated with the oil chamber 2078*a* via the sliding gap in the revolving bearing 2018*b*.

An outer peripheral space 2037 of the revolving scroll 2018 is intermittently communicated with the back-pressure chamber 2039 via key grooves 2071 of the revolving scroll 2018, in which an Oldham's ring 2024 is engaged, and oil grooves 291 formed in the thrust bearing 220 only when second compression chambers 51*a* and 51*b* (see FIG. 18) are communicated with the intake chamber 17.

The oil grooves 291 and the key grooves 2071, provided at two portions, are positioned in opposite relation to each other, and communicate the back-pressure camber 2039 with the outer peripheral space 2039 at a phase angle of 180° by the revolution of the revolving scroll 2018.

The other constructions are similar to those of the first and second embodiments, and therefore explanation is omitted.

The operation of the scroll compressors constructed as described above will be described.

In FIGS. 5 to 20, when the drive shaft 4 is driven for rotation by the motor 3, the revolving scroll 18 tends to rotate about the main axis of the drive shaft 4 by the crank mechanism of the drive shaft 4; however, since the key portion (see FIG. 7) of the Oldham's ring 24 close to the revolving scroll 18 is engaged in the key groove 71 of the revolving scroll 18 whereas the opposite key portion is engaged in the key groove 71*a* of the body frame 5, the revolving scroll is prevented from rotation about its axis, and revolves to cooperate with the fixed scroll 15 to change the volume of the compression chambers, thereby performing the intake and compression of the cooling gas medium.

Then, the intake cooling medium of a gas-liquid mixture containing the lubricating oil flows from the refrigerating cycle, connected to the compressor, into the accumulator chamber 46 via the intake pipe 47, and impinges upon the outer surface of the mirror plate 15*b* of the fixed scroll 15, and thereafter passes through the upper space of the accumulator chamber 46, and flows into the intake chamber via the two intake hole 43.

On the other hand, the liquid cooling medium and the lubricating oil, separated from the cooling medium gas because of the weight difference between the gas and the liquid and of the inertia force produced at the time of the change of the flow direction, are once collected at the bottom portion of the accumulator chamber 46, and are drawn in an atomized condition up to the intake holes 43 via the oil suction holes 9*a* and the oil suction holes 9*b* by a negative pressure produced when the intake cooling medium gas passes past the intake holes 43, so that they are again mixed into the intake cooling medium gas.

The intake cooling medium gas subjected to the gas-liquid separation passes through the intake chamber 17 and the first compression chambers 61*a* and 61*b*, formed between the revolving scroll 18 and the fixed scroll 15, and is confined in the compression chambers, and is sequentially fed to the second compression chambers 51*a* and 51*b* and the third compression chambers 60*a* and 60*b* so as to be compressed, and then is discharged to the check valve chamber 50*a* from the central discharge port 16, and is discharged to the motor chamber 6 sequentially via the discharge chamber 2, the gas passages 80*b*, the gas passages A 80*a* and the discharge chamber 2*b*.

The compression chambers are communicated with the discharge port 16 immediately after the completion of the compression, so that the compressed cooling medium gas, when flowing from the compression chambers into the check valve chamber 50*a*, is subjected to an abrupt primary expansion, and during the time period from the discharge completion step immediately thereafter to the compression completion step, the discharge cooling medium gas in the check valve chamber 50*a* temporarily flows back to the compression.

As a result, the cooling medium gas, while repeating the intermittent flow out of and into the compression chambers, flows from the compression chambers to the discharge chamber 2 as a whole, and the discharge cooling medium gas in the check valve chamber 50*a* and the discharge chamber 2, when flowing into and out of the compression chambers, is subjected to pressure variations, thereby producing a pulsating phenomenon.

The pulsation of the discharge cooling medium gas is gradually reduced by a secondary expansion occurring at the time of the flow into the discharge chamber 2 via the discharge small holes 50*h* of the check valve device 50 and also by third and fourth expansions occurring at the time of the flow into the discharge chamber 2*b* and the motor chamber 6 via the two discharge passages 80, so that the pressure variation in the motor chamber 6 is almost damped.

Incidentally, when the discharge cooling medium gas instantaneously flows back from the discharge chamber 2 to the check valve chamber 50*a*, the valve member 50*b* tends to move in response to this flow in a direction to close the discharge port 16; however, during the operation of the compressor, the coil spring 50*c* having shape memory characteristics is fully contracted and does not urge the member 50*b*, and also the valve member 50*b* of a magnetized nature is attracted to the bottom surface of the check valve chamber 50*a* and is not moved apart therefrom, and therefore the valve member 50*b* will not close the discharge port 16.

The discharge cooling medium gas, discharged in a dispersed manner to the motor chamber 6 from the small holes 81*a* in the discharge guide 81, impinges the annular shield plate 86 and the winding of the motor 3, and then passes through the passages at the inner and outer sides of the stator 3*b* to cool the motor 3, and flows to the upper portion of the motor chamber 6, and is delivered to the external refrigerating cycle via the discharge pipe 31.

At this time, part of the lubricating oil in the discharge cooling medium gas deposits on the surface of the winding at the lower portion of the motor 3, and is separated from the cooling medium gas and is collected in the discharge chamber oil reservoir 34. The lubricating oil in the discharge cooling medium gas, passing past the outer peripheral portions of the upper balance weight 75 and lower balance weight 76, is centrifuged by the rotations of the upper balance weight 75 and lower balance weight 76 so as to be diffused to the inner surface of the winding of the motor 3, and flows downward along the inner space of the winding bundle, and is collected in the discharge chamber oil reservoir 34.

Immediately after the compression starts, the release gap 27, which is provided at the back side of the thrust bearing 20 and is communicated with the compression chambers of the final compression step (the compression space of the step immediately before the compression chamber is communicated with the discharge port 16) is filled with the high-pressure cooling medium gas. By this back-pressure urging force and the resilient force of the seal rings 70, the thrust bearing 20 is pressed against the mirror plate mounting surface 15*b*1 of the fixed scroll 15. As a result, the wrap support disk 18*c* of the revolving scroll 18 is held between the mirror plate sliding surface 15*b*2 and the thrust bearing 20.

The lubricating oil in the discharge chamber oil reservoir 34 flows into the back-pressure chamber 39 via the path later described to thereby gradually increase the pressure in the back-pressure chamber, and the wrap support disk 18*c* of the revolving scroll 18 is urged by this back pressure against the mirror plate sliding surface 15*b*2 of the fixed scroll 15 so as to eliminate the gap between the distal end of the fixed scroll wrap 15*a* and the wrap support disk 18*c* of the revolving scroll 18, so that the compression chambers are sealed, and therefore the intake cooling medium gas is efficiently compressed, so that the stable operation is continued.

Incidentally, during the compression, the cooling medium gas, when leaking into the adjacent lower-pressure compression chambers, flows into the tip seal groove 98, and the back pressure of this gas urges the tip seal 98*a* against the side surface of the tip seal groove 98*a* close to the lower-pressure compression chambers and the fixed scroll, thereby sealing the axial gap between the distal end of the revolving scroll 18*a* and the fixed scroll 15.

Figure 12:
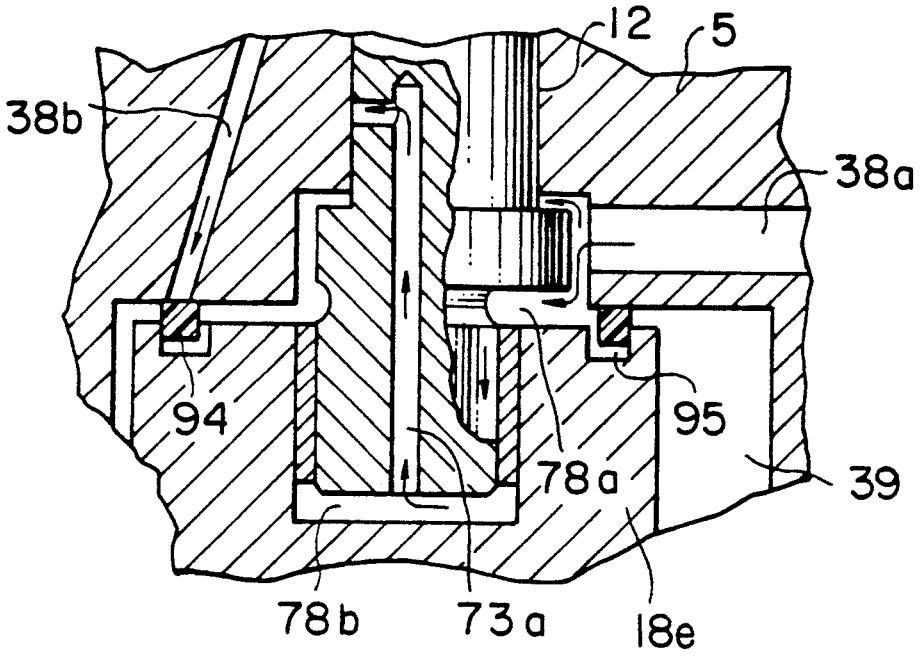
FIG. 12 is a cross-sectional view of a portion of a main bearing portion of the above compressor.

When the compressor is stopped, due to the reserve flow resulting from the pressure differential of the cooling medium gas in the compression chambers, the revolving scroll 18 temporarily revolves in the reverse direction; however, since the cooling medium gas flows back from the compression chambers into the intake chamber 17, the revolving scroll 18 is stopped at such an angle of revolution that the first compression chambers 61*a* and 61*b* are in communication with the intake chamber 17, as shown in FIG. 18. As shown in FIG. 12, in this stop condition, the annular ring 94 closes the inlet of flow of the lubricating oil into the back-pressure chamber 39.

Also, at the time of the stop of the compressor, the cooling gas medium in the compression chamber flows back into the intake chamber 17, so that the pressure of the cooling medium gas in the discharge port 16 abruptly decreases, and due to a pressure differential of the cooling medium gas between the discharge port 16 and the discharge chamber 2, the valve member 50*b* closes the discharge port 16 to prevent a continuous reverse flow of the discharge cooling medium gas from the discharge chamber 2 to the compression chambers.

After the stop of the compressor, until the pressure balance of the refrigerating cycle is achieved, the valve member 50*b* of a magnetized nature is kept away from the bottom surface of the check valve chamber 50*a* by the pressure differential, and the valve member 50*b* continues to close the discharge port 16. In parallel with this, the coil spring 50 having shape memory characteristics is expanded due to its temperature drop, and the valve member 50*b* continues to close the discharge port 16 by the urging force of the coil spring 50.

The first compression chambers 61*a* and 61*b*, intermittently communicated with the intake chamber 17, are communicated with the back-pressure chamber 39 via the oil hole 91, formed in the thrust bearing 20, only when the first compression chambers 61*a* and 61*b* are in communication with the intake chamber 17. The oil film seal of the lubricating oil is provided between the thrust bearing 20 and the wrap support disk 18*c*, and therefore the cooling medium gas will not flow from the compression chambers back to the back-pressure chamber 39 during the compression.

During the stop of the compressor, the pressure within the compressor is balanced, and the liquid cooling medium has flowed not only into the accumulator chamber 46 but also into the compression chambers, and at the initial stage of the activation of the compressor in its cooled condition, the liquid compression is liable to occur, and due to the compressed cooling medium pressure in the compression chambers, a thrust force exerted in a direction opposite to the discharge port 16 acts on the revolving scroll 18.

On the other hand, at the initial stage of the activation of the compressor in its cooled condition, the pressure of the back-pressure chamber 39 is low, and the wrap support disk 18*c* of the revolving scroll 18 is kept away from the mirror plate sliding surface 15*b*2, and is retracted to the thrust bearing 20 and is supported thereby, and a gap is produced between the wrap support disk 18*c* and the distal end of the fixed scroll 15*a*, and the pressure in the compression chambers is lowered, and the compression load at the initial stage of the activation is reduced.

During the continuous operation, if the pressure in the compression chambers should temporarily increases abnormally due, for example, to the development of the liquid compression in the compression chambers, the thrust force acting on the revolving scroll 18 becomes greater than the back-pressure urging force acting on the back side of the revolving scroll 18, so that the revolving scroll 18 is moved in the axial direction and is supported by the thrust bearing 20. Then, the sealing of the compression chambers is released in the same manner as described above, and the pressure of the compression chambers decreases, and the compression load is lowered.

At the initial stage of the activation of the compressor in its cooled condition, the lubricating oil in the discharge chamber oil reservoir 34 is drawn into the oil chamber 78*a* via the oil hole 38*a* by the screw pumping action of the spiral oil grooves 41*a* and 41*b* formed in the drive shaft 4.

Thereafter, part of the lubricating oil passes through the spiral oil groove 41*b*, the oil chamber 78*b* and the oil feed hole 73*a*, and lubricates the sliding surface of the revolving bearing 18*b*, and is supplied to the sliding surface of the main bearing 12, and is delivered to the oil reservoir 72.

The lubricating oil, supplied to the main bearing 12 by the spiral oil groove 41*a*, is combined with the lubricating oil, passed through the oil chamber 78*b*, at the oil reservoir 72, and thereafter part of the lubricating oil is reduced in pressure at the throttle passage portion of the oil hole 38*b*, and is intermittently supplied to the back-pressure chamber 39, and the remainder of the lubricating oil lubricates the sliding surfaces of the upper bearing 11 and the thrust bearing 13, and then is again recovered by the discharge chamber oil reservoir 34.

Incidentally, the oil reservoir 72 is isolated from the motor chamber 6 by the sealing effect of the oil film which lubricates the upper bearing 11.

Following the lapse of time after the activation of the compressor in its cooled condition, the pressure of the motor chamber 6 increases, and the lubricating oil in the discharge chamber oil reservoir 34 is drawn into the oil chamber 78*a* also by the pressure differential between it and the back-pressure chamber 39, and is supplied to the back-pressure chamber 39 in cooperation with the screw pumping action of the spiral oil grooves 41*a* and 41*b* so as to gradually increase the pressure of the back-pressure chamber 39.

In the arrangement of the construction in which the center of the compression chambers, the center of the revolving bearing 18*e* and the center of the annular ring 94 are generally aligned with one another, the annular ring 94 revolves with the revolving scroll 18, and therefore tends to move out of the annular seal groove 95, formed in the revolving boss 18*e*, due to the inertia force produced at this time. As a result, the annular ring 94 is urged against the body frame 5 and the outer surface of the annular seal groove 95, and due to an oil sweeping action of the annular ring 94, the lubricating oil is forced in between the annular seal groove 95 and the annular ring 94, and the annular ring 94 is urged also by the dynamic pressure produced at this time, thereby providing a seal between the oil chamber 78*a* and the back-pressure chamber 39.

Further, since the annular ring 94 is also urged against the outer surface of the annular seal groove 95 by the pressure differential between the back-pressure chamber 39 and the oil chamber 78*a*, the seal between the two spaces is made more positive.

Incidentally, the oil film of the lubricating oil residing in the oil grooves 94*a* of the annular groove 94 seals the sliding surface between the annular ring 94 and the body frame 5, and also reduces wear of the sliding surface and the sliding resistance.

The revolving scroll 18 is uniformly urged toward the fixed scroll 15 by the lubricating oil pressure of the high-pressure oil chamber 78*a* and the lubricating oil pressure of the medium-pressure back-pressure chamber 39, and the wrap support disk 18*c* and the mirror plate sliding surface 15*b*2 smoothly slide relative to each other, and also the deformation of the wrap support disk 18c is reduced to thereby minimize the axial gap of the compression chambers.

The lubricating oil, flowed into the back-pressure chamber 39, intermittently flows into the outer peripheral space 37 via the oil hole 91 formed in the thrust bearing 20, and is decreased in pressure while passing through the oil hole 38c and the injection holes 52 of a small diameter formed in the wrap support disk 18c, and flows into the second compression chambers 51a and 51b. The lubricating oil lubricates the sliding surfaces and seals the sliding gaps during the flow thereof.

The lubricating oil, injected into the second compression chambers 51a and 51b, is combined with the lubricating oil which flows into the compression chambers together with the intake cooling medium gas, and seals the very small gap between the adjacent compression chambers by the oil film to prevent the leakage of the compressed cooling medium gas, and lubricates the sliding surfaces between the compression chambers, and is again discharged, together with the compressed cooling medium gas, to the motor chamber 6 via the discharge port 16.

In the oil feed path from the discharge chamber oil reservoir 34 via the back-pressure chamber 39 to the second compression chambers 51a and 51b, the back-pressure chamber 39 is maintained at the proper medium pressure intermediate the discharge pressure and the intake pressure.

As shown in FIG. 20, the open portions of the injection holes 52a and 52b of the second compression chambers 51a and 51b are subjected to pressure variations, and the pressure thereof is temporarily higher than the pressure 68 of the back-pressure chamber varying in response to the pressure of the motor chamber 6; however, at this time, with respect to the back-pressure chamber 39 and the outer peripheral space 37, the lap support disk 18c closes the open end of the oil hole 91 of the thrust bearing 20, and the oil seal is provided between the sliding surfaces of the lap support disk 18c and the thrust bearing 20, and therefore the cooling medium gas during the compression will not flow back into the back-pressure chamber 39, and also the average pressure of the second compression chambers 51a and 51b is lower than the pressure of the back-pressure chamber 39.

Also, as described above, the revolving scroll 18 at the initial stage of the activation of the compressor is kept away from the fixed scroll 15, and is supported by the thrust bearing 20 receiving the resilient force of the seal rings 70 and the back pressure of the cooling medium gas fed from the compression chambers at the final compression step.

The lubricating oil, supplied to the back-pressure chamber 39 by the pressure-differential after the activation of the compressor becomes stable, applies the urging force of a medium pressure to the revolving scroll 18 to press the wrap support disk 18c against the mirror plate 15, and provides the oil film seal between the sliding surfaces thereof by the oil film, and also provides the seal between the outer peripheral space 37 and the intake chamber 17.

Also, the lubricating oil in the back-pressure chamber 39 is provided between the gap between the sliding surfaces of the thrust bearing 20 and the lap support disk 18c to seal this gap.

Also, since the compression ratio of the scroll compressor is constant, there are occasions when the intake cooling medium gas pressure is relatively high as immediately after the activation in the cooled condition, so that the pressure in the compression chambers become very high, or occasions when an abnormal liquid compression occurs. In such case, as described above, the revolving scroll 18 is moved away from the fixed scroll 15, and is supported by the thrust bearing 20.

However, the thrust bearing 20 urged by the back pressure can not support the abnormally-increased pressure load of the compression chambers, and is retracted in a direction to reduce the release gap 27, so that the axial gap between the lap support disk 18c of the revolving scroll 18 and the distal end of the fixed scroll lap 15a of the fixed scroll 15 is increased. As a result, much leakage develops between the compression chambers, and the pressure of the compression chambers abruptly decreases during the compression, as indicated by the dot-and-dash line 63a in FIG. 19.

After the compression load is instantaneously decreased, the thrust bearing 20 is instantaneously returned to its initial position, and the pressure of the back-pressure chamber 39 is not lowered greatly, and the stable operation is again continued.

Incidentally, when the revolving scroll 18 is retracted toward the thrust bearing 20, the axial dimension between the distal end of the revolving scroll lap 18a and the fixed scroll 15 is also increased; however, since the tip seal 98a is urged toward the fixed scroll 15 by the gas pressure at the back side thereof, the compressed cooling medium gas hardly leaks through this portion.

Also, even if a foreign matter gets caught in the axial gap between the revolving scroll 18 and the fixed scroll 15, the thrust bearing 20 is retracted as described above to remove the foreign matter.

Also, if a temporary liquid compression occurs at the initial stage of the activation in the cooled condition or during the constant operation, an abnormal excessive compression occurs as indicated by the dotted line 63 in FIG. 19; however, the volume of the high-pressure space communicated with the discharge port 16 is large, and besides the expansion is repeated while it sequentially passes through the check valve chamber 50a, the discharge chamber 2 and the discharge chamber 2b, and therefore pressure variations of the motor chamber 6 hardly occur.

Also, as the speed of operation of the compressor increases, the leakage of the cooling medium gas per unit time at the compression chambers becomes smaller. On the other hand, the time of opening of the injection holes 52a and 52b per revolution is shortened, and the amount of injection of the oil to the compression chambers is restrained, and also the passage resistance is increased because of the increase of the speed of interruption between the oil hole 38b and the back-pressure chamber 39, and the amount of flow of the lubricating oil from the oil chamber 78a into the back-pressure chamber 39 is also restrained, so that the pressure of the back-pressure chamber 39 is properly maintained.

Also, during the operation of the scroll cooling medium compressor incorporated in the heat pump refrigerating cycle, when it is switched from the heating operation to the defrosting operation, the high-pressure side is communicated with the evaporator whereas the low-pressure side is communicated with a condenser side, though for a short period of time, and therefore the pressure of the motor chamber 6 is temporarily lowered. When in response to this, the pressure of the back-pressure chamber 39 communicated with the motor chamber 6 is lowered, so that the proper back pressure can not be maintained, the plunger 29 of the back-pressure control valve device 25 mounted on the wrap support disk 18*c* is moved toward the outer peripheral space 37, as shown in FIG. 17, by the lubricating oil pressure of the oil hole 54*b*, communicated with the oil chamber 78*b*, against the coil spring 53 and the back pressure of the lubricating oil leading to the back-pressure chamber 39, and the oil chamber 78*b* is communicated with the back-pressure chamber 39, so that the high-pressure lubricating oil flows into the back-pressure chamber 39 to restore the back-pressure chamber 39 into the proper pressure, and the plunger 29 is again moved toward the oil chamber 78*b* as shown in FIG. 16, thereby isolating the oil chamber B 78*b* from the back-pressure chamber 39.

Also, when the thermal load at the evaporator side is high and the condensing capacity of the condenser side is large, the operation is done in the condition in which the intake pressure is relatively high and the discharge pressure is relative low.

In such a case, since the pressure of the compression chambers is higher than during the normal operation, it is necessary to increase the pressure of the back-pressure chamber than usual; however, even in this case, as described above, the plunger 29 is moved toward the outer peripheral space 37 by the lubricating oil pressure of the oil hole 54*b*, communicated with the oil chamber 78*b*, and the intake-side cooling medium pressure, communicated with the intake chamber 17 via the oil hole 54*a*, against the coil spring 53 and the back pressure of the lubricating oil leading to the back-pressure chamber 39, as shown in FIG. 13, and the oil chamber 78*b* is intermittently (or partially) communicated with the back-pressure chamber 39, so that the high-pressure lubricating oil flows into the back-pressure chamber 39, thereby maintaining the back-pressure chamber 39 at the proper pressure.

Naturally, the plunger 29 tends to move toward the outer peripheral space 37 while receiving influences due to the centrifugal force, the inertia force and the frictional force acting thereon, and therefore the pressure of the back-pressure chamber 39 becomes higher as the speed of operation of the compressor increases.

Also, in the above embodiment, although the compressed cooling medium gas during the final compression step is introduced into the release gas 27 provided at the back surface of the thrust bearing 20, the discharge cooling medium gas at the region where the compression chambers at the final compression step are communicated with the discharge port 16 may be introduced into the release gap 27.

Figure 7:
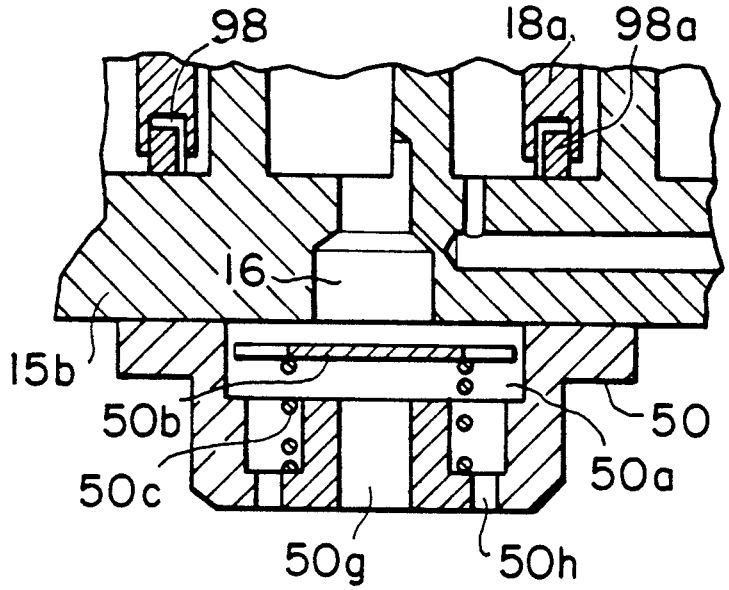
FIG. 7 is a cross-sectional view of a portion of a check valve device provided at a discharge port portion of the above compressor.
Figure 8:
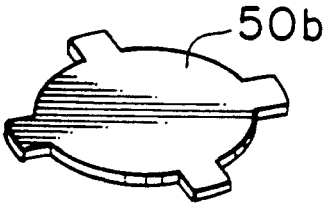
FIGS. 8, 9 and 10 are perspective views of component parts of the check valve device of FIG. 8, respectively.
Figure 9:
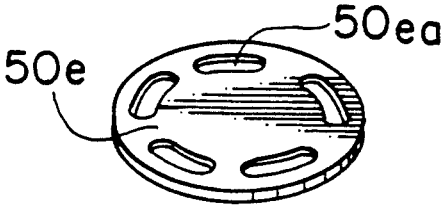
Figure 10:
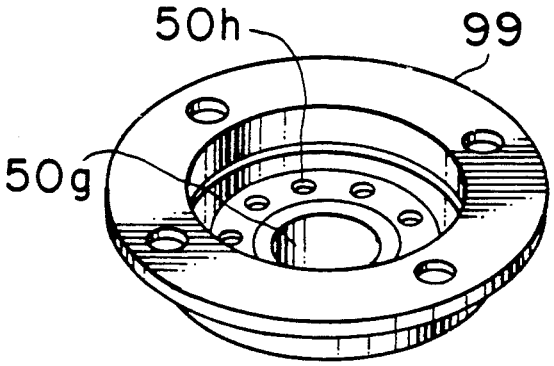

Also, in the above embodiment, although the sliding gap between the lap support disk 18*c* of the revolving scroll 18 and the thrust bearing 20 is sealed only by the oil film of the lubricating oil, an annular ring 82, as proposed by the inventor in FIGS. 7 and 8 of the specification of Japanese Patent Application No. 63-159996, can be mounted on the back side of the wrap support disk 18*c*, thereby further enhancing the sealing effect at the gap between the sliding portions of the back-pressure chamber 39 and the outer peripheral space 37.

Next, the operation of the second embodiment will be described with reference to FIGS. 21 to 25.

The pressure of the motor chamber 6 in which the discharge cooling medium gas is filled with the lapse of time after the activation of the compressor gradually increases.

As in FIG. 5, the lubricating oil in the discharge chamber oil reservoir 34 at the bottom portion of the motor chamber 6 is drawn into the oil chamber 278*a* via the oil hole 238*a*, formed in the body frame 205, by the screw pumping action of the spiral oil grooves 241*a* and 241*b* formed in the drive shaft 204. At this time, the partition cap 101 guides the lubricating oil so that the lubricating oil can pass past the vicinity of the surface of the drive shaft 204 to flow into the oil chamber 278*a* and the spiral oil groove 241*b*. By doing so, when the lubricating oil flows from the oil hole 238*a* into the oil chamber 278*a*, the lubricating oil is drawn into the spiral oil groove 214*a* without being influenced by the centrifugal diffusion due to the high-speed rotation of the drive shaft 204, thereby performing a good screw pumping oil feed.

The lubricating oil, supplied to the oil chamber 278*b* by the pressure differential between the discharge chamber oil reservoir 34 and the back-pressure chamber 239 of the revolving scroll 218 and the screw pumping action of the spiral oil groove 241*b*, lubricates, during the flow thereof, the sliding surface of the revolving bearing 218*b*, and then flows into the back-pressure chamber 239 via the throttle passage 103, the annular groove 104 and the oil hole 105.

The lubricating oil in the oil chamber 278*a* of which pressure is generally equal to the pressure of the motor chamber 6 is decreased in pressure while passing through the throttle passage 103 and the oil hole 105, so that the interior of the back-pressure chamber 239 is in a medium pressure condition.

As in FIG. 1, the outer peripheral space 37 is communicated with the back-pressure chamber 239 via the oil groove 291, formed in the surface of the thrust bearing 220, only in that revolution angle range in which the compression chambers are at the intake step, and therefore the lubricating oil in the back-pressure chamber 239 is intermittently supplied to the outer peripheral space 37.

As in FIG. 5, thereafter, the lubricating oil is supplied to the compression chambers, and is again discharged, together with the compressed cooling medium gas, to the motor chamber 6.

The lubricating oil, supplied to the main bearing 212, the upper bearing 211 and the thrust bearing 213 by the screw pumping action of the spiral oil groove 241*a*, is again collected in the discharge chamber oil reservoir 34.

The other operations are similar to those of FIG. 5, and explanation is omitted.

Next, the operation of the third embodiment will be described with reference to FIGS. 26 to 28.

Simultaneously with the activation of the compressor, the lubricating oil in the discharge chamber oil reservoir 34 at the bottom portion of the motor chamber 6 is drawn into the oil chamber 378*a* via the oil hole 338*a*, formed in the body frame 305, by the screw pumping action of the spiral oil grooves 341*a* and 341*b*, formed in the drive shaft 304, and the trochoide pump device 106 provided at the lower end of the drive shaft 304. At this time, as in FIG. 17, the partition cap 101 guides the lubricating oil so that the lubricating oil can pass past the vicinity of the surface of the drive shaft 304 to flow into the oil chamber 378*a* and the spiral oil groove 341*b*, and when the lubricating oil flows from the oil hole 338*a* into the oil chamber 378*a*, the lubricating oil is drawn into the spiral oil groove 341*a* without being influenced by the centrifugal diffusion due to the high-speed rotation (e.g. not less than 6000 rpm) of the drive shaft 304, thereby performing a good screw pumping oil feed.

The lubricating oil, flowed into the intake hole 108 of the trochoide pump device 106 via the spiral oil groove 341*b* while lubricating the sliding surface of the revolving bearing 318*b*, is discharged to the oil groove 111, and then is supplied to the main bearing 312 via the oil hole 112 and the radial oil hole 113, and is discharged to the oil reservoir 72. The lubricating oil, discharged to the oil reservoir 72 via the spiral oil groove 341*a* while lubricating the main bearing 312, is combined with the lubricating oil discharged from the trochoide pump device 106, and part of this lubricating oil is decreased in pressure while passing through the oil hole 38*b*, and is intermittently supplied to the back-pressure chamber 339.

The remainder of the lubricating oil discharged to the oil reservoir 72 lubricates the upper bearing 311 and the thrust bearing portion 313, and thereafter is collected in the discharge chamber oil reservoir 34.

The pressure of the motor chamber 6 in which the discharge cooling gas medium is filled with the lapse of time after the activation of the compressor gradually increases, and the lubricating oil in the discharge chamber oil reservoir 34 is supplied to the back-pressure chamber 339 also by the pressure differential between the discharge chamber oil reservoir 34 and the back-pressure chamber 339 of the revolving scroll 318.

The oil supply from the back-pressure chamber 339 to the compression chambers, as well as the other operations, are similar to those of FIG. 17, and therefore explanation is omitted.

Figure 30:
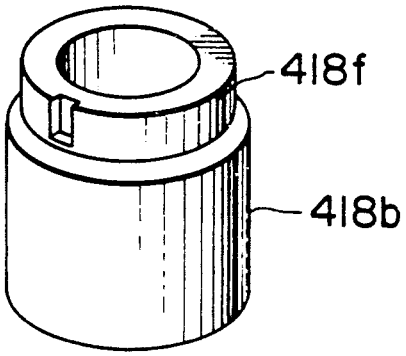
FIG. 30 is a perspective view of a bearing part in FIG. 29.

Next, the operation of the fourth embodiment will be described with reference to FIGS. 29 to 31.

Simultaneously with the activation of the compressor, the crankshaft 414 makes an eccentric rotational motion by the rotation of the drive shaft 404, and due to the rotation prevention mechanism of the Oldham's ring 24 which is allowed only to reciprocally move, the revolving scroll 418 revolves about the main axis of the drive shaft 404 without rotating.

In response to the revolution of the revolving bearing 418*b* fixed to the revolving scroll 418, the piston 115 in sliding engagement therewith revolves while rotating, and there is performed the intake and discharge operation of the known oil feed pump in which the distal end of the partition vane 117 is urged by the coil spring 116 into sliding contact with the piston 115.

The lubricating oil in the discharge chamber oil reservoir 34 is fed to the intake notch 114*a* via the oil hole 438*a* formed in the body frame 405, and is discharged to the groove 119 of the side plate case 118 via the pump chamber, and then is fed from the oil chamber 478*a* to the oil chamber B 478*b* and the axial oil hole 112*a*, formed in the drive shaft 404, with the aid of the screw pumping action (the viscosity pumping action) of the spiral oil groove 441*b*, while lubricating the sliding surface of the revolving bearing 414, and lubricates the sliding surface of the main bearing 412.

Also, the lubricating oil, drawn into the spiral oil groove 441*a* by the rolling piston-type oil feed pump, is fed to the main bearing 412 by the screw pumping action, and is combined with the lubricating oil discharged from the axial oil hole 112, and then is discharged to the oil reservoir 72 (not shown), the upper bearing and the thrust bearing portion as in FIG. 26, and is reduced in pressure by the oil hole 438*a*, and is supplied to the back-pressure chamber 439, and lubricates each sliding portion at the initial stage of the activation of the compressor.

The open end of the oil hole B 438*b* opening to the back-pressure chamber 439 is intermittently opened and closed by the reciprocal movement of the Oldham's ring 24, and the continuous opening time becomes shorter with the increase of the rotational speed of the drive shaft 404, and therefore the resistance of flow into the back-pressure chamber 439 is increased. As a result, the amount of flow of the lubricating oil into the back-pressure chamber 439 is decreased.

After the pressure of the discharge cooling medium gas, acting on the discharge chamber oil reservoir 34 with the lapse of time after the activation of the compressor, increases, the lubricating oil in the discharge chamber oil reservoir 34 is supplied to the oil chamber 478*a* also by the pressure differential between it and the back-pressure chamber 439, and then is supplied to each sliding portion by the screw pumping action of the spiral oil grooves 441*a* and 441*b*.

By the oil feed means using the pressure differential oil feed, the capacity-type oil feed pump (the rolling piston-type oil feed pump device) and the viscosity pump (the screw pump) in combination, even if a small amount of gas is introduced into the lubricating oil, or if the oil feed ability of the capacity-type oil feed pump or the viscosity pump is lowered at the high-speed region, the feed of sufficient oil to the sliding portions is continued.

The other operations are similar to those of FIGS. 5, FIGS. 21 and FIG. 26, and therefore explanation is omitted.

Next, the operation of the fifth embodiment will be described with reference to FIGS. 32 to 34.

The piston 115*a*, having the projection 115*b* movably engaged in the notched groove 121 of the body frame 505, makes a swinging motion in response to the revolution of the revolving bearing 518*b* of the revolving scroll 518, thereby performing the intake and discharge operations. Since the gap is provided between the inner surface of the piston 115*a* and the smaller-diameter outer peripheral portion 518*f* of the revolving bearing 518*b*, the amount of movement of the piston 115*a* is smaller than an amount twice the amount of eccentricity of the crankshaft 514. Depending on this gap dimension, the displacement amount of the revolving cylindrical piston-type oil feed pump is determined. In this embodiment, the amount of movement of the piston 115*a* is determined to correspond to the amount of eccentricity of the crankshaft 514, and the limitation of the input at the time of the high-speed operation as well as the assurance of the oil supply amount is expected.

Simultaneously with the activation of the compressor, the lubricating oil in the discharge chamber oil reservoir 34 is drawn into the intake hole 114 of the side plate 114*b* via the oil hole 538*a*, and then is discharged from the groove 115*c* of the piston 115*a*, and is fed to the oil chamber 578*a*.

The lubricating oil in the oil chamber 578*a* is supplied to the revolving bearing 518*b* and the main bearing 512 by the screw pumping action of the spiral oil groove 541*b*, and is used for lubricating each sliding surface.

The operation thereafter is the same as described above, and explanation is omitted.

Figure 36:
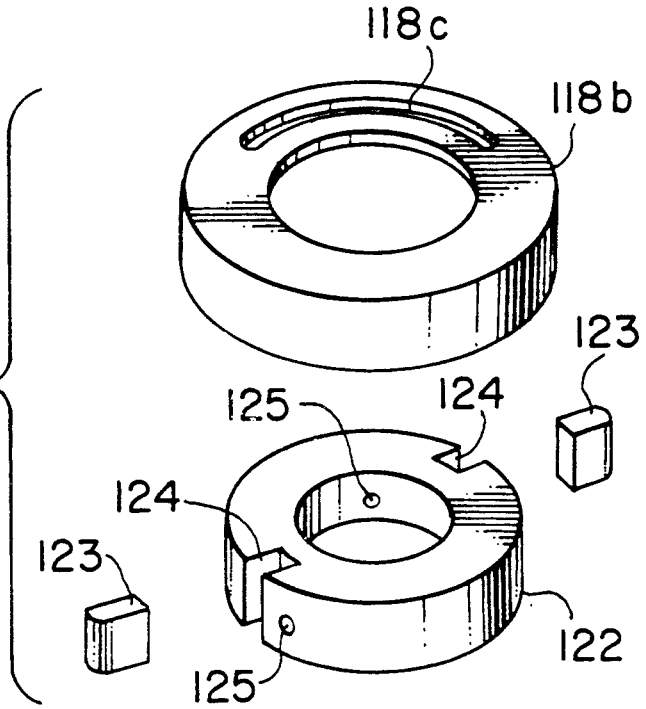
FIG. 36 is a perspective view of component parts of an oil feed pump device of the above compressor.

Next, the operation of the sixth embodiment will be described with reference to FIGS. 35 and 36.

Simultaneously with the activation of the compressor, the rotor 122 fixed to the drive shaft 604 is rotated, and the vanes 123 slidably mounted on the rotor 122 are subjected to their own centrifugal force, so that these vanes are moved to the outer peripheral portion of the rotor 123 to divide the pump chamber, thereby performing the known intake and discharge operations.

The lubricating oil in the discharge chamber oil reservoir 34 is drawn from the intake hole 118*c* of the side plate 118*b*, and is discharged to the oil chamber 678*a* via the discharge holes 125.

When the drive shaft 604 rotates at high speed so that the pressure of the pump chamber becomes higher than the predetermined pressure, the force of the lubricating oil applied from the pump chamber to the distal ends of the vanes 123 becomes greater than the centrifugal force of the vanes 123. As a result, the vanes 123 are retracted to increase the gap of the pump chamber to control the pumping oil feed ability.

Also, at the time of the very low-speed operation, the centrifugal force of the vanes 123 is small, and therefore the definition of the pump chamber is insufficient, and the pumping oil feed action is restrained. As a result, at the initial stage of the activation of the compressor in the cooled condition, the liquid cooling medium residing at the bottom portion of the discharge chamber oil reservoir 34 will not be supplied to the sliding portions of the bearings.

The liquid cooling medium, residing in the discharge chamber oil reservoir 34 with the lapse of time after the activation of the compressor, is separated from the lubricating oil, while being foamed, and moves to the upper portion of the motor chamber 6, and then the oil feed pumping action is sufficiently achieved in the normal operating speed region of the compressor, and the lubricating oil containing no cooling medium is supplied to each sliding portion.

The other operations are similar to those of FIG. 28, and therefore explanation is omitted.

Next, the seventh embodiment will be described with reference to FIG. 37.

By the rotation of the drive shaft 704, the intake cooling medium gas flows into the accumulator chamber 746 via the intake pipe 47, and then is suctioned and compressed, and the discharge cooling medium gas flows into the oil separation chamber 128 via the discharge chamber 2, the gas passage 780*b*, the gas passage 780*a* and the discharge by-pass pipe 127.

The discharge cooling medium gas, flowed into the oil separation chamber 128, separates part of the lubricating oil therefrom when impinging upon the upper frame 126, and then passes through the gas hole 129 and the upper space of the motor chamber 706 to cool the motor 703 while separating part of the lubricating oil therefrom, and then is discharged from the discharge pipe 731 provided outside the lower motor coil end 130.

The lubricating oil, separated from the discharge cooling medium gas at the oil separation chamber 128, passes through the spiral oil groove 741*d*, formed in the upper end shaft 704*d* of the drive shaft 704, to lubricate the bearing sliding surface, and then flows into the motor chamber 706, and is collected in the lower discharge chamber oil reservoir 734.

As the pressure of the motor chamber 706 increases with the lapse of time after the activation of the compressor, the lubricating oil in the discharge chamber oil reservoir 34 is drawn into the oil chamber 778*a* via the oil hole 738*a*, formed in the body frame 705, by the pressure differential between it and the back-pressure chamber 739 and the pumping action of the spiral oil grooves 741*a* and 741*b* formed in the drive shaft 704, and then is supplied to the main bearing 712 and the oil chamber B 778*b*.

The lubricating oil in the oil chamber 778*b* receives the centrifugal pumping oil feed action via the axial oil hole 112, and is supplied to the main bearing 712, and then is combined with the lubricating oil passed through the spiral oil groove 741*a*, and is discharged to the oil reservoir 772.

Further, the lubricating oil, after lubricating the thrust bearing portion 713, is collected in the discharge chamber oil reservoir 734, and is decreased in pressure in the throttle passage portion of the oil hole 738*b*, and is intermittently supplied to the back-pressure chamber 739.

By the oil film of the lubricating oil supplied to the thrust bearing portion 713, a gas seal is provided between the oil reservoir 772 and the motor chamber 706, and therefore the cooling medium gas in the motor chamber 706 will not flow directly into the back-pressure chamber 739.

Also, the release gap (see FIG. 14), which is provided at the back side of the thrust bearing 20 and is communicated with the compression chambers at the final compression step, is communicated via the throttle passage in the screw gaps of the bolt 710 provided in the path of the communication. Therefore, the compressed cooling medium gas at the initial stage of the activation is introduced in a pressure-decreased condition into the release gap. As a result, the gas pressure in the release gap is low immediately after the activation of the compressor, but increases with the lapse of time after the activation, and its gas back pressure urges the thrust bearing 20 against the fixed scroll 715.

The rotor 703*a*, provided between the thrust bearing portion 713 of the body frame 705 and the upper frame 126, is limited in its axial movement by selecting the axial dimension of the upper balance weight 775 and the lower balance weight 776.

The lower balance weight 776 is held in contact with the thrust bearing portion 776 to support the weights of the drive shaft 704 and the rotor 703*a*.

The axial movement of the drive shaft 704 and the rotor 703*a* takes place when the jumping phenomenon, due to incomplete flatness of the sliding surfaces, occurs during the high-speed sliding contact of the lower balance weight 776 with the thrust bearing portion 713; however, as described above, this axial movement is limited, and therefore this movement is very small.

The other operations are similar to those of FIG. 5, and therefore explanation is omitted.

Next, the operation of the eighth embodiment will be described with reference to FIG. 38.

The cooling medium gas, drawn via the intake pipe 47, is compressed at the compression chambers, and then passes through the check valve chamber 50*a*, the discharge chamber 2, the pass passage 880*b*, the gas passage 880*b*, the discharge chamber 2*b*, the motor chamber 806, the gas hole 129 and the oil separation chamber 128*a* to cool the motor 703, and is discharged to the external refrigerating cycle via the upper discharge pipe 831. The lubricating oil, contained in this discharge cooling medium gas, is subjected to the primary separation at the motor chamber 806, and is subjected to the secondary separation at the oil separation chamber 128*a*, and then this lubricating oil is collected in the central bottom portion of the upper frame 126 supporting the upper end of the drive shaft 704, and then lubricates the bearing sliding surface, and is returned to the motor chamber 706.

The oil supply to the main bearing 812 of the body frame 805, the thrust bearing portion, the back-pressure chamber 839, the revolving bearing and etc., is the same as in FIG. 37.

The back side of the thrust bearing 220 is directly communicated with the discharge chamber oil reservoir 34, and the urging force for urging the thrust bearing 220 toward the fixed scroll 815 depends on the pressure of the lubricating oil in the discharge chamber oil reservoir 34, the coil springs 131 and the seal ring 70*a*. Therefore, at the initial stage of the activation of the compressor in the cooled condition when the pressure of the motor chamber 806 is low, the force supporting the thrust bearing 220 is small, and when the revolving scroll 818 is retracted toward the thrust bearing 220 by the pressure of the compression chambers developing at the time of the activation of the compressor, the thrust bearing 220 can not support this load, and is retracted in a direction to narrow the release gap to increase the axial gap of the compression chambers to abruptly decrease the pressure of the compression chambers, thereby reducing the compression load at the initial stage of the activation.

A very small gas is provided between the body frame 805 and the outer surface of the thrust bearing 220 so as to allow the thrust bearing 220 to move in the axial direction, and the lubricating oil in the discharge chamber oil reservoir 34 flows into this gap.

This lubricating oil flows into the outer peripheral space 37 when as a result of the development of the liquid compression in the compression chambers, the revolving scroll 818 is retracted toward the thrust bearing 220, with the thrust bearing 220 also retracted, so that the gap is formed between the thrust bearing 220 and the fixed scroll 815. As a result, the pressure of the back-pressure chamber 839 communicated with the outer peripheral space 37 is quickly increased so as to again urge the revolving scroll 818 toward the fixed scroll 815.

Also, in the condition in which the check valve device closes the discharge port, immediately before the activation of the compressor, the energizing circuit of the motor 703 which is subjected to a variable-speed control by the DC power source is switched so as to cause the motor 703 to make two or three reverse rotations at a very low speed, thereby discharging the liquid cooling medium and the lubricating oil in the compression chambers to the accumulator chamber 846, and then the motor 703 is rotated in the normal direction. By doing so, the liquid compression at the initial stage of the activation of the compressor can be reduced or avoided.

Also, even when the compressor is activated in a reversely-rotated manner in the condition in which the check valve device does not close the discharge port, by increasing the reverse speed a little, the check valve device closes the discharge port in response to the reverse flow of the fluid from the discharge port to the compression chambers, and therefore if the normal rotation-activation is started in a short time after the stop of the reverse-rotation operation, the activation load can be reduced.

The other operations are similar to those of FIG. 5 and FIG. 37, and therefore explanation is omitted.

Next, the operation of the ninth embodiment will be described with reference to FIG. 39.

The lubricating oil, which flows from the discharge chamber oil reservoir 34 into the back-pressure chamber 939 via the bearing sliding portion supporting the drive shaft 4 and the bearing connecting portion between the revolving scroll 918 and the drive shaft 4, urges the revolving scroll 918 toward the fixed scroll 915 by the back pressure, and also flows in a pressure-reduced manner into the outer peripheral space 37 via the oil groove 291, formed in the thrust bearing 220, while the second compression chambers 51*a* and 51*b* are in communication with the intake chamber 17.

The lubricating oil, flowed into the outer peripheral space 37, lubricates the sliding surfaces between the wrap support disk 918*c* of the revolving scroll 918 and the thrust bearing 220 and the sliding surfaces between the wrap support disk 918*c* and the mirror plate sliding surface 915*b*2 of the fixed scroll 915, and then flows into the oil hole 938*c* and the injection holes 952 to be decreased in pressure while the second compression chambers 51*a* and 51*b* are in communication with the intake chamber 17, and then flows into the compression chambers to seal the gap of the compression chambers by its oil film, and is mixed into the compressed gas and is discharged again to the discharge chamber 2.

When the pressure of the compression chambers temporarily increases abnormally due, for example, to the development of the liquid compression in the compression chamber, the compressed gas tends to reversely flow, together with the lubricating oil flowing halfway through the passage, to the outer peripheral space via the injection holes 952 and the oil hole 938*c*; however, the pressure is damped by the viscosity resistance of the lubricating oil residing in the oil reservoir passage 938*e* and the flow resistance of the throttle passage 938*d*, and also the end of the oil hole 938*c* is closed by the wrap support disk 918*c*, and the reverse flow to the outer peripheral space 37 is prevented.

Also, during this compression step, the outer peripheral space 37 is isolated from the back-pressure chamber 939 by the wrap support disk 918*c*.

The other operations are similar to those of the first and second embodiments, and therefore explanation is omitted.

Next, the operation of the tenth embodiment will be described with reference to FIG. 40.

Due to the pressure differential between the discharge chamber oil reservoir 2034, on which the discharge pressure acts, and the compression chambers, the lubricating oil in the discharge chamber oil reservoir 2034 flows into the compression chambers through the following differential pressure path, and during the flow through this path, the lubricating oil is used to provide the lubrication of the sliding portions, the back-pressure urging for urging the revolving scroll 2018 toward the fixed scroll 2015, and the oil film seal for preventing the gas leakage through the gap between the sliding portions.

Namely, the lubricating oil in the discharge chamber oil reservoir 2034 flows into the oil chamber 2078*a* via the oil intake passage 2038 formed in the body frame 2005 and the fixed scroll 2015.

The lubricating oil in the oil chamber 2078*a* is supplied to the main bearing 2012 and the upper bearing 2011 by the spiral groove formed in the drive shaft 2004, and also is subjected to a primary pressure reduction through the bearing gap between the crankshaft 2014 and the revolving bearing 2018*b*, and flows into the oil chamber 2078*b*, and is subjected to a secondary pressure reduction through the narrow hole 2014, and then flows into the back-pressure chamber 2039.

The open ends of the narrow holes 2040 (which are provided at the two portions of the revolving boss 2018*e*) opening to the back-pressure chamber 2039 are disposed near the key grooves 2071*a* of the sliding contact portion between the Oldham's ring 2024 and the body frame 2005, and the lubricating oil forced from the oil chamber 2078*b* into the back-pressure chamber 2039 forcibly lubricates the sliding surfaces of the key grooves 2071*a*.

The lubricating oil in the back-pressure chamber 2039 passes through the two key grooves 2071, formed in the revolving scroll 2018, and the two shallow grooves 291 formed in the thrust bearing 220, and lubricates the sliding surfaces of the key grooves 2071 at the phase angle of 180°, and intermittently flows from the opposite positions into the outer peripheral space 2037 while being subjected to a third pressure reduction.

The path of flow of the lubricating oil from the outer peripheral space 2037 into the compression chambers is the same as in the first and second embodiments.

Due to the pressure differential between the oil chamber 2078*a* and the oil chamber 2078*b*, the drive shaft 2004 is abutted against the end face of the revolving boss 2018*e* of the revolving scroll 2018, and is slidably supported thereby.

The upper end of the spiral oil groove formed in the drive shaft 2004 is not open to the upper end of the upper bearing 2011, and the bearing gap of the upper bearing 2011 is sealed by the oil film of the lubricating oil residing in the bearing gap of the upper bearing 2011, and the discharge cooling medium gas will not flow into the bearing and the back-pressure chamber 2039.

The surface of connection between the fixed scroll 2015 and the body frame 2005 is surrounded, outside thereof, by the lubricating oil in the discharge chamber oil reservoir 2034, and the oil film confined in this connecting surface prevents the high-pressure side cooling medium gas from flowing into the outer peripheral space 2037 through this connecting surface, and therefore the high-pressure cooling medium gas will not flow into the outer peripheral space 2037.

The cooling medium gas, flowed into the intake chamber 17 via the intake pipe 2047, is compressed, and then is discharged to the discharge chamber 2, and is discharged to the discharge chamber 2002*b* via the two discharge passages 2080 provided at the symmetrical positions, and then is fed to the external refrigerating cycle via the motor chamber 2006 and the discharge pipe 2031.

Incidentally, the pressure pulsations and discharge sounds of the discharge cooling medium gas discharged to the discharge chamber 2002*b* from the two symmetrically-positioned discharge passages 2080 interfere with each other to be damped, and thereafter similarly the gas is discharged equally from the discharge chamber 2002*b* to the motor chamber 2006, so that the pressure pulsations are reduced. As a result, the pressure pulsation of the motor chamber 2006 leading to the external piping system is damped to such a level as not to influence the vibration of the external piping system.

Also, the discharge sound, generated when the compressed cooling medium gas is discharged from the compression chambers to the discharge chamber 2, is blocked by the lubricating oil of the discharge chamber oil reservoir 2034 surrounding the compression chambers and the discharge chamber 2, and is hardly propagated to the exterior of the sealed case 2001.

Also, the discharge sound, generated when the compressed cooling medium gas is discharged from the compression chambers to the discharge chamber 2, increases in accordance with the operation speed of the compressor; however, when the operation speed of the compressor is in the normal operating region (for example, not more than 5000 rpm), there may be used an arrangement in which the discharge chamber 2002*b* is omitted, the two symmetrically-positioned discharge passages 2080 are extended (for example, discharge passages or discharge pipes are provided) so as to discharge the gas directly to the motor chamber 2006. In this case, the greater the distance between the openings of the extended ends of the two symmetrically-positioned discharge passages is, the more the discharge sound and the pressure pulsation are damped by the interference action.

Although the above 1st to 10th embodiments have been described, these embodiments can be suitably combined depending on the operating conditions of the compressor.

(1) As described above, according to the above embodiments, there are provided the main bearing 12 which supports the drive shaft 4, and is provided on the body frame 5, and is disposed close to the revolving scroll 18, and the revolving bearing 18*b* which slidably connects the drive shaft 4 and the revolving scroll 18 together so as to impart a revolving motion to the revolving scroll 18. There is provided the bearing oil supply passage which after lubricating oil in the discharge chamber oil reservoir 34 subjected to the discharge pressure is supplied to the main bearing 12 and the revolving bearing 18*b* by the viscosity pump operated by the rotation of the drive shaft 4, returns the lubricating oil again to the discharge chamber oil reservoir 34. There is provided the oil injection passage having the throttle passage which supplies part of the lubricating oil, supplied to at least one of the bearings (the main bearing 12 or the revolving bearing 18*b*), sequentially to the back-pressure chamber 39, provided at that side of the revolving scroll 18 directed away from the compression chambers, and the compression chambers 51*a* and 51*b*. With this arrangement, the lubricating oil in the discharge chamber oil reservoir 34 is drawn by the viscosity pump operated by the rotation of the drive shaft 4, so that a necessary amount of the oil is supplied to the main bearing 12, supporting the drive shaft 4 and disposed close to the revolving scroll 18, and the revolving bearing 18 slidably connecting the drive shaft 4 and the revolving scroll 18 together, thereby lubricating the bearing sliding surfaces supporting most of the compression load so as to reduce wear and a frictional resistance.

Also, without limiting the amount of supply of the oil to the main bearing 12 or the revolving bearing 18*b*, part of the lubrication supplied to at least one bearing is effectively used to be supplied to the back-pressure chamber 39, and thereafter the oil is decreased in pressure during the flow through the oil injection passage, so that a proper amount of the oil can be supplied to the second compression chambers 51*a* and 51*b*. By doing so, the sliding surfaces of the compression chambers can be lubricated and cooled without lowering the intake efficiency.

Also, the gap of the compression chambers is sealed by its oil film so as to prevent the leakage of the compressed gas, and besides an impingement sound and vibrations, produced when the revolving scroll 18 impinges on the fixed scroll 15, can be reduced.

Also, the lubricating oil supplied to the back-pressure chamber 39 lubricates the sliding portions at the interior and surroundings thereof, and its pressure urges the revolving scroll 18 toward the fixed scroll 15 to keep the axial gap of the compression chamber to a minimum, thereby reducing the leakage of the compressed fluid to enhance the compression efficiency.

(2) Also, according to the above embodiments, there is provided the oil feed passage which leads to the second compression chambers 51*a* and 51*b* sequentially via the discharge chamber oil reservoir 34, subjected to the discharge pressure, and the back-pressure chamber 39 provided at that side of the revolving scroll 18 directed away from the compression chambers. There is provided means for intermittently opening and closing the flow inlet to the back-pressure chamber 39 and the communication passage between the back-pressure chamber 39 and the second compression chambers 51*a* and 51*b* in associated relation to the revolution of the revolving scroll 18. With this arrangement, when by the pressure differential between the discharge chamber oil reservoir 34 and the second compression chambers 51*a* and 51*b*, the lubricating oil in the discharge chamber oil reservoir 34 is supplied sequentially to the back-pressure chamber 39 of the revolving scroll 18 and the second compression chambers 51*a* and 51*b*, the pressure can be reduced by the resistance produced when intermittently opening and closing the passage between the flow inlet of the back-pressure chamber 39 and the second compression chambers 51*a* and 51*b*. This passage resistance increases with the increase of the operation speed of the compressor, and therefore during the high-speed operation of the compressor when the compression time is short, and the amount of leakage of the gas per intake gas volume during the compression is small, so that a large amount of injection of the lubricating oil into the compression chambers is not needed, the amount of supply of the oil to the compression chambers is restrained, thereby preventing the input increase due to the compression of a large amount of the lubricating oil.

Also, during the high-speed operation of the compressor when, since the pressure of the compression chambers is lowered due to the lowered intake pressure, it is necessary to reduce the frictional loss between the revolving scroll 18 and the fixed scroll 15 by reducing the back-pressure urging force urging the revolving scroll 18 toward the fixed scroll 15, the passage resistance at the flow inlet portion of the back-pressure chamber 39 is increased, and the pressure of the back-pressure chamber is decreased so as to properly control the back-pressure urging force on the revolving scroll 18, thereby enhancing the compression efficiency and the durability of the sliding portions.

(3) Also, according to the above embodiments, there are provided the discharge chamber oil reservoir 34 subjected to the discharge pressure, the main bearing 12 which is provided on the body frame 5 and supports the drive shaft 4, and the back-pressure chamber 39 provided at that side of the revolving scroll 18 directed away from the compression chambers. There is provided the pressure differential oil feed passage passing sequentially via the discharge chamber oil reservoir 34, the main bearing 12, the back-pressure chamber 39 and the compression chambers (or the intake chamber). The open portion of the passage communicating from the main bearing 12 to the back-pressure chamber 39 which open portion is open to the back-pressure chamber is intermittently opened and closed by the reciprocal movement of the sliding surface of the Oldham's ring 24. With this arrangement, when the lubricating oil in the discharge chamber oil reservoir 34 subjected to the discharge pressure is to be flowed by the pressure differential oil feed into the back-pressure chamber 39 of the revolving scroll 18, the oil can be forcibly fed to the sliding surface of the Oldham's ring 24 in contact with the body frame 5. The oil film is filled in this sliding gap so as to reduce the substantial sliding gap, and also to reduce the impingement of the Oldham's ring upon the revolving scroll 18 or the body frame 15 when this ring is reversely moved, so that vibrations and noises can be prevented from being generated from the Oldham's ring 24.

(4) Also, according to the above embodiments, there are provided the discharge chamber oil reservoir 34 subjected to the discharge pressure, the main bearing 12 which is provided on the body frame 5 and supports the drive shaft 4, and the back-pressure chamber 39 provided at that side of the revolving scroll 18 directed away from the compression chambers. There is provided the pressure differential oil feed passage passing sequentially via the discharge chamber oil reservoir 34, the main bearing 12, the back-pressure chamber 39 and the compression chambers (or the intake chamber). The open portion of the passage communicating from the main bearing 12 to the back-pressure chamber 39 which open portion is open to the back-pressure chamber is intermittently opened and closed by the reciprocal movement of the sliding surface of the key portion of the Oldham's ring 24 engaged with the body frame 5. With this arrangement, when the lubricating oil in the discharge chamber oil reservoir 34 subjected to the discharge pressure is to be flowed by the pressure differential oil feed into the back-pressure chamber 39 of the revolving scroll 18, the key portion by which the Oldham's ring 24 is slidably engaged with the body frame 5 is forcibly lubricated, thereby reducing the wear of the key portion.

By doing so, the backlash in the direction of rotation of the Oldham's ring 24 can be reduced, and the relative angle of engagement between the revolving scroll 18 and the fixed scroll 15 is always kept constant, and the gap in the radial direction of the compression chambers is prevented from being biased to be increased, and the impingement between the laps of the revolving scroll 18 and the fixed scroll 15 is prevented, and the high compression efficiency can be maintained, and the low-noise/low-vibration design can be achieved.

(5) Also, according to the above embodiments, there is provided the pressure differential oil feed passage which passes sequentially via the back-pressure chamber 39 provided at that side of the revolving scroll 18 directed away from the compression chambers, the thrust bearing 20 which supports that side of the wrap support disk 18*c* of the revolving scroll 18 directed away from the compression chambers and is disposed outside the back-pressure chamber 39, the outer peripheral space 37 provided outside the wrap support disk 18*c* so that the wrap support disk 18*c* of the revolving scroll 18 can be in sliding contact with the mirror plate 15*b* of the fixed scroll 15 at the outer portion of the intake chamber 17, and the compression chambers. The throttle passage (oil hole 91) is provided between the back-pressure chamber 39 and the outer peripheral space 37. The throttle passage (oil hole 91) is intermittently opened and closed by the revolution of the wrap support disk 18*c*. With this arrangement, the lubricating oil in the discharge chamber oil reservoir 34 subjected to the discharge pressure is reduced to a medium pressure, and is caused to flow into the back-pressure chamber 39 of the revolving scroll 18, and then is further caused to flow via the throttle passage into the outer peripheral space 37 at the outer peripheral portion of the wrap support disk 18*c* supporting the volute-like wrap of the revolving scroll 18, and by intermittently opening and closing its passage, the oil feed under a reduced pressure can be carried out. As a result, the pressure differential between the outer peripheral space 37 and the intake chamber 17 is reduced, so that the lubricating oil in the outer peripheral space is prevented from leaking into the intake chamber 17, thereby preventing the intake efficiency of the intake cooling medium gas from being lowered.

(6) Also, according to the above embodiments, there is provided the main bearing 12 which leads to the discharge chamber oil reservoir 34 subjected to the discharge pressure, and is provided on the body frame 5, and supports the drive shaft 4. The annular ring 94, which separates the high-pressure lubricating oil space (oil chamber 78*a*) of the main bearing 12 leading to the discharge chamber oil reservoir 34 from the back-pressure chamber 39 provided at that side of the revolving scroll 18 directed away from the compression chambers and disposed outside the high-pressure lubricating oil space (oil chamber 78*a*), is provided between the body frame 5 and the revolving scroll 18. The annular ring 94 is movably received in the annular seal groove 95 in the revolving scroll 18 with a very small gap therebetween. There is provided the pressure differential oil feed passage passing sequentially via the discharge chamber oil reservoir 34, the main bearing 12, the back-pressure chamber 39 and the compression chambers (or the intake chamber). The open portion of the passage communicating from the main bearing 12 to the back-pressure chamber 39 which open portion is open to the back-pressure chamber is intermittently opened and closed by a revolving motion of the sliding surface of the annular ring 94. With this arrangement, when the lubricating oil in the discharge chamber oil reservoir 34 subjected to the discharge pressure is to be flowed into the back-pressure chamber 39 of the revolving scroll 18, the oil is forcibly fed to the sliding surface of the annular ring 94, and the oil film of this lubricating oil is filled in the sliding gap to reduce wear of the sliding surfaces of the body frame 5 and the annular ring 94, and the sealing durability of the annular ring can be enhanced. As a result, the flow of a large amount of the lubricating oil into the back-pressure chamber 39 is prevented to prevent an abnormal pressure increase of the back-pressure chamber 39, and the increase of the input and the lowering of the durability are prevented.

(7) Also, according to the above embodiments, there is provided the main bearing 12 which supports the drive shaft 4, and is provided on the body frame 5, and is disposed close to the revolving scroll 18, and also there is provided the revolving bearing 18*b* which slidably connects the drive shaft 4 and the revolving scroll 18 together so as to impart a revolving motion to the revolving scroll 18. There is provided the oil hole 38*a* communicating between the oil chamber 78*a*, provided between the main bearing 12 and the revolving bearing 18*b*, and the discharge chamber oil reservoir 34 subjected to the discharge pressure. The spiral oil grooves (41*a* and 41*b*) for producing a viscosity pumping action are formed respectively in the sliding surfaces of the above bearings (12 and 18*b*). There is provided the oil passage for communicating the suction side of each of the spiral oil grooves (41*a* and 41*b*) with the oil chamber 78*a* and for communicating the discharge side of each of the spiral oil grooves (41*a* and 41*b*) with the discharge chamber oil reservoir 34 and the second compression chambers 51*a* and 51*b*. With this arrangement, when the drive shaft 4 begins to rotate, by the viscosity pumping action of the spiral oil grooves 41*a* and 41*b* formed in the sliding surfaces of the main bearing 12 and the revolving bearing 18*b*, the lubricating oil in the discharge chamber oil reservoir 34 subjected to the discharge pressure can be simultaneously supplied equally to the revolving bearing 18*b*, slidably connecting the revolving scroll 18 and the drive shaft 4 together, and the main bearing 12 supporting that portion of the drive shaft 4 close to the revolving scroll 18. And, the bearing sliding surfaces, supporting all or most of the compression load, can be lubricated from the initial stage of the activation, and a smooth operation is obtained at the initial stage of the activation, and the durability of the bearing portions is enhanced, and the increase of the bearing gap is prevented, and the radial gap of the compression chambers is kept to a very small value, and the compression leakage is reduced, and the lowering of the compression efficiency can be prevented.

(8) Also, according to the above embodiments, there are provided the drive shaft 304 supported on the body frame 305, and the revolving bearing 318*b* which slidably connects the drive shaft 304 and the revolving scroll 318 together so as to impart a revolving motion to the revolving scroll 318. The trochoid pump device 106 is provided at that side of the revolving bearing 318*b* close to the compression chambers which device comprises the inner rotor 106*b* connected to the drive shaft 304 and the outer rotor 106*a* received in the revolving scroll 318. There is provided the oil feed passage which has the upstream side passing sequentially via the discharge chamber oil reservoir 34, subjected to the discharge pressure, and the revolving bearing 318*b*, and has the downstream side where the bearing sliding portion supporting the drive shaft 304 is provided. With this arrangement, there can be provided the inexpensive and space-saving oil feed pump in which simultaneously with the start of rotation of the drive shaft 304, the trochoid pump device 106 operates to draw the lubricating oil in the discharge chamber oil reservoir 34 so as to forcibly lubricate the sliding surface of the revolving bearing 318*b* slidably connecting the drive shaft 304 and the revolving scroll 318, and also to supply the oil to the bearing sliding portion supporting the drive shaft 304. By doing so, the excessive compression load at the initial stage of the activation is supported through the sufficient feed of the oil to the bearing from the initial stage of the activation, thereby enhancing the durability of the compressor.

(9) Also, according to the above embodiments, there are provided the drive shaft 404 supported on the body frame 405, and the revolving bearing portion 418*b* which slidably connects the drive shaft 404 and the revolving scroll 418 together so as to impart a revolving motion to the revolving scroll 418. There is provided the rolling piston-type oil feed pump device which has the annular piston 115 whose inner surface is intermittently contacted slidably with the smaller-diameter outer peripheral portion 418*f* of the sliding connection portion between the drive shaft 404 and the revolving scroll 418 outside thereof, so that the pumping action is performed by a swinging movement of the piston 115 effected in response to the revolving motion of the revolving scroll 418, the pump device being provided between the main bearing 412, which supports the drive shaft 404 and is provided on the body frame 405 close to the revolving scroll 418, and the sliding connection portion. There is provided the oil feed passage communicating between the discharge chamber oil reservoir 34, subjected to the discharge pressure, and the bearing sliding portion related to the drive shaft 404. The rolling piston-type oil feed pump device is provided halfway in this oil feed passage. With this arrangement, there can be provided the oil feed pump in which since the smaller-diameter outer peripheral portion 418*f* of the sliding connection portion, which revolves with the revolving scroll 418 and is the drive side, is intermittently brought into sliding contact with the inner surface of the piston 115 which is the driven side, the sliding speed is low, and the high durability of the pump is achieved. Therefore, the durability of the bearing is enhanced.

Also, by the intermittent movement of the piston, the pump ability can be reduced, and the excessive pump input is not needed, and the parts constituting the pump can be reduced in size, thereby enabling the use of the space-saving oil feed pump.

As a result, the main bearing 412 can be disposed close to the revolving scroll 418 to reduce the compression load acting on the main bearing, and the durability of the bearing can be enhanced, and the input loss can be reduced.

(10) Also, according to the above embodiments, there is provided the main bearing 412 which supports the drive shaft 404, and is provided on the body frame 405, and is disposed close to the revolving scroll 418, and also there is provided the revolving bearing 418*b* which slidably connects the drive shaft 404 and the revolving scroll 418 together so as to impart a revolving motion to the revolving scroll 418. The capacity-type oil feed pump device (rolling piston-type oil feed pump device), operated by the rotational motion of the drive shaft 404, is provided between the main bearing 412 and the revolving bearing 418*b*. There is provided the oil feed passage passing sequentially via the discharge chamber oil reservoir 34 subjected to the discharge pressure, the capacity-type oil feed pump device, the main bearing 412, the revolving bearing 418, the back-pressure chamber 439 provided at that side of the revolving scroll 418 directed away from the compression chambers, and the compression chambers. With this arrangement, simultaneously with the activation of the compressor, the lubricating oil in the discharge chamber oil reservoir 34 subjected to the discharge pressure is supplied to the bearing sliding portion to support the compression pressure, thereby starting the smooth compression operation.

Also, by the sequential supply via the back-pressure chamber 439 of the revolving scroll 418 and the compression chambers, the increasing of the pressure of the back-pressure chamber 439 as well as the oil supply to the sliding portion can be achieved, and therefore immediately after the activation, the revolving scroll 418 can be urged toward the fixed scroll 415, and the gap of the compression chambers is sealed by the oil film of the lubricating oil so as to reduce the compression leakage, and the compression efficiency can be enhanced from the initial stage of the activation, and the durability of the sliding portion can be enhanced.

Also, by providing the oil film in the gap of the sliding portion at the initial stage of the activation, the reduction of its substantial gap and the damping effect of the oil film reduce the impingement of the movable members caused due to the unstable operation at the initial stage of the activation, thereby preventing the generation of noises and vibrations.

(11) Also, according to the above embodiments, there are provided the drive shaft 504 supported on the body frame 505, and the revolving bearing portion 518*b* which slidably connects the drive shaft 504 and the revolving scroll 518 together so as to impart a revolving motion to the revolving scroll 518. There is provided the revolving cylindrical piston-type oil feed pump device which has the annular piston 115*a* whose inner surface 115*d* is slidably contacted with the outer peripheral portion (the smaller-diameter outer peripheral portion 518*f* of the revolving bearing 518*b*) of the sliding connection portion between the drive shaft 504 and the revolving scroll 518 outside thereof, and the projection 115*b* on part of the outer peripheral portion of the piston 115*a* is movably engaged in the notched groove 121 in the body frame 505, so that a pumping action is performed by a swinging movement of the piston 115*a* effected in response to the revolving motion of the revolving scroll 518, the pump device is provided between the main bearing 512, which supports the drive shaft 504 and is provided on the body frame 505 close to the revolving scroll 518, and the sliding connection portion. There is provided the oil feed passage communicating between the discharge chamber oil reservoir 34, subjected to the discharge pressure, and the bearing sliding portion related to the drive shaft 504. The revolving cylindrical piston-type oil feed pump device is provided halfway in this oil feed passage. With this arrangement, there can be achieved the small-capacity and small-input pump mechanism in a space-saving manner, in which the swinging movement of the piston 115*a* of the oil feed pump device which is smaller than the diameter of revolution of the revolving scroll 518 is applied from inside the piston 115*a*. As a result, even during the high-speed operation, the input loss can be reduced, and the scroll compression mechanism portion can be reduced in size to reduce the distance between the compression chambers and the main bearing 512, and the compression load on the main bearing 512 supporting the drive shaft 504 can be reduced, and the bearing durability can be enhanced at the same time.

(12) Also, according to the above embodiments, there are provided the main bearing 612 which is provided on the body frame 605 supporting the drive shaft 604 and is disposed close to the revolving scroll 618, and the revolving bearing portion 618*b* which slidably connects the drive shaft 604 and the revolving scroll 618 together so as to impart a revolving motion to the revolving scroll 618. The slide vane-type oil feed pump device is provided between the main bearing 612 and the revolving scroll 618, the pump device comprising the rotor 122 rotatable coaxially with the drive shaft 604, and the vane 123 movable back and forth in the vane groove 124, formed in the rotor 122, so as to dividingly seal the interior of the pump chamber. There is provided the oil feed passage communicating between the discharge chamber oil reservoir 34 subjected to the discharge pressure and the bearing sliding potions of the main bearing 612 and the revolving bearing 618*b*. The slide vane-type oil feed pump device is provided halfway in this oil feed passage. The back-pressure urging force of the vane 123 depends only on a centrifugal force based on the weight of the vane. With this arrangement, during the low-speed operation immediately after the activation of the compressor in the cooled condition, the centrifugal force of the vane of the slide vane-type oil feed pump device is small, and therefore the sealing separation between the intake side and discharge side of the pump chamber is made incomplete to thereby interrupt the substantial pumping action to stop the supply of the liquid cooling medium (which is not evaporated from the lubricating oil and is introduced into the discharge chamber oil reservoir) to the bearing, thereby preventing the lubricating oil, residing on the bearing sliding surface, from flowing therefrom, and the bearing durability can be enhanced.

Also, in the normal operating speed region of the compressor in which the evaporation of the liquid cooling medium from the lubricating oil in the discharge chamber oil reservoir 34 has been completed, an efficient oil feed pumping can be carried out by the sealing division of the pump chamber by the vane 123 supplied with the sufficient centrifugal force.

Also, when an abnormal pressure develops in the pump chamber, the vane 123 is retracted against the centrifugal force of the vane 123 by the lubricating oil pressure acting on the distal end of the vane 123, so as to adjustably reduce the pressure of the pump chamber, and therefore the pump input can be reduced.

(13) Also, according to the above embodiments, there are provided the main bearing 12 and the upper bearing 11 which support the drive shaft 4 and are provided on the body frame 5, and the oil reservoir 72 provided between the upper bearing 11 and the main bearing 12. The back-pressure chamber 39 is provided outside the bearing (12) disposed at that side of the revolving scroll 18 directed away from the compression chambers. There is provided the pressure differential oil feed passage passing sequentially via the discharge chamber oil reservoir 34 subjected to the discharge pressure, the main bearing 12, the oil reservoir 72, the back-pressure chamber 39 and the compression chambers. The oil hole B 38*b* having the throttle passage is provided between the back-pressure chamber 39 and the oil reservoir 72. With this arrangement, after the lubricating oil in the discharge chamber oil reservoir 34 subjected to the discharge pressure is passed via the main bearing 12, supporting the drive shaft 4, and the oil reservoir 72 so as to be decreased in pressure, this oil is supplied by the pressure differential to the back-pressure chamber 39 of the revolving scroll 18, and therefore even if the lubricating oil in the discharge chamber oil reservoir 34 becomes insufficient temporarily, the lubricating oil stored in the oil reservoir 72 can be continuously supplied to the back-pressure chamber 39, and the abnormal pressure increase due to the flow of the gas into the back-pressure chamber 39 can be prevented, and the lowering of the compression efficiency as well as the lowering of the durability of the sliding portion can be prevented.

Also, during the stop of the compressor, by the provision of the lubricating oil in the oil reservoir 72, the cooling medium gas in the motor chamber 6 is prevented from flowing into the back-pressure chamber 39 via the oil hole B 38*b*, and therefore the lubricating oil in the back-pressure chamber 39 can be secured at the time of re-activation of the compressor, thereby enabling the smooth start of the compression operation.

Incidentally, by the pressure differential between the oil reservoir and the back-pressure chamber immediately after the stop of the compressor, the lubricating oil in the oil reservoir subjected to the discharge pressure flows into and fills in the oil reservoir via the bearing supporting the drive shaft.

(14) Also, according to the above embodiments, there is provided the pressure differential oil feed passage passing sequentially via the back-pressure chamber 939 provided at that side of the revolving scroll 918 directed away from the compression chambers, the thrust bearing 220 which supports that side of the lap support disk 918*c* of the revolving scroll 918 directed away from the compression chambers and is provided outside the back-pressure chamber 939 and is urged at its back surface by the compressed cooling medium gas fed from the compression chambers provided outside the back-pressure chamber 939, the outer peripheral space 37 which is provided outside the lap support disk 918*c* so that the lap support disk 918*c* of the revolving scroll 918 can be in sliding contact with the mirror plate 915*c* of the fixed scroll 915 at the outer portion of the intake chamber 17, and the oil passage which includes an oil hole 938*c*, having a throttle portion which opens to the sliding surface 915*b*2 of said mirror plate 915*b* disposed in sliding contact with the lap support disk 918*c* and is communicated with the outer peripheral space 37, and injection holes 952 of a small diameter. The discharge chamber oil reservoir 34 subjected to the discharge pressure is provided at the upstream side of this oil feed passage whereas the second compression chambers 51*a* and 51*b* intermittently communicated with the intake chamber 17 are provided at the downstream side thereof. The oil groove 291, communicating between the back-pressure chamber 939 and the outer peripheral space 37 and provided in the thrust bearing 220, and the communication end of the oil passage to the outer peripheral space 37 are provided in opposite relation to each other with respect to the center of the revolving scroll 918. With this arrangement, the lubricating oil, flowed from the discharge chamber oil reservoir 34 into the back-pressure chamber 939, flows into the outer peripheral space 37, and thereafter is divided toward both sides of the outer peripheral portion of the lap support disk 918*c* to flow through the entire region of the outer peripheral space 37, and then flows into the oil hole 938*c* formed in the mirror plate 915*c*. Therefore, the lubricating oil can be supplied to both sides of the lap support disk 918*c* over the entire region thereof, and the durability of the lap support disk 918*c* is enhanced, and further by the sealing effect of the oil film between the outer peripheral space 37 and the intake chamber 17, the lubricating oil will not flow from the outer peripheral space 37 into the intake chamber 17, thereby preventing the lowering of the intake efficiency.

Also, the oil film can be always provided on the sliding surface, and therefore the impingement between the lap support disk 918*c* and the mirror plate sliding surface 915*b*2, caused by a temporary tilting of the revolving scroll 918 due to the inertia force and the centrifugal force produced during the high-speed revolution of the revolving scroll 918, is reduced, thereby reducing vibrations and noises.

(Common) Incidentally, in the above embodiments, although as the general-purpose oil feed passage, the lubricating oil in the back-pressure chamber is caused to flow into the second compression chambers 51*a* and 51*b*, a special oil feed passage may be provided depending on the operation conditions of the compressor (the operation speed, the compression load, etc.). For example, a oil feed passage for flowing the oil into other compression chambers or the intake chamber 17 may be provided.

Also, in the above embodments, although the cooling medium compressors have been described, similar operation effects can be expected with a compressor for other gas, such as oxygen, nitrogen or helium, using lubricating oil, and a liquid pump such as a cooling medium pump.

Also, in the above embodiments, although the vertical type compressors are shown and explained with respect to the effects thereof, similar effects can be expected with horizontal type compressors.

INDUSTRIAL APPLICABILITY

As is clear from the above embodiments, according to the present invention, there is provided the main bearing which supports the drive shaft, and is provided on the stationary member fixing the fixed scroll, and is disposed close to the revolving scroll, and also there is provided the revolving bearing which slidably connects the drive shaft and the revolving scroll together so as to impart a revolving motion to the revolving scroll; there is provided the bearing oil supply passage which after the lubricating oil in the oil reservoir subjected to the discharge pressure is supplied to the main bearing and the revolving bearing by the feed pump operated by the rotation of the drive shaft, returns the lubricating oil again to the oil reservoir; and there is provided the oil injection passage having the throttle passage which supplies part of the lubricating oil, supplied to at least one of the bearings, sequentially to the back-pressure chamber, provided at that side of the revolving scroll directed away from the compression chambers, and the compression chambers. With this arrangement, the lubricating oil in the oil reservoir is drawn by the oil feed pump operated by the rotation of the drive shaft, so that a necessary amount of the oil is supplied to the main bearing, supporting the drive shaft and disposed close to the revolving scroll, and the revolving bearing slidably connecting the drive shaft and the revolving scroll together, thereby lubricating the bearing sliding surfaces supporting most of the compression load so as to reduce wear and a frictional resistance.

Also, without limiting the amount of supply of the oil to the main bearing or the revolving bearing, part of the lubrication supplied to at least one bearing is effectively used to be supplied to the back-pressure chamber, and thereafter the oil is decreased in pressure during the flow through the oil injection passage, so that a proper amount of the oil can be supplied to the compression chambers. By doing so, the slding surfaces of the compression chambers can be lubricated and cooled without lowering the intake efficiency.

Also, the gap of the compression chambers is sealed by its oil film so as to prevent the leakage of the compressed gas, and besides an impingement sound and vibrations, produced when the revolving scroll impinges on the fixed scroll, can be reduced.

Also, the lubricating oil supplied to the back-pressure chamber lubricates the sliding portions at the interior and surroundings thereof, and its pressure urges the revolving scroll toward the fixed scroll to keep the axial gap of the compression chamber to a minimum, thereby reducing the leakage of the compressed fluid to enhance the compression efficiency.

According to the second invention, there is provided the oil feed passage which leads to the compression chambers sequentially via the oil reservoir, subjected to the discharge pressure, and the back-pressure chamber provided at that side of the revolving scroll directed away from the compression chambers; and there is provided means for intermittently opening and closing the flow inlet to the back-pressure chamber and the communication passage between the back-pressure chamber and the compression chambers in associated relation to the revolution of the revolving scroll. With this arrangement, when by the pressure differential between the oil reservoir and the compression chambers, the lubricating oil in the oil reservoir is supplied sequentially to the back-pressure chamber of the revolving scroll and the compression chambers, the pressure can be reduced by the resistance produced when intermittently opening and closing the passage between the flow inlet of the back-pressure chamber and the compression chambers. This passage resistance increases with the increase of the operation speed of the compressor, and therefore during the high-speed operation of the compressor when the compression time is short, and the amount of leakage of the gas per intake gas volume during the compression is small, so that a large amount of injection of the lubricating oil into the compression chambers is not needed, the amount of supply of the oil to the compression chambers is restrained, thereby preventing the input increase due to the compression of a large amount of the lubricating oil.

Also, during the high-speed operation of the compressor when since the pressure of the compression chambers is lowered due to the lowered intake pressure, it is necessary to reduce the frictional loss between the revolving scroll and the fixed scroll by reducing the back-pressure urging force urging the revolving scroll toward the fixed scroll, the passage resistance at the flow inlet portion of the back-pressure chamber is increased, and the pressure of the back-pressure chamber is decreased so as to properly control the back-pressure urging force on the revolving scroll, thereby enhancing the compression efficiency and the durability of the sliding portions.

According to the seventh invention, there is provided the main bearing which supports the drive shaft, and is provided on the stationary member fixing the fixed scroll, and is disposed close to the revolving scroll, and also there is provided the revolving bearing which slidably connects the drive shaft and the revolving scroll together so as to impart a revolving motion to the revolving scroll; there is provided the oil suction passage communicating between the oil chamber, provided between the main bearing and the revolving bearing, and the oil reservoir subjected to the discharge pressure; the spiral oil groove for producing a viscosity pumping action is formed in the sliding surface of each of the bearings; and there is provided the oil passage for communicating the suction side of each of the spiral oil grooves with the oil chamber and for communicating the discharge side of each of the spiral oil grooves with the oil reservoir or the compression chambers. With this arrangement, when the drive shaft P53 begins to rotate, by the viscosity pumping action of the spiral oil grooves formed in the sliding surfaces of the main bearing and the revolving bearing, the lubricating oil in the oil reservoir subjected to the discharge pressure can be simultaneously supplied equally to the revolving bearing, slidably connecting the revolving scroll and the drive shaft together, and the main bearing supporting that portion of the drive shaft close to the revolving scroll. And, the bearing sliding surfaces, supporting all or most of the compression load, can be lubricated from the initial stage of the activation, and a smooth operation is obtained at the initial stage of the activation, and the durability of the bearing portions is enhanced, and the increase of the bearing gap is prevented, and the radial gap of the compression chambers is kept to a very small value, and the compression leakage is reduced, and the lowering of the compression efficiency can be prevented.

According to the eighth invention, there are provided the drive shaft supported on the stationary member supporting the fixed scroll, and the revolving bearing which slidably connects the drive shaft and the revolving scroll together so as to impart a revolving motion to the revolving scroll; the trochoide pump device is provided at that side of the revolving bearing close to the compression chambers which device comprises the inner rotor connected to the drive shaft and the outer rotor received in the revolving scroll; and there is provided the oil feed passage which has the upstream side passing sequentially via the oil reservoir, subjected to the discharge pressure, and the revolving bearing, and has the downstream side where the bearing sliding portion supporting the drive shaft is provided. With this arrangement, there can be provided the inexpensive and space-saving oil feed pump in which simultaneously with the start of rotation of the drive shaft, the trochoide pump device operates to draw the lubricating oil in the oil reservoir so as to forcibly lubricate the sliding surface of the revolving bearing slidably connecting the drive shaft and the revolving scroll, and also to supply the oil to the bearing sliding portion supporting the drive shaft. By doing so, the excessive compression load at the initial stage of the activation is supported through the sufficient feed of the oil to the bearing from the initial stage of the activation, thereby enhancing the durability of the compressor.

Also, according to the ninth invention, there are provided the drive shaft supported on the stationary member fixing the fixed scroll, and the revolving bearing portion which slidably connects the drive shaft and the revolving scroll together so as to impart a revolving motion to the revolving scroll; there is provided the oil feed pump device which has the annular piston whose inner surface is slidably contacted with the outer peripheral portion of the sliding connection portion between the drive shaft and the revolving scroll outside thereof, so that a pumping action is performed by a swinging movement of the piston effected in response to the revolving motion of the revolving scroll, the pump device being provided between the main bearing, which supports the drive shaft and is provided on the stationary member close to the revolving scroll, and the sliding connection portion; there is provided the oil feed passage communicating between the oil reservoir, subjected to the discharge pressure, and the bearing sliding portion related to the drive shaft; and the oil feed pump device is provided halfway in the oil feed passage. With this arrangement, there can be provided the oil feed pump in which since the outer peripheral portion of the sliding connection portion, which revolves with the revolving scroll and is the drive side, is intermittently brought into sliding contact with the inner surface of the piston which is the driven side, the sliding speed is low, and the high durability of the pump is achieved. Therefore, the durability of the bearing is enhanced.

Also, by the intermittent movement of the piston, the pump ability can be reduced, and the excessive pump input is not needed, and the parts constituting the pump can be reduced in size, thereby enabling the use of the space-saving oil feed pump.

As a result, the main bearing can be disposed close to the revolving scroll to reduce the compression load acting on the main bearing, and the durability of the bearing can be enhanced, and the input loss can be reduced.

Also, according to the third invention, there are provided the oil reservoir subjected to the discharge pressure, the bearing which is provided on the stationary member fixing the fixed scroll and supports the drive shaft, and the back-pres sure chamber provided at that side of the revolving scroll directed away from the compression chambers; there is provided the pressure differential oil feed passage passing sequentially via the oil reservoir, the bearing, the back-pressure chamber and the compression chambers (or the intake chamber); and the open portion of the passage communicating from the bearing to the back-pressure chamber which open portion is open to the back-pressure chamber is intermittently opened and closed by a reciprocal movement of th sliding surface of the rotation prevention means. With this arrangement, when the lubricating oil in the oil reservoir subjected to the discharge pressure is to be flowed by the pressure differential oil feed into the back-pressure chamber of the revolving scroll, the oil can be forcibly fed to the sliding surface of the Oldham's ring in contact with the stationary member. The oil film is filled in this sliding gap so as to reduce the substantial sliding gap, and also to reduce the impingement upon the revolving scroll or the stationary member when the rotation prevention member is reversely moved, so that vibrations and noises can be prevented from being generated from the rotation prevention member.

Also, according to the fourth invention, there are provided the oil reservoir subjected to the discharge pressure, the bearing which is provided on the stationary member fixing the fixed scroll and supports the drive shaft, and the back-pressure chamber provided at that side of the revolving scroll directed away from the compression chambers. There is provided the pressure differential oil feed passage passing sequentially via the oil reservoir, the bearing, the back-pressure chamber and the compression chambers (or the intake chamber). The open portion of the passage communicating from the bearing to the back-pressure chamber which open portion is open to the back-pressure chamber is intermittently opened and closed by the reciprocal movement of the sliding surface of the key portion of the rotation prevention member engaged with the stationary member. With this arrangement, when the lubricating oil in the oil reservoir subjected to the discharge pressure is to be flowed by the pressure differential oil feed into the back-pressure chamber of the revolving scroll, the key portion by which the rotation prevention member is slidably engaged with the stationary member is forcibly lubricated, thereby reducing the wear of the key portion. By doing so, the backlash in the direction of rotation of the rotation prevention member can be reduced, and the relative angle of engagement between the revolving scroll and the fixed scroll is always kept constant, and the gap in the radial direction of the compression chambers is prevented from being biased to be increased, and the impingement between the wraps of the revolving scroll and the fixed scroll is prevented, and the high compression efficiency can be maintained, and the low-noise/low-vibration design can be achieved.

Also, according to the thirteenth invention, there is provided the main bearing which supports the drive shaft, and is provided on the stationary member fixing the fixed scroll, and is disposed close to the revolving scroll, and also there is provided the revolving bearing which slidably connects the drive shaft and the revolving scroll together so as to impart a revolving motion to the revolving scroll; the capacity-type oil feed pump device, operated by the rotational motion of the drive shaft, is provided between the main bearing and the revolving bearing; and there is provided the oil feed passage passing sequentially via the oil reservoir subjected to the discharge pressure, the capacity-type oil feed pump device, the main bearing, the revolving bearing, the back-pressure chamber provided at that side of the revolving scroll directed away from the compression chambers, and the compression chambers. With this arrangement, simultaneously with the activation of the compressor, the lubricating oil in the oil reservoir subjected to the discharge pressure is supplied to the bearing sliding portion to support the compression pressure, thereby starting the smooth compression operation.

Also, by the sequential supply via the back-pressure chamber of the revolving scroll and the compression chambers, the increasing of the pressure of the back-pressure chamber as well as the oil supply to the sliding portion can be achieved, and therefore immediately after the activation, the revolving scroll can be urged toward the fixed scroll, and the gap of the compression chambers is sealed by the oil film of the lubricating oil so as to reduce the compression leakage, and the compression efficiency can be enhanced from the initial stage of the activation, and the durability of the sliding portion can be enhanced.

Also, by providing the oil film in the gap of the sliding portion at the initial stage of the activation, the reduction of its substantial gap and the damping effect of the oil film reduce the impingement of the movable members caused due to the unstable operation at the initial stage of the activation, thereby preventing the generation of noises and vibrations.

According to the eleventh invention, there are provided the drive shaft supported on the stationary member fixing the fixed scroll, and the revolving bearing portion which slidably connects the drive shaft and the revolving scroll together so as to impart a revolving motion to the revolving scroll; there is provided the revolving cylindrical piston-type oil feed pump device which has the annular piston whose inner surface is slidably contacted with the outer peripheral portion of the sliding connection portion between the drive shaft and the revolving scroll outside thereof, part of the outer peripheral portion of the piston being movably engaged with the stationary member, so that a pumping action is performed by a swinging movement of the piston effected in response to the revolving motion of the revolving scroll, the pump device being provided between the main bearing, which supports the drive shaft and is provided on the stationary member close to the revolving scroll, and the sliding connection portion; there is provided the oil feed passage communicating between the oil reservoir, subjected to the discharge pressure, and the bearing sliding portion related to the drive shaft; and the oil feed pump device is provided halfway in the oil feed passage. With this arrangement, there can be achieved the small-capacity and small-input pump mechanism in a space-saving manner, in which the swinging movement of the piston of the oil feed pump device which is smaller than the diameter of revolution of the revolving scroll is applied from inside the piston. As a result, even during the high-speed operation, the input loss can be reduced, and the scroll compression mechanism portion can be reduced in size to reduce the distance between the compression chambers and the main bearing, and the compression load on the main bearing supporting the drive shaft can be reduced, and the bearing durability can be enhanced at the same time.

Also, according to the twelfth invention, there are provided the main bearing which is provided on the stationary member fixing the fixed scroll and supporting the drive shaft and is disposed close to the revolving scroll, and the revolving bearing portion which slidably connects the drive shaft and the revolving scroll together so as to impart a revolving motion to the revolving scroll; the slide vane-type oil feed pump device is provided between the main bearing and the revolving scroll, the pump device comprising the rotor rotatable coaxially with the drive shaft, and the vane movable back and forth in the groove, formed in the rotor, so as to dividingly seal the interior of the pump chamber; there is provided the oil feed passage communicating between the oil reservoir subjected to the discharge pressure and the bearing sliding potions of the main bearing and the revolving bearing; the slide vane-type oil feed pump device is provided halfway in the oil feed passage; and the back-pressure urging force of the vane depends only on the centrifugal force based on the weight of the vane. With this arrangement, during the low-speed operation immediately after the activation of the compressor in the cooled condition, the centrifugal force of the vane of the slide vane-type oil feed pump device is small, and therefore the sealing separation between the intake side and discharge side of the pump chamber is made incomplete to thereby interrupt the substantial pumping action to stop the supply of the condensation liquid of the compressed gas (which is not evaporated from the lubricating oil and is introduced into the oil reservoir) to the bearing, thereby preventing the lubricating oil, residing on the bearing sliding surface, from flowing therefrom, and the bearing durability can be enhanced.

Also, in the normal operating speed region of the compressor in which the evaporation of the condensation liquid of the compressed ga from the lubricating oil in the oil reservoir has been completed, an efficient oil feed pumping can be carried out by the sealing division of the pump chamber by the vane supplied with the sufficient centrifugal force.

Also, when an abnormal pressure develops in the pump chamber, the vane is retracted against the centrigural force of the vane by the lubricating oil pressure acting on the distal end of the vane, so as to adjustably reduce the pressure of the pump chamber, and therefore the pump input can be reduced.

Also, according to the thirteenth invention, there are provided the plurality of radial bearings supporting the drive shaft and provided on the stationary member fixing the fixed scroll, and the oil reservior provided between the radial bearings; the back-pressure chamber is provided outside the bearing disposed a that side of the revolving scroll directed away from the compression chambers; there is provided the pressure differential oil feed passage passing sequentially via the oil reservoir subjected to the discharge pressure, the radial bearing, the oil reservoir, the back-pressure chamber and the compression chambers; and the throttle passage is provided between the back-pressure chamber and the oil reservoir. With this arrangement, after the lubricating oil in the oil reservoir subjected to the discharge pressure is passed via the main bearing, supporting the drive shaft, and the oil reservoir so as to be decreased in pressure, this oil is supplied by the pressure differential to the back-pressure chamber of the revolving scroll, and therefore even if the lubricating oil in the oil reservoir becomes insufficient temporarily, the lubricating oil stored in the oil reservoir can be continuously supplied to the back-pressure chamber, and the abnormal pressure increase due to the flow of the gas into the back-pressure chamber can be prevented, and the lowering of the compression efficiency as well as the lowering of the durability of the sliding portion can be prevented.

Also, during the stop of the compressor, by the provision of the lubricating oil in the oil reservoir, the gas in the space leading to the oil reservoir is prevented from flowing into the back-pressure chamber via the differential pressure oil feed passage, and therefore the lubricating oil in the back-pressure chamber can be secured at the time of re-activation of the compressor, thereby enabling the smooth start of the compression operation.

Also, by the pressure differential between the oil reservoir and the back-pressure chamber immediately after the stop of the compressor, the lubricating oil in the oil resevoir subjected to the discharge pressure flows into and fills in the oil reservoir via the bearing supporting the drive shaft. During the stop of the compressor, by the provision of the lubricating oil in the oil reservoir, the gas at the discharge side can be prevented from flowing into the back-pressure chamber. By doing so, the lubricating oil can be always stored in the back-pressure chamber, and the sliding portion immediately after the re-activation can be provided, and the durability can be further enhanced.

Also, according to the fifth invention, there is provided the pressure differential oil feed passage which passes sequentially via the back-pressure chamber provided at that side of the revolving scroll directed away from the compression chambers, the thrust bearing which supports that side of the wrap support disk of the revolving scroll directed away from the compression chambers and is disposed outside the back-pressure chamber, the outer peripheral space provided outside the wrap support disk so that the wrap support disk of the revolving scroll can be in sliding contact with the mirror plate of the fixed scroll at the outer side portion of the intake chamber, and the compression chambers; the throttle passage is provided between the back-pressure chamber and the outer peripheral space; and the throttle passage is intermittently opened and closed by the revolution of the wrap support disk. With this arrangement, the lubricating oil in the oil reservoir subjected to the discharge pressure is reduced to a medium pressure, and is caused to flow into the back-pressure chamber of the revolving scroll, and then is further caused to flow via the throttle passage into the outer peripheral space at the outer peripheral portion of the wrap support disk supporting the volute-like wrap of the revolving scroll, and by intermittently opening and closing its passage, the oil feed under a reduced pressure can be carried out. As a result, the pressure differential between the outer peripheral space and the intake chamber is reduced, so that the lubricating oil in the outer peripheral space is prevented from leaking into the intake chamber, thereby preventing the intake efficiency of the intake cooling medium gas from being lowered.

Also, according to the sixth invention, there is provided the bearing which leads to the oil reservoir subjected to the discharge pressure, and is provided on the stationary member fixing the fixed scroll, and supports the drive shaft; the annular seal member, which separates the high-pressure lubricating oil space of said two bearing portions, leading to the oil reservoir, from the back-pressure chamber provided at that side of the revolving scroll directed away from the compression chambers and disposed outside the high-pressure lubricating oil space, is provided between the stationary member and the revolving scroll; the seal member is movably received in the annular groove in the revolving scroll with a very small gap therebetween; there is provided the pressure differential oil feed passage passing sequentially via the oil reservoir, the bearings, the back-pressure chamber and the compression chambers (or the intake chamber); and the open portion of the passage communicating from the bearing to the back-pressure chamber which open portion is open to the back-pressure chamber is intermittently opened and closed by a revolving motion of the sliding surface of the annular seal member. With this arrangement, when the lubricating oil in the oil reservoir subjected to the discharge pressure is to be flowed into the back-pressure chamber of the revolving scroll, the oil is forcibly fed to the sliding surface of the annular seal member, and the oil film of this lubricating oil is filled in the sliding gap to reduce wear of the sliding surfaces of the stationary member and the annular seal member, and the sealing durability of the annular seal member can be enhanced. As a result, the flow of a large amount of the lubricating oil into the back-pressure chamber is prevented to prevent an abnormal pressure increase of the back-pressure chamber, and the increase of the input and the lowering of the durability are prevented.

Also, according to the fourteenth invention, there is provided the oil feed passage passing sequentially via the back-pressure chamber provided at that side of the revolving scroll directed away from the compression chambers, the thrust bearing which supports that side of the wrap support disk of the revolving scroll directed away from the compression chambers and is provided outside the back-pressure chamber, the outer peripheral space which is provided outside the wrap support disk so that the wrap support disk of the revolving scroll can be in sliding contact with the mirror plate of the fixed scroll at the outer portion of the intake chamber, and the oil passage which opens to the sliding surface of the mirror plate disposed in sliding contact with the wrap support disk and is communicated with the outer peripheral space; the oil reservoir subjected to the discharge pressure is provided at the upstream side of the oil feed passage whereas the compression space intermittently communicated with the intake chamber is provided at the downstream side thereof; and the oil passage, communicating between the back-pressure chamber and the outer peripheral space, and the communication end of the oil passage to the outer peripheral space are provided in opposite relation to each other with respect to the center of the revolving scroll. With this arrangement, the lubricating oil, flowed from the oil reservoir into the back-pressure chamber, flows into the outer peripheral space, and thereafter is divided toward both sides of the outer peripheral portion of the wrap support disk to flow through the entire region of the outer peripheral space, and then flows into the oil feed passage formed in the mirror plate and leading to the compression chambers. Therefore, the lubricating oil can be supplied to both sides of the lap support disk over the entire region thereof, and the durability of the wrap support disk is enhanced, and further by the sealing effect of the oil film between the outer peripheral space and the intake chamber, the lubricating oil will not flow from the outer peripheral space into the intake chamber, thereby preventing the lowering of the intake efficiency.

Also, the oil film can be always provided on the sliding surface, and therefore the impingement between the wrap support disk and the mirror plate sliding surface, caused by a temporary tilting of the revolving scroll due to the inertia force and the centrifugal force produced during the high-speed revolution of the revolving scroll, is reduced, thereby reducing vibrations and noises.

I claim:

1. A scroll compressor comprising:

(a) a sealed vessel;

(b) a compression mechanism disposed within said sealed vessel and comprising:

a fixed scroll including a mirror plate, a volute-like fixed scroll wrap formed on one side of said mirror plate, and a discharge port provided on said mirror plate at a position corresponding to a central portion of said fixed scroll wrap, a revolving scroll including a support disk and a revolving scroll wrap provided on said support disk, said revolving scroll wrap being swingably rotatably engaged with said fixed scroll wrap so as to form a volute-like compression space between said fixed scroll and said revolving scroll, said fixed scroll wrap and said revolving scroll wrap including means for dividing said compression space into a plurality of compression chambers for continuously shifting from an intake side toward a discharge side, a stationary member, and rotation prevention means, engaged between said revolving scroll and said stationary member, for preventing said revolving scroll from rotating, said revolving scroll revolving so as to compress a fluid;

(c) a drive shaft;

(d) a main bearing provided on said stationary member in close proximity to said revolving scroll and supporting said drive shaft;

(e) a revolving bearing for slidably interconnecting said drive shaft and said revolving scroll so as to impart a revolving motion to said revolving scroll;

(f) an oil reservoir, disposed over said scroll compression mechanism, for holding oil and being subjected to discharge pressure;

(g) an oil feed pump, operated by rotation of said drive shaft, for supplying said oil to said main bearing and said revolving bearing;

(h) a bearing oil supply passage for returning said oil supplied to said bearings to said oil reservoir;

(i) a back pressure chamber provided at a side of said revolving scroll opposite to a side of said revolving scroll facing said compression chambers and;

(j) an oil injection passage having a throttle passage for sequentially supplying a portion of said oil that is being supplied to at least one of (1) said main bearing and (2) said revolving bearing to said pack-pressure chamber and said compression chambers.

2. A scroll compressor according to claim 1, wherein:

an open portion of said oil injection passage, communicating with said back pressure chamber and one of said bearings, is operatively associated with said rotation prevention means; and said open portion is intermittently opened and closed by reciprocal movement of a sliding surface of said rotation prevention means.

3. A scroll compressor according to claim 2, wherein said sliding surface of said rotation prevention means comprises a key portion engaged with said stationary member.

4. A scroll compressor according to claim 1, wherein:

an outer peripheral space is formed outside said wrap support disk so as to allow said wrap support to be in sliding contact with said mirror plate;

a throttle passage is provided between said back pressure chamber and said outer peripheral space; and said throttle passage is intermittently opened and closed in response to revolution of said wrap support disk.

5. A scroll compressor according to claim 1, further comprising:

a trochoide pump, comprising an inner rotor and an outer rotor, disposed on a side of said rotating bearing which is adjacent to said compression chambers, said inner rotor being connected to said drive shaft and said outer rotor being disposed within said revolving scroll.

6. A scroll compressor according to claim 1, wherein:

said oil feed pump device comprises an annular piston having an inner surface;

said inner surface of said piston is in slidable contact with an outer peripheral portion of a connection portion, said connection portion being provided between said drive shaft and said revolving scroll; and said oil feed pump is disposed between said main bearing and said connection portion.

7. A scroll compressor according to claim 1, wherein said oil feed pump is a capacity-type oil feed pump.

8. A scroll compressor according to claim 1, wherein:

said oil feed pump is a revolving cylindrical piston-type oil feed pump comprising an annular piston having an inner surface;

said inner surface of said piston is in slidable contact with an outer peripheral portion of a connection portion, said connection portion being provided between said drive shaft and said revolving scroll; and said oil feed pump is disposed between said main bearing and said connection portion.

9. A scroll compressor according to claim 1, wherein:

said oil feed pump is a slide vane-type oil feed pump comprising (a) a rotor having a groove formed therein and coaxially rotatable with said drive shaft, and (b) a vane movable back and forth within said groove in said rotor, a back pressure urging force of said vane depending only on a centrifugal force associated with a weight of said vane; and said oil feed pump is disposed between said main bearing and said revolving scroll.

10. A scroll compressor according to claim 1, further comprising a plurality of radial bearings, disposed on said stationary member, for supporting said drive shaft.

11. A scroll compressor according to claim 1, further comprising a thrust bearing for supporting a side of said wrap support disk which faces away from said compression chambers; and an outer peripheral space formed outside said wrap support disk so as to allow said wrap support to be in sliding contact with said mirror plate.

12. A scroll compressor comprising:

(a) a sealed vessel;

(b) a compression mechanism disposed within said sealed vessel and comprising:

a fixed scroll including a mirror plate, a volute-like fixed scroll wrap formed on one side of said mirror plate, and a discharge port provided on said mirror plate at a position corresponding to a central portion of said fixed scroll wrap, a revolving scroll including a support disk and a revolving scroll wrap provided on said support disk, said revolving scroll wrap being swingably rotatably engaged with said fixed scroll wrap so as to form a volute-like compression space between said fixed scroll and said revolving scroll, said fixed scroll wrap and said revolving scroll wrap including means for dividing said compression space into a plurality of compression chambers for continuously shifting from an intake side toward a discharge side, a stationary member, and rotation prevention means, engaged between said revolving scroll and said stationary member, for preventing said revolving scroll from rotating, said revolving scroll revolving so as to compress a fluid;

(c) an oil reservoir, disposed over said scroll compression mechanism, for holding oil and being subjected to discharge pressure;

(d) an oil feed passage which leads to said compression chambers sequentially from said oil reservoir;

(e) a back pressure chamber provided at a side of said revolving scroll opposite to a side of said revolving scroll facing said compression chambers;

(f) a communication passage between said back pressure chamber and said compression chambers; and (g) means for intermittently opening and closing a flow inlet to said back pressure chamber and said communication passage in accordance with revolution of said revolving scroll.

13. A scroll compressor comprising:

(a) a sealed vessel;

(b) a compression mechanism disposed within said sealed vessel and comprising:

a fixed scroll including a mirror plate, a volute-like fixed scroll wrap formed on one side of said mirror plate, and a discharge port provided on said mirror plate at a position corresponding to a central portion of said fixed scroll wrap, a revolving scroll including a support disk and a revolving scroll wrap provided on said support disk, said revolving scroll wrap being swingably rotatably engaged with said fixed scroll wrap so as to form a volute-like compression space between said fixed scroll and said revolving scroll, said fixed scroll wrap and said revolving scroll wrap including means for dividing said compression space into a plurality of compression chambers for continuously shifting from an intake side toward a discharge side, a stationary member, and rotation prevention means, engaged between said revolving scroll and said stationary member, for preventing said revolving scroll from rotating, said revolving scroll revolving so as to compress a fluid;

(c) a drive shaft;

(d) an oil reservoir for holding oil and being subjected to discharge pressure;

(e) a bearing, mounted on said stationary member, having a first portion leading to said oil reservoir and a second portion supporting said drive shaft;

(f) a high pressure lubricating oil space formed by said first portion and said second portion of said bearing;

(g) a back pressure chamber provided at a side of said revolving scroll opposite to a side of said revolving scroll facing said compression chambers;

(h) an annular seal member for separating said high pressure lubricating oil space from said from said back pressure chamber, said annual seal member being movably received in an annular groove formed in said revolving scroll with a very small gap therebetween; and (i) a pressure differential oil feed passage sequentially passing said oil reservoir, said bearing, said back pressure chamber and one of (1) said compression chambers and (2) said intake chamber, an open portion of said passage communicating from said bearing to said back pressure chamber being intermittently opened and closed by revolving motion of a sliding surface of said annular seal member.

14. A scroll compressor comprising:

(a) a sealed vessel;

(b) a compression mechanism disposed within said sealed vessel and comprising:

a fixed scroll including a mirror plate, a volute-like fixed scroll wrap formed on one side of said mirror plate, and a discharge port provided on said mirror plate at a position corresponding to a central portion of said fixed scroll wrap, a revolving scroll including a support disk and a revolving scroll wrap provided on said support disk, said revolving scroll wrap being swingably rotatably engaged with said fixed scroll wrap so as to form a volute-like compression space between said fixed scroll and said revolving scroll, said fixed scroll wrap and said revolving scroll wrap including means for dividing said compression space into a plurality of compression chambers for continuously shifting from an intake side toward a discharge side, a stationary member, and rotation prevention means, engaged between said revolving scroll and said stationary member, for preventing said revolving scroll from rotating, said revolving scroll revolving so as to compress a fluid;

(c) a drive shaft;

(d) a main bearing provided on said stationary member and in close proximity to said revolving scroll and supporting said drive shaft;

(e) a revolving bearing for slidably connecting said drive shaft to said revolving scroll so as to impart a revolving motion to said revolving scroll;

(f) an oil chamber provided between said main bearing and said revolving bearing;

(g) an oil reservoir, disposed over said scroll compression mechanism, for holding oil and being subjected to discharge pressure;

(h) an oil suction passage communicating between said oil chamber and said oil reservoir;

(i) spiral oil grooves formed in sliding surfaces of each of said main bearing and said revolving bearing for producing viscosity pumping action; and (j) an oil passage for providing communication between a suction side of each of said spiral oil grooves and said oil chamber and for providing communication between a discharge side of each of said spiral oil grooves with one of (1) said oil reservoir and (2) said compression chambers.

* * * * *